US005648190A

United States Patent [19]

Kato et al.

[11] Patent Number: 5,648,190

[45] Date of Patent: Jul. 15, 1997

[54] METHOD OF FORMING COLOR IMAGES AND APPARATUS USED THEREFOR

[75] Inventors: Eiichi Kato; Sadao Osawa; Yusuke Nakazawa, all of Shizuoka, Japan

[73] Assignee: Fuji Photo Film Co., Ltd., Kanagawa, Japan

[21] Appl. No.: 374,713

[22] PCT Filed: May 27, 1994

[86] PCT No.: PCT/JP94/00847

§ 371 Date: Mar. 27, 1995

§ 102(e) Date: Mar. 27, 1995

[87] PCT Pub. No.: WO94/28466

PCT Pub. Date: Dec. 8, 1994

[30] Foreign Application Priority Data

May 27, 1993 [JP] Japan ..... 5-146767

[51] Int. Cl.[6] ..... G03G 13/01; G03G 13/14; G03G 15/01

[52] U.S. Cl. ..... 430/47; 430/126; 399/298

[58] Field of Search ..... 430/47, 126; 355/271, 355/327

[56] References Cited

U.S. PATENT DOCUMENTS 3,847,642 11/1974 Rhodes ..... 430/126

3,999,481 12/1976 Sankus ..... 430/126 X 5,176,974 1/1993 Till et al. ..... 430/126 X 5,370,960 12/1994 Cahill et al. ..... 430/126 X

FOREIGN PATENT DOCUMENTS 0078476 5/1983 European Pat. Off. ..... 430/126

*Primary Examiner*—Roland Martin

*Attorney, Agent, or Firm*—Sughrue, Mion, Zinn, Macpeak & Seas

[57] ABSTRACT

A method of forming a color image comprising providing a first peelable transfer layer 12 on an electrophotographic light-sensitive element 11 whose surface has releasability, forming one or more color toner images 3 on the first transfer layer by a conventional electrophotographic process, further forming a second transfer layer 13 on the toner images 3, and transferring the toner images 3 together with the first transfer layer 12 and the second transfer layer 13 to a receiving material 16 is disclosed. The method is excellent in transferability of toner image and provides simply and stably color images of high accuracy and high quality without color shear. The transfer layer has good releasability from an electrophotographic light-sensitive element and good adhesion to a receiving material. A color duplicate formed has good retouching property, sealing property and storage stability.

6 Claims, 5 Drawing Sheets

METHOD OF FORMING COLOR IMAGES AND APPARATUS USED THEREFOR

TECHNICAL FIELD

The present invention relates to a method of forming a color image and an apparatus used therefor such as an electrophotographic color duplicator, a color printer, a color proofer or a color checker.

TECHNICAL BACKGROUND

Methods of forming color printings, color duplicates or color proofs (proofs for printing) which comprises conducting development with electrophotographic developing agents to form a plurality of over-lapping color toner images directly on the surface of electrophotographic light-sensitive element and transferring the resulting color images at once onto a receiving material such as printing paper have hitherto been known.

The developing methods include a so-called dry type developing method and wet type developing method. Color images obtained by the wet type developing method are preferred because of little color shear and good resolution as compared with those formed with dry toners. However, it is very difficult to directly transfer wet type toner images entirely from the surface of the light-sensitive element to printing paper.

In order to solve this problem, a transfer technique in which a non-aqueous solvent is supplied between a light-sensitive element and a receiving material and then transfer is electrostatically performed is described in JP-A-2-272469 (the term "JP-A" as used herein means an "unexamined published Japanese patent application").

Also, a method in which a transparent film is first laminated on the surface of a light-sensitive element, wet type toner images are formed by an electrophotographic process on the film, and then the film bearing the toner images is separated from the light-sensitive element and stuck on paper, thereby forming transferred images is described in JP-A-2-115865 and JP-A-2-115866. According to the method, the film to be laminated has suitably a thickness of 9 μm. However, the production and handling of a film having such thickness is very troublesome and it is necessary to arrange a special system for them.

Further, in JP-B-2-43185 (the term "JP-B" as used herein means an "examined Japanese patent publication"), a method in which imagewise exposure through a transparent electrophotographic light-sensitive element and development are conducted repeatedly to form over-lapping color separation images on a dielectric support releasably provided on the light-sensitive element and the dielectric support bearing the images is transferred to a receiving material is described. Since the imagewise exposure is performed from the side of substrate for the light-sensitive element according to this method, the substrate is required to be transparent. This is disadvantageous in view of a cost.

On the other hand, an electrophotographic transfer method using a so-called dry type developing method in which a releasable transfer layer is provided on the surface of a light-sensitive element, toner images are formed on the transfer layer and the toner images are transferred together with the transfer layer to printing paper is described in JP-A-1-112264, JP-A-1-281464 and JP-A-3-11347.

Moreover, in EP-A-0534479, a method in which a transfer layer is formed on the surface of light-sensitive element which has releasability, one or more color toner images are formed on the transfer layer by an electrophotographic process and then the toner images are transferred together with the transfer layer onto a receiving material is described. However, a latitude of conditions on the transfer (for example, heating temperature, pressure and transportation speed) of toner images together with the transfer layer is still narrow and unsatisfactory in this method.

In order to obtain good color images by a color image-forming method in which toner images are transferred together with the transfer layer to printing paper various kinds of requirements must be satisfied.

First, it is important that the transfer layer should be uniformly provided in order to perform uniform charging and exposure to light and not degrade electrophotographic characteristics of an electrophotographic light-sensitive element since toner images are formed upon an electrophotographic process. Also, the transfer layer is desired to have good releasability from an electrophotographic light-sensitive element and good adhesion to a receiving material in order to conduct easy transfer in the transfer step. Particularly, an enlarged latitude of transfer conditions (for example, heating temperature, pressure and transportation speed) is required. Moreover, it is desired that a color duplicate obtained accept retouching and sealing without causing any trouble and have good storage stability, for example, in that the transfer layer is not peeled off when the color duplicate has been filed between plastic sheets and piled up.

However, these characteristics have not been fully considered in the techniques hitherto known and image forming performance of color image, transferability of transfer layer and retouching property, sealing property and storage stability of color duplicate are not satisfactorily good.

The present invention is to solve the above-described various problems associated with conventionally known methods of forming electrophotographic transfer images.

An object of the present invention is to provide a method of forming an electrophotographic color image which is excellent in transferability of toner image, which provides simply and stably color images of high accuracy and high quality without color shear, in which a transfer layer has good releasability from an electrophotographic light-sensitive element and good adhesion to a receiving material, and a color duplicate formed by which method has good retouching property, sealing property and storage stability, and an apparatus used therefor.

Another object of the present invention is to provide a method of forming a color image in which a transfer layer is formed by an apparatus of a simple structure in an electrophotographic apparatus and a light-sensitive element is repeatedly usable, thereby reducing a running cost.

DISCLOSURE OF THE INVENTION

It has been found that the above described objects of the present invention are accomplished by a method of forming a color image comprising forming at least one color toner image by an electrophotographic process on a first peelable transfer layer provided on the surface of an electrophotographic light-sensitive element whose surface has releasability, forming a second transfer layer on the toner image and transferring the toner image together with the first transfer layer and the second transfer layer onto a receiving material.

Specifically, the method of forming a color image according to the present invention comprises, as shown in FIG. 1 which is a schematic view of the process of the present invention, providing a first peelable transfer layer (X) 12 on the surface of an electrophotographic light-sensitive element 11 having at least a support 1 and a light-sensitive layer 2, forming at least one color toner image 3 on the first peelable transfer layer by a conventional electrophotographic process, forming further a second transfer layer (Y) 13 on the toner image, and then transferring the toner image 3 together with the transfer layer (X) 12 and the transfer layer (Y) 13 onto another substrate (receiving material) 16, thereby providing a color duplicate.

According to the hitherto known methods, toner images are formed on a transfer layer provided on a light-sensitive element and transferred together with the transfer layer onto a receiving material. Therefore, in order to obtain a duplicate of excellent color image, the transfer layer is required to satisfy various kinds of condition in that the transfer layer does not adversely affect electrophotographic characteristics in the electrophotographic process, in that it has good transferability (i.e., good releasability from a light-sensitive element and good adhesion to a receiving material) in the transfer step and in that it has good retouching and sealing properties and filing aptitude as the resulting color duplicate as described above.

On the contrary, the above-described various requirements for the transfer layer can be fulfilled by dividing a transfer layer into two layers (X and Y) before and after the formation of toner image, more specifically by providing the transfer layer (Y) on the first transfer layer (X) bearing toner images according to the method of the present invention to share these requirements with each other depending on its function.

Since the toner image is sandwiched between the transfer layer (X) and the transfer layer (Y) in the present invention, fixing strength of toner image is reinforced by the transfer layer, and thus the toner can be employed without taking its fixing property into careful consideration.

It is preferred in the present invention that both the first transfer layer (X) and the second transfer layer (Y) are mainly composed of a thermoplastic resin (A) having a glass transition point of not more than 140° C. or a softening point of not more than 180° C. in order to further improve transferability of the transfer layers.

It is important for the transfer layer (X) used in the present invention to have features in that it does not degrade electrophotographic characteristics (such as chargeability, dark charge retention rate and photosensitivity) until toner images are formed by an electrophotographic process, in that it has thermoplasticity sufficient for easy release from the surface of light-sensitive element in the heat transfer process and in that it accepts retouching and sealing without causing any trouble as the resulting color duplicate which has good storage stability wherein the transfer layer is not peeled from the receiving material when the duplicate has been filed between plastic sheets and piled up during storage.

On the other hand, it is important for the transfer layer (Y) to have good adhesion not only to toner images and the transfer layer (X) in the non-image areas but also to a receiving material and to be easily transferred onto a receiving material in the heat transfer process irrespective of the kind of receiving material. Particularly, good adhesion of the transfer layer (X) onto a receiving material is very important in order to accelerate the release at the interface between the transfer layer (X) and the light-sensitive element. The transfer layer (Y) does not have any restriction on the electrophotographic characteristics, since it is provided after the formation of toner image.

The first transfer layer (X) and second transfer layer (Y) are preferably so constructed as to fulfill the above-described requirements for the transfer layer in the present invention.

In particular, in the method according to the present invention wherein transfer layer (Y) is further provided on toner images formed on the surface of transfer layer (X), excellent transferability of transfer layer can be achieved by employing transfer layer (Y) which has good adhesion to a receiving material in comparison with a case of conducting transfer without the formation of transfer layer (Y).

Moreover, a stratiform structure composed of a first transfer layer (X) containing a thermoplastic resin (AH) having a glass transition point of from 10° C. to 140° C. or a softening point of from 35° C. to 180° C. provided on the surface of light-sensitive element and a second transfer layer (Y). containing a thermoplastic resin (AL) having a glass transition point of not more than 45° C. or a softening point of not more than 60° C. which is to adhere to a receiving material is preferred in the present invention. By adopting such a configuration, transferability of the transfer layer to a receiving material is remarkably improved, a further enlarged latitude of transfer conditions (e.g., heating temperature, pressure, and transportation speed) can be achieved, and the transfer can be easily performed irrespective of the kind of receiving material to form a color duplicate. Moreover, the above-described filing aptitude is more improved since the surface of the transfer layer transferred onto a receiving material is composed of the thermoplastic resin (AH) having a high glass transition point or softening point, and the retouching property and sealing property similar to those of normal paper may be imparted to the resulting color duplicate by appropriately selecting the thermoplastic resin (AH).

Furthermore, by introducing a polymer component (F) containing at least one of a silicon atom and a fluorine atom (hereinafter referred to as a silicon atom and/or fluorine atom-containing polymer ,component (F) sometimes) as a copolymer component into the thermoplastic resins (AH) and/or (AL), an effect for further increasing releasability of the resins themselves is obtained.

On the other hand, an adhesive strength of the surface of an -electrophotographic light-sensitive element employed in the present invention which surface is to be come into contact with the transfer layer measured according to JIS Z 0237-1980 "Testing methods of pressure sensitive adhesive tapes and sheets" is preferably not more than 150 gram·force (g·f), more preferably not more than 100 g·f, and furthermore preferably not more than 50 g·f in order to perform easy release of the transfer layer. By using such an electrophotographic light-sensitive element, releasability between the transfer layer and the light-sensitive element is more effectively revealed.

The measurement of adhesive strength is conducted according to JIS Z 0237-1980 8.3.1. 180 *Degrees Peeling Method* with the following modifications:

(i) As a test plate, an electrophotographic light-sensitive element on the surface of which a transfer layer is to be provided is used.

(ii) As a test piece, a pressure resistive adhesive tape of 6 mm in width prepared according to JIS C2338-1984 is used.

(iii) A peeling rate is 120 mm/min using a constant rate of traverse type tensile testing machine.

Specifically, the test piece is laid its adhesive face downward on the test plate and a roller is reciprocate one stroke at a rate of approximately 300 mm/min upon the test piece for pressure sticking. Within 20 to 40 minutes after the sticking with pressure, a part of the stuck portion is peeled approximately 25 mm in length and then peeled continuously at the rate of 120 mm/min using the constant rate of traverse type tensile testing machine. The strength is read at an interval of 20 mm in length of peeling, and eventually read 4 times. The test is conducted on three test pieces. The mean value is determined from 12 measured values for three test pieces and the resulting mean value is converted in terms of 10 mm in width.

The measurement of adhesive strength of a receiving material can also be conducted in the same manner as described above using the receiving material to be measured as the test plate.

Examples of the electrophotographic light-sensitive element, the surface of which has the releasability include specifically an electrophotographic light-sensitive element using amorphous silicon and an electrophotographic light-sensitive element containing a resin to increase releasability which contains a silicon atom and/or a fluorine atom (hereinafter referred to as a resin (P) sometimes) in a layer adjacent to the transfer layer (X) or the uppermost layer of the light-sensitive element which is to be come into contact with the transfer layer (X). By using such a light-sensitive element, the transfer layer is easily and completely transferred.

The layer containing the resin containing a silicon atom and/or a fluorine atom is a layer which is adjacent to the transfer layer (X) or which is to be come into contact with the transfer layer (X) and may or may not be a light-sensitive layer. A light-insensitive layer (an overcoat layer) having the releasability described above may be provided on a light-sensitive layer in order to impart the releasability from the transfer layer (X).

Further, the resin (P) is preferably a copolymer comprising at least one polymer segment ($\alpha$) containing not less than 50% by weight of a silicon atom and/or fluorine atom-containing polymer component and at least one polymer segment ($\beta$) containing from 0 to 20% by weight of a silicon atom and/or fluorine atom-containing polymer component, the polymer segment ($\alpha$) and ($\beta$) being bonded in the form of blocks in view of further improvement in the releasability from the transfer layer (X).

Moreover, a light-sensitive element whose surface has the releasability can also be obtained by causing a compound (S) containing at least a fluorine atom and/or a silicon atom to adsorb or adhere onto the surface of electrophotographic light-sensitive element in the present invention. By employing the means for imparting the releasability to a light-sensitive element as described above, an electrophotographic light-sensitive element conventionally used can be utilized without taking releasability of the surface of the electrophotographic light-sensitive element into consideration.

The transfer layer (X) may have been previously provided on a light-sensitive element or may be formed each time on the light-sensitive element according to the present invention. The formation of transfer layer may be performed in an apparatus different from an apparatus for an electrophotographic process and a transfer process or in the apparatus for these processes on the light-sensitive element each time.

It is preferred that the transfer layer (X) and the transfer layer (Y) are formed on a light-sensitive element and the transfer layer (X), respectively, by any one of a hot-melt coating method, an electrodeposition coating method and a transfer method.

According to the present invention, the steps for forming the transfer layer (X) and transfer layer (Y) are preferably conducted in an apparatus in which the electrophotographic process and the transfer process are carried out and the transfer layers are formed each time, since the light-sensitive element can be repeatedly employed after the transfer layers are released therefrom without throwing it away and the electrophotographic process can be advantageously performed in sequence with these steps in the same apparatus, thus resulting in an operation of a low running cost.

Therefore, one preferred embodiment of the present invention is a method of forming a color image comprising performing the following steps (i) to (iv) in the same apparatus:

(i) a step of forming a peelable transfer layer (X) on an electrophotographic light-sensitive element, (ii) a step of forming at least one color toner image on the transfer layer (X) by an electrophotographic process, (iii) a step of forming a second peelable transfer layer (Y) on the toner image, and (iv) a step of transferring the toner image together with the transfer layer (X) and (Y) onto a receiving material.

The present invention also provides a method of forming a color image further comprising a step of causing the above-described compound (S) to adsorb or adhere onto the surface of electrophotographic light-sensitive element before the step (i) of forming the transfer layer (X) in order to impart the releasability to the electrophotographic light-sensitive element in the apparatus.

In the present invention, the step (i) of forming the first transfer layer (X) on an electrophotographic light-sensitive element is performed by means of electrodeposition or adhesion of resin grains (AR) by electrophoresis on the surface of electrophotographic light-sensitive element to form a film using a dispersion for electrodeposition comprising resin grains (AR) having a glass transition point of not more than 140° C. or a softening point of not more than 180° C. dispersed in an electrically insulating organic solvent having a dielectric constant of not more than 3.5 and at least one compound (S) which has a fluorine atom and/or a silicon atom and is soluble at least 0.01 g per 1.0 liter of the organic solvent.

Since the compound (S) having a fluorine atom and/or silicon atom contained in the dispersion for electrodeposition forming the transfer layer tends to adsorb or adhere onto the surface of light-sensitive element before the electrodeposition or adhesion of dispersed resin grains (AR) by electrophoresis on the surface of light-sensitive element, releasability has been imparted onto the surface of light-sensitive element at the formation of transfer layer, thereby effectively providing transferability of the transfer layer. According to such a procedure, the impartation of releasability and formation of transfer layer onto the electrophotographic light-sensitive element can be performed at the same time and a specific technique for imparting releasability on the surface of light-sensitive element is not necessary.

The preparation of a uniform and thin layer can be easily performed by supplying resin grains (AR) between the electrophotographic light-sensitive element and an electrode placed in face of the light-sensitive element and migrating the resin grains (AR) by electrophoresis according to a potential gradient applied from an external power source to cause the grains (AR) to electrodeposite on or adhere to the electrophotographic light-sensitive element and form a film.

In addition, the present invention provides an apparatus for forming a color image comprising a means for forming a first peelable transfer layer on the surface of an electrophotographic light-sensitive element, a means for forming at least one color toner image on the transfer layer by an electrophotographic process, a means for forming a second peelable transfer layer on the toner image formed on the first transfer layer and a means for transferring the toner image together with the first transfer layer and the second transfer layer onto a receiving material.

The present invention also provides an apparatus for forming a color image further comprising a means for causing the compound (S) described above to adsorb or adhere onto the surface of light-sensitive element.

Now, the transfer layer which can be used in the present invention will be described in greater detail below.

The transfer layer (X) used in the present invention is not particularly limited as far as it is light-transmittive and capable of transmitting a radiation having a wavelength which constitutes at least one part of the spectrally sensitive region of electrophotographic light-sensitive element. The layer may be colored. In a case wherein duplicated images transferred on a receiving material are color images, particularly full-color images, a colorless and transparent transfer layer (X) is usually employed.

On the other hand, the transfer layer (Y) is not imposed such a restriction relating to the electrophotographic process as on the transfer layer (X) since the transfer layer (Y) is provided on the toner image which has been formed. Further, the transfer layer (Y) may contain a white pigment or a fluorescent whitening agent in order to increase whiteness of a color duplicate formed on a receiving material as a support or may contain a dye or pigment suitable for making an appropriate background color, if desired, since it constitutes the undermost layer in the color duplicate transferred on the receiving material.

It is preferred that the peelable transfer layers (X) and (Y) are both mainly composed of a thermoplastic rein (A) having a glass transition point of not more than 140° C. or a softening point of not more than 180° C. The resin (A) has more preferably a glass transition point of not more than 120° C. or a softening point of not more than 160° C., and further more preferably a glass transition point of not more than 100° C. or a softening point of not more than 140° C.

The resins (A) can be employed individually or as a mixture of two or more thereof in each of these layers.

It is preferred for the transfer layer mainly composed of the resin (A) according to the present invention to be peelable under transfer conditions of a temperature of not more than 180° C. and/or a pressure of not more than 30 Kgf/cm$^2$, particularly a temperature of not more than 160° C. and/or a pressure of not more than 20 Kgf/cm$^2$. The transfer is performed without arising practical problems under the above-described conditions because it is almost unnecessary to render a device for transfer large-sized in order to maintain the desired heat capacity and pressure for releasing and transferring the transfer layer from the surface of light-sensitive element and the transfer is sufficiently effected at an appropriate transfer speed. While there is no particular lower limit thereof, it is ordinarily preferred to use a resin layer which is peelable under transfer condition of a temperature of not less than room temperature or a pressure of not less than 100 gf/cm$^2$.

The resin (A) which can be used in the present invention may be any resins which satisfy the above described requirement on thermal property, and include thermoplastic resins and resins conventionally known as adhesive or stick. Suitable examples of such resins include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, olefin-styrene copolymers, olefin-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring (the heterocyclic ring including, for example, furan, tetrahydrofuran, thiophene, dioxane, dioxofuran, lactone, benzofuran, benzothiophene and 1,3-dioxetane rings), cellulose resins, fatty acid-modified cellulose resins and epoxy resins. Specific examples of resins are described, e.g., in *Plastic Zairyo Koza Series,* Vols. 1 to 18, Nikkan Kogyo Shinbunsha (1981), Kinki Kagaku Kyokai Vinyl Bukai (ed.), *Polyenka Vinyl*, Nikkan Kogyo Shinbunsha (1988), Eizo Omori, *Kinosei Acryl Jushi*, Techno System (1985), Ei-ichiro Takiyama, *Polyester Jushi Handbook,* Nikkan Kogyo Shinbunsha (1988), Kazuo Yuki, *Howa Polyester Jushi Handbook,* Nikkan Kogyo Shinbunsha (1989), Kobunshi Gakkai (ed.), *Kobunshi Data Handbook* (*Oyohen*), Ch. 1, Baifukan (1986), Yuji Harasaki, *Saishin Binder Gijutsu Binran,* Ch. 2, Sogo Gijutsu Center (1985), Taira Okuda (ed.), *Kobunshi Kako*, Vol. 20, Supplement "Nenchaku", Kobunshi Kankokai (1976), Keizi Fukazawa, *Nenchaku Gijutsu,* Kobunshi Kankokai (1987), Mamoru Nishiguchi, *Secchaku Binran,* 14th Ed., Kobunshi Kankokai (1985), and Nippon Secchaku Kokai (ed.), *Secchaku Handbook,* 2nd Ed., Nikkan Kogyo Shinbunsha (1980).

In a preferred embodiment, the transfer layer (X) is mainly composed of a thermoplastic resin (AH) having a glass transition point of from 10° C. to 140° C. or a softening point of from 35° C. to 180° C., more preferably a glass transition point of from 15° C. to 120° C. or a softening point of from 40° C. to 140° C.

The transfer layer (Y) is mainly composed of a thermoplastic resin (AL) having a glass transition point of not less than 45° C. or a softening point of not less than 60° C., more preferably a glass transition point of from −40° C. to 40° C. or a softening point of from −20° C. to 60° C., and a difference in the glass transition point or softening point between the resin (AH) used in transfer layer (X) and the resin (AL) used in transfer layer (Y) is at least 2° C. More preferably, a glass transition point or softening point of resin (AL) is at least 5° C. lower than one of resin (AH). The difference in the glass transition point or softening point between the resin (AH) and the resin (AL) means a difference between the lowest glass transition point or softening point of those of the resins (AH) and the highest glass transition point or softening point of those of the resins (AL) when two or more of the resins (AH) and/or resins (AL) are employed.

A weight average molecular weight of the resin (AH) is preferably from $1\times10^3$ to $1\times10^6$, more preferably from $3\times10^3$ to $5\times10^5$. Also, a weight average molecular weight of the resin (AL) is preferably from $3\times10^3$ to $1\times10^6$, more preferably from $5\times10^3$ to $5\times10^5$.

According to the present invention, the resin (AH) and resin (AL) each having a glass transition point or a softening point in the above-described range are appropriately selected from the resins (A) descrbed above.

The thermoplastic resins (AH) and/or (AL) used in the transfer layer of the present invention preferably contains a polymer component (F) containing a moiety having a fluorine atom and/or a silicon atom which has an effect to increase the releasability of the resin (A) itself as a polymer component in the resin described above.

The moiety having a fluorine atom and/or a silicon atom may be incorporated into the main chain of the polymer or contained as a substituent in the side chain of the polymer.

The polymer components (F) are preferably present as a block in the resin (A). The content of polymer component (F) is preferably from 3 to 40% by weight, more preferably from 5 to 25% by weight of the total polymer components of the resin (A) (including the resins (AH) and (AL)). The polymer component (F) containing a fluorine atom and/or a silicon atom may be incorporated into any of the resin (AH) and resin (AL). It is desirable to incorporate the polymer component (F) into the resin (AH) in order to effectively increase the releasability of the transfer layer from the electrophotographic light-sensitive element, resulting in improvement of the transferability.

The polymer component (F) which has an effect for increasing the releasability of the resin (A) itself will be described below.

The fluorine atom-containing moieties include monovalent or divalent organic residues, for example, $-C_hF_{2h+1}$ (wherein h represents an integer of from 1 to 18), $-(CF_2)_jCF_2H$ (wherein j represents an integer of from 1 to 17), $-CFH_2$,

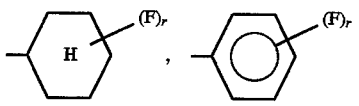

(wherein r represents an integer of from 1 to 5), $-CF_2-$, $-CFH-$,

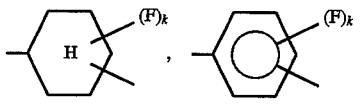

(wherein k represents an integer of from 1 to 4).

The silicon atom-containing moieties include monovalent or divalent organic residues, for example,

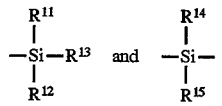

wherein $R^{11}$, $R^{12}$, $R^{13}$, $R^{14}$, and $R^{15}$, which may be the same or different, each represents a hydrocarbon group which may be substituted or $-OR^{16}$ wherein $R^{16}$ represents a hydrocarbon group which may be substituted.

The hydrocarbon group represented by $R^{11}$, $R^{12}$, $R^{13}$, $R^{14}$, $R^{15}$ or $R^{16}$ include specifically an alkyl group having from 1 to 18 carbon atoms which may be substituted (e.g., methyl, ethyl, propyl, butyl, hexyl, octyl, decyl, dodecyl, hexadecyl, 2-chloroethyl, 2-bromoethyl, 2,2,2-trifluoroethyl, 2-cyanoethyl, 3,3,3-trifluoropropyl, 2-methoxyethyl, 3-bromopropyl, 2-methoxycarbonylethyl, or 2,2,2,2',2',2'-hexafluoroisopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, or 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, or dimethoxybenzyl), an alicyclic group having from 5 to 8 carbon atoms which may be substituted (e.g., cyclohexyl, 2-cyclohexylethyl, or 2-cyclopentylethyl), or an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, or dodecyloylamidophenyl).

The fluorine atom and/or silicon atom-containing organic residue may be composed of a combination thereof. In such a case, they may be combined either directly or via a linking group. The linking groups include divalent organic residues, for example, divalent aliphatic groups, divalent aromatic groups, and combinations thereof, which may or may not contain a bonding group, e.g.,

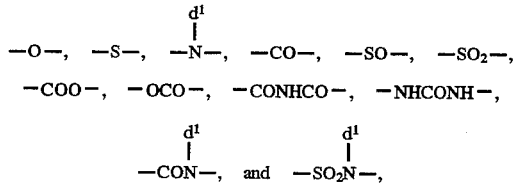

wherein $d^1$ has the same meaning as $R^{11}$ above.

Examples of the divalent aliphatic groups are shown below.

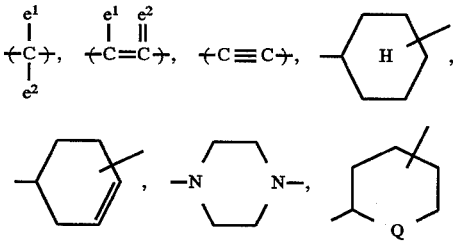

wherein $e^1$ and $e^2$, which may be the same or different, each represents a hydrogen atom, a halogen atom (e.g., chlorine or bromine) or an alkyl group having from 1 to 12 carbon atoms (e.g., methyl, ethyl, propyl, chloromethyl, bromomethyl, butyl, hexyl, octyl, nonyl or decyl); and Q represents

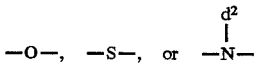

wherein $d^2$ represents an alkyl group having from 1 to 4 carbon atoms, $-CH_2Cl$, or $-CH_2Br$.

Examples of the divalent aromatic groups include a benzene ring, a naphthalene ring, and a 5- or 6-membered heterocyclic ring having at least one hetero atom selected from an oxygen atom, a sulfur atom and a nitrogen atom. The aromatic groups may have a substituent, for example, a halogen atom (e.g., fluorine, chlorine or bromine), an alkyl group having from 1 to 8 carbon atoms (e.g., methyl, ethyl, propyl, butyl, hexyl or octyl) or an alkoxy group having from 1 to 6 carbon atoms (e.g., methoxy, ethoxy, propoxy or butoxy). Examples of the heterocyclic ring include a furan ring, a thiophene ring, a pyridine ring, a piperazine ring, a tetrahydrofuran ring, a pyrrole ring, a tetrahydropyran ring, and a 1,3-oxazoline ring.

Specific examples of the repeating units having the fluorine atom and/or silicon atom-containing moiety as described above are set forth below, but the present invention should not be construed as being limited thereto. In formulae (F-1) to (F-32) below, $R_f$ represents any one of the following groups of from (1) to (11); and b represents a hydrogen atom or a methyl group.

$-C_nF_{2n+1}$ (1)

$-CH_2C_nF_{2n+1}$ (2)

$-CH_2CH_2C_nF_{2n+1}$ (3)

$-CH_2(CF_2)_mCFHCF_3$ (4)

$-CH_2CH_2(CF_2)_mCFHCF_3$ (5)

$-CH_2CH_2(CF_2)_mCFHCF_2H$ (6)

$-CH_2(CF_2)_mCFHCF_2H$ (7)

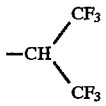
(8)

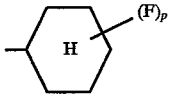
(9)

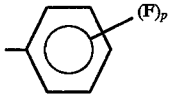
(10)

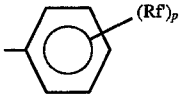
(11)

wherein Rf' represents any one of the above-described groups of from (1) to (8); n represents an integer of from 1 to 18; m represents an integer of from 1 to 18; and p represents an integer of from 1 to 5.

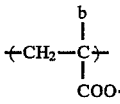
(F-1)

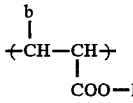
(F-2)

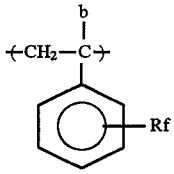
(F-3)

-continued

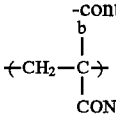
(F-4)

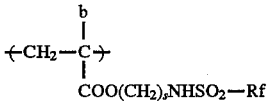
(F-5)

(s: an integer of from 1 to 12)

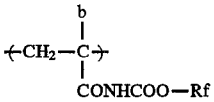
(F-6)

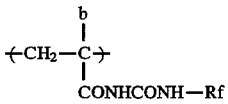
(F-7)

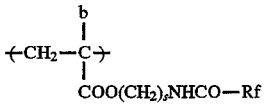
(F-8)

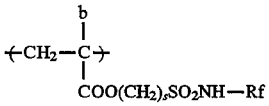
(F-9)

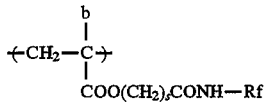
(F-10)

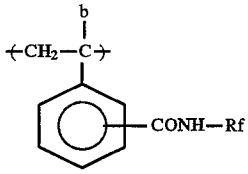
(F-11)

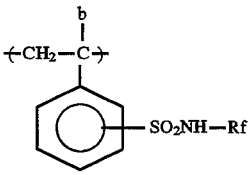
(F-12)

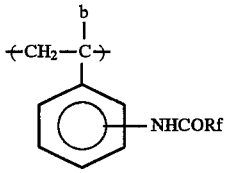
(F-13)

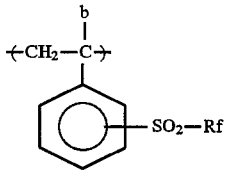
(F-14)

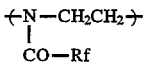
(F-15)

-continued (F-16)

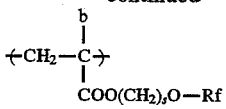

(F-17)

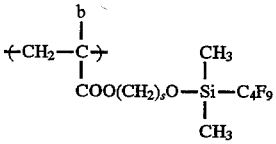

(F-18)

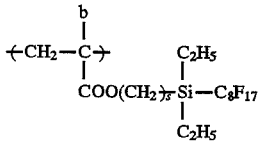

(F-19)

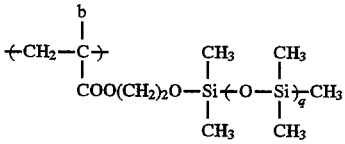

q: an integer of from 1 to 20

(F-20)

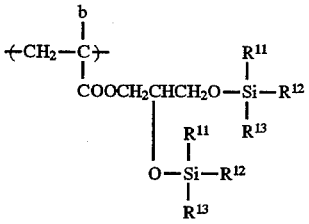

$R^{11}$, $R^{12}$, $R^{13}$: an alkyl group having from 1 to 12 carbon atoms (F-21)

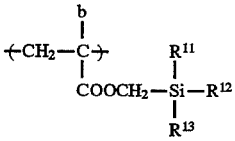

(F-22)

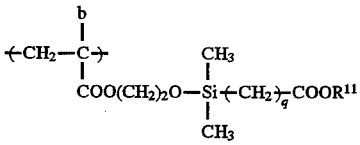

(F-23)

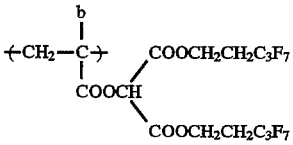

(F-24)

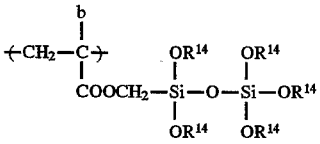

$R^{14}$: $-Si(CH_3)_2-CH_3$

-continued (F-25)

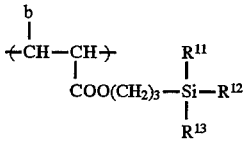

(F-26)

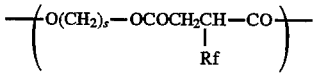

(F-27)

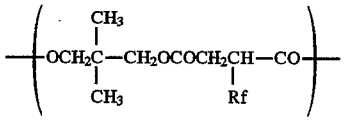

(F-28)

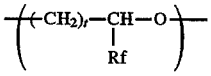

t: an integer of from 3 to 6

(F-29)

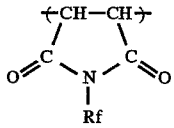

(F-30)

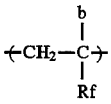

(F-31)

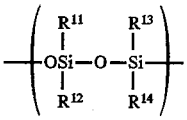

(F-32)

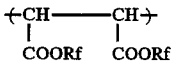

A preferred embodiment of the block copolymer in the resin (A) according. to the present invention will be described below. Any type of copolymer can be used as far as the fluorine atom and/or silicon atom-containing polymer components are contained as a block in the resins (A). The term "to be contained as a block" means that the resin has a polymer segment comprising at least 70 by weight of the fluorine atom and/or silicon atom-containing polymer component based on the polymer segment. The forms of blocks include an A-B type block, an A-B-A type block, a B-A-B type block, a graft type block, and a starlike type block as schematically illustrated below.

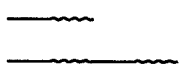

A—B Type

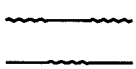

A—B—A (B—A—B) Type

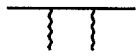

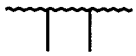

Graft Type (The number of the grafts is arbitrary)

-continued

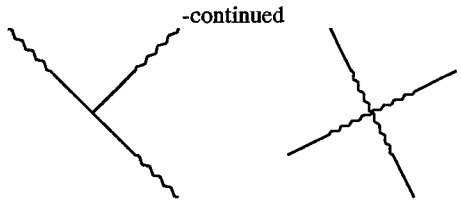

Starlike Type (The number of the branches is arbitrary)

——: Segment (α) (containing fluorine atom and/or silicon atom)

〰: Segment (β) (containing no or little fluorine atom and/or silicon atom)

These various types of block copolymers can be synthesized in accordance with conventionally known polymerization methods. Useful methods are described, e.g., in W. J. Burlant and A. S. Hoffman, *Block and Graft Polymers,* Reuhold (1986), R. J. Cevesa, *Block and Graft Copolymers,* Butterworths (1962), D. C. Allport and W. H. James, *Block Copolymers*, Applied Sci. (1972), A. Noshay and J. E. McGrath, *Block Copolymers*, Academic Press (1977), G. Huvtreg, D. J. Wilson, and G. Riess, *NATO ASIser. SerE.*, Vol. 1985, p. 149, and V. Perces, *Applied Polymer Sci.*, Vol. 285, p. 95 (1985).

For example, ion polymerization reactions using an organometallic compound (e.g., an alkyl lithium, lithium diisopropylamide, an alkali metal alcoholate, an alkylmagnesium halide, or an alkylaluminum halide) as a polymerization initiator are described, for example, in T. E. Hogeu-Esch and J. Smid, *Recent Advances in Anion Polymerization,* Elsevier (New York) (1987), Yoshio Okamoto, *Kobunshi*, Vol. 38, p. 912 (1989), Mitsuo Sawamoto, *Kobunshi*, Vol. 38, p. 1018 (1989), Tadashi Narita, *Kobunshi*, Vol. 37, p. 252 (1988), B. C. Anderson, et al., *Macromolecules*, Vol. 14, p. 1601 (1981), and S. Aoshima and T. Higasimura, *Macromolecules*, Vol. 22, p. 1009 (1989).

Ion polymerization reactions using a hydrogen iodide/iodine system are described, for example, in T. Higashimura, et al., *Macromol. Chem., Macromol. Symp.,* Vol. 13/14, p. 457 (1988), and Toshinobu Higashimura and Mitsuo Sawamoto, *Kobunshi Ronbunshu*, Vol. 46, p. 189 (1989).

Group transfer polymerization reactions are described, for example, in D. Y. Sogah, et al., *Macromolecules,* Vol. 22, p. 1473 (1987), O. W. Webster and D. Y. Sogah, *Kobunshi*, Vol. 36, p. 808 (1987), M. T. Reetg, et al., *Angew. Chem. Int. Ed. Engl.*, Vol. 25, p. 9108 (1986), and JP-A-63-97609.

Living polymerization reactions using a metalloporphyrin complex are described, for example, in T. Yasuda, T. Aida, and S. Inoue, Macromolecules, Vol. 17, p. 2217 (1984), M. Kuroki, T. Aida, and S. Inoue, *J. Am. Chem. Soc.*, Vol. 109, p. 4737 (1987), M. Kuroki, et al., *Macromolecules*, Vol. 21, p. 3115 (1988), and M. Kuroki and I. Inoue, *Yuki Gosei Kagaku,* Vol. 47, p. 1017 (1989).

Ring-opening polymerization reactions of cyclic compounds are described, for example, in S. Kobayashi and T. Saegusa, *Ring Opening Polymerization*, Applied Science Publishers Ltd. (1984), W. Seeliger, et al., *Angew. Chem. Int. Ed. Engl.*, Vol. 5, p. 875 (1966), S. Kobayashi, et al., *Poly. Bull.*, Vol. 13, p. 447 (1985), and Y. Chujo, et al., *Macromolecules*, Vol. 22, p. 1074 (1989).

Photo living polymerization reactions using a dithiocarbamate compound or a xanthate compound, as an initiator are described, for example, in Takayuki Otsu, *Kobunshi*, Vol. 37, p. 248 (1988), Shun-ichi Himori and Koichi Otsu, *Polymer Rep. Jap.*, Vol. 37, p. 3508 (1988), JP-A-64-111, JP-A-64-26619, and M. Niwa, *Macromolecules,* Vol. 189, p. 2187 (1988).

Radical polymerization reactions using a polymer containing an azo group or a peroxide group as an initiator to synthesize block copolymers are described, for example, in Akira Ueda, et al., *Kobunshi Ronbunshu,* Vol. 33, p. 931 (1976), Akira Ueda, *Osaka Shiritsu Kogyo Kenkyusho Hokoku*, Vol. 84 (1989), O. Nuyken, et al., *Macromol. Chem., Rapid. Commun.*, Vol. 9, p. 671 (1988), and Ryohei Oda, *Kagaku to Kogyo*, Vol. 61, p. 43 (1987).

Syntheses of graft type block copolymers are described in the above-cited literature references and, in addition, Fumio Ide, *Graft Jugo to Soho Oyo*, Kobunshi Kankokai (1977), and Kobunshi Gakkai (ed.), *Polymer Alloy*, Tokyo Kagaku Dojin (1981). For example, known grafting techniques including a method of grafting of a polymer chain by a polymerization initiator, an actinic ray (e.g., radiant ray, electron beam), or a mechano-chemical reaction; a method of grafting with chemical bonding between functional groups of polymer chains (reaction between polymers); and a method of grafting comprising a polymerization reaction of a macromonomer may be employed.

The methods of grafting using a polymer are described, for example, in T. Shiota, et al., *J. Appl. Polym. Sci.*, Vol. 13, p. 2447 (1969), W. H. Buck, *Rubber Chemistry and Technology*, Vol. 50, p. 109 (1976), Tsuyoshi Endo and Tsutomu Uezawa, *Nippon Secchaku Kyokaishi*, Vol. 24, p. 323 (1988), and Tsuyoshi Endo, ibid., Vol. 25, p. 409 (1989).

The methods of grafting using a macromonomer are described, for example, in P. Dreyfuss and R. P. Quirk, *Encycl. Polym. Sci. Eng.*, Vol. 7, p. 551 (1987), P. F. Rempp and E. Franta, *Adv. Polym. Sci.*, Vol. 58, p. 1 (1984), V. Percec, *Appl. Poly. Sci.*, Vol. 285, p. 95 (1984), R. Asami and M. Takari, *Macromol. Chem. Suppl.*, Vol. 12, p. 163 (1985), P. Rempp, et al., *Macromol. Chem. Suppl.*, Vol. 8, p. 3 (1985), Katsusuke Kawakami, *Kagaku Kogyo,* Vol. 38, p. 56 (1987), Yuya Yamashita, *Kobunshi,* Vol. 31, p. 988 (1982), Shiro Kobayashi, *Kobunshi,* Vol. 30, p. 625 (1981), Toshinobu Higashimura, *Nippon Secchaku Kyokaishi,* Vol. 18, p. 536 (1982), Koichi Itoh, *Kobunshi Kako,* Vol. 35, p. 262 (1986), Takashiro Azuma and Takashi Tsuda, *Kino Zairyo*, Vol. 1987, No. 10, p. 5, Yuya Yamashita (ed.), *Macromonomer no Kagaku to Kogyo*, I.P.C. (1989), Tsuyoshi Endo (ed.), *Atarashii Kinosei Kobunshi no Bunshi Sekkei*, Ch. 4, C.M.C. (1991), and Y. Yamashita, et al., *Polym. Bull.*, Vol. 5, p. 361 (1981).

Syntheses of starlike block copolymers are described, for example, in M. T. Reetz, *Angew. Chem. Int. Ed. Engl.*, Vol. 27, p. 1373 (1988), M. Sgwarc, *Carbanions, Living Polymers and Electron Transfer Processes*, Wiley (New York) (1968), B. Gordon, et al., *Polym. Bull.,* Vol. 11, p. 349 (1984), R. B. Bates, et al., *J. Org. Chem.*, Vol. 44, p. 3800 (1979), Y. Sogah, *A.C.S. Polym. Rapr.,* Vol. 1988, No. 2, p. 3, J. W. Mays, *Polym. Bull.,* Vol. 23, p. 247 (1990), I. M. Khan et al., *Macromolecules,* Vol. 21, p. 2684 (1988), A. Morikawa, *Macromolecules,* Vol. 24, p. 3469 (1991), Akira Ueda and Toru Nagai, *Kobunshi*, Vol. 39, p. 202 (1990), and T. Otsu, *Polymer Bull.*, Vol. 11, p. 135 (1984).

While reference can be made to known techniques described in the literatures cited above, the method for synthesizing the block copolymers according to the present invention is not limited to these methods.

The resin (A) is preferably used at least 70% by weight, more preferably at least 90% by weight based on the total amount of the composition for the transfer layer. The resin (A) may be used individually or as a mixture of two or more thereof.

If desired, the transfer layer (X) or (Y) may contain various additives for improving physical characteristics, such as adhesion, film-forming property, and film strength. For example, rosin, petroleum resin, or silicone oil may be added for controlling adhesion; polybutene, DOP, DBP, low-molecular weight styrene resins, low molecular weight polyethylene wax, microcrystalline wax, or paraffin wax, as a plasticizer or a softening agent for improving wetting property to the light-sensitive element or decreasing melting viscosity; and a polymeric hindered polyvalent phenol, or a triazine derivative, as an antioxidant. For the details, reference can be made to Hiroshi Fukada, *Hot-melt Secchaku no Jissai,* pp. 29 to 107, Kobunshi Kankokai (1983).

Each thickness of the transfer layer (X) and transfer layer (Y) is preferably in a range of from 0.1 to 10 μm, more preferably in a range of from 0.5 to 7 μm. If the thickness of each of the transfer layer (X) and transfer layer (Y) is 0.1 μm or more, the sufficient effect of these transfer layers is obtained.

Now, an electrophotographic light-sensitive element having the releasability on which the transfer layer is formed will be described in detail below.

Any conventionally known electrophotographic light-sensitive element can be employed. What is important is that the surface of the light-sensitive element has the releasability at the time for the formation of transfer layer so as to easily release the transfer layer provided thereon together with toner images. Specifically, in the present invention, an adhesive strength of the surface of light-sensitive element measured according to JIS Z 0237-1980 "Testing Methods of pressure sensitive adhesive tapes and sheets" is preferably not more than 150 g·f, more preferably not more than 100 g·f, and particularly preferably not more than 50 g·f, at the time for the formation of transfer layer (X) or before the formation of toner image. While an electrophotographic light-sensitive element which has already the surface exhibiting the desired releasability can be employed in the present invention, it is also possible to cause a compound (S) containing at least a fluorine atom and/or a silicon atom to adsorb or adhere onto the surface of electrophotographic light-sensitive element for imparting the releasability thereto before the formation of transfer layer (X). Thus, conventional electrophotographic light-sensitive elements can be utilized without taking releasability of the surface thereof into consideration.

Further, when releasability of the surface of electrophotographic light-sensitive element tends to decrease during repeated use of the light-sensitive element having the surface releasability according to the present invention the method for adsorbing or adhering a compound (S) can be applied. By the method, the releasability of light-sensitive element is easily maintained.

The impartation of releasability onto the surface of electrophotographic light-sensitive element is preferably carried out in an apparatus for forming a color image, and specifically a means for causing the compound (S) to adsorb or adhere onto the surface of electrophotographic light-sensitive element is further provided in the apparatus for forming a color image.

In order to obtain a light-sensitive element having a surface of the releasability, there are a method of selecting a light-sensitive element previously having such a surface of the releasability, a method of imparting the releasability to a surface of electrophotographic light-sensitive element conventionally employed by causing the compound (S) for imparting releasability to adsorb or adhere onto the surface of light-sensitive element, and a method of forming a transfer layer on a light-sensitive element by an electrodeposition coating method using a dispersion for electrodeposition containing the compound (S) for imparting releasability to simultaneously conduct the impartation of releasability and formation of transfer layer on the light-sensitive element.

Suitable examples of the light-sensitive elements previously having the surface of releasability used in the first method include those employing a photoconductive substance which is obtained by modifying a surface of amorphous silicon to exhibit the releasability.

For the purpose of modifying the surface of electrophotographic light-sensitive element mainly containing amorphous silicon to have the releasability, there is a method of treating a surface of amorphous silicon with a coupling agent containing a fluorine atom and/or a silicon atom (for example, a silane coupling agent or a titanium coupling agent) as described, for example, in JP-A-55-89844, JP-A-4-231318, JP-A-60-170860, JP-A-59-102244 and JP-A-60-17750. Also, a method of adsorbing and fixing the compound (S) according to the present invention, particularly a releasing agent containing a component having a fluorine atom and/or a silicon atom as a substituent in the form of a block (for example, a polyether-modified polydialkylsilicone or a carboxylic acid-, amino group- or carbinol-modified polydialkylsilicone) as described in detail below can be employed.

Further, another example of the light-sensitive elements previously having the surface of releasability is an electrophotographic light-sensitive element containing a polymer having a polymer component containing a fluorine atom and/or a silicon atom in a region near to the surface thereof.

The term "region near to the surface of electrophotographic light-sensitive element" used herein means the uppermost layer of the light-sensitive element and includes an overcoat layer provided on a photoconductive layer and the uppermost photoconductive layer. Specifically, an overcoat layer is provided on the light-sensitive element having a photosensitive layer as the uppermost layer which contains the above-described polymer to impart the releasability, or the above-described polymer is incorporated into the uppermost layer of a photoconductive layer (including a single photoconductive layer and a laminated photoconductive layer) to modify the surface thereof so as to exhibit the releasability. By using such a light-sensitive element, the transfer layer can be easily and completely transferred since the surface of the light-sensitive element has the good releasability.

In order to impart the releasability to the overcoat layer or the uppermost photoconductive layer, a polymer containing a silicon atom and/or a fluorine atom is used as a binder resin of the layer. It is preferred to use a small amount of a block copolymer containing a polymer segment comprising a silicon atom and/or fluorine atom-containing polymer component described in detail below (hereinafter referred to as a surface-localized type copolymer sometimes) in combination with other binder resins. Further, such polymers containing a silicon atom and/or a fluorine atom are employed in the form of grains.

In the case of providing an overcoat layer, it is preferred to use the above-described surface-localized type block copolymer together with other binder resins of the layer for maintaining sufficient adhesion between the overcoat layer and the photoconductive layer. The surface-localized type copolymer is ordinarily used together with other binder resins in a proportion of from 0.1 to 20 parts by weight per 100 parts by weight of the total composition of the overcoat layer.

Specific examples of the overcoat layer include a protective layer which is a surface layer provided on the light-sensitive element for protection known as one means for ensuring durability of the surface of a light-sensitive element for a plain paper copier (PPC) using a dry toner against repeated use.

For instance, techniques relating to a protective layer using a silicon type block copolymer are described, for example, in JP-A-61-95358, JP-A-55-83049, JP-A-62-87971, JP-A-61-189559, JP-A-62-75461, JP-A-61-139556, JP-A-62-139557, and JP-A-62-208055. Techniques relating to a protective layer using a fluorine type block copolymer are described, for example, in JP-A-61-116362, JP-A-61-117563, JP-A-61-270768, and JP-A-62-14657. Techniques relating to a protecting layer using grains of a resin containing a fluorine-containing polymer component in combination with a binder resin are described in JP-A-63-249152 and JP-A-63-221355.

On the other hand, the method of modifying the surface of the uppermost photoconductive layer so as to exhibit the releasability is effectively applied to a so-called disperse type light-sensitive element which contains at least a photoconductive substance and a binder resin.

Specifically, a layer constituting the uppermost layer of a photoconductive layer is made to contain either one or both of a block copolymer resin comprising a polymer segment containing a fluorine atom and/or silicon atom-containing polymer component as a block and resin grains containing a fluorine atom and/or silicon atom-containing polymer component, whereby the resin material migrates to the surface of the layer and is concentrated and localized there to have the surface imparted with the releasability. The copolymers and resin grains which can be used include those described in JP-A-5-197169.

In order to further ensure surface localization, a block copolymer comprising at least one fluorine atom and/or fluorine atom-containing polymer segment and at least one polymer segment containing a photo- and/or heat-curable group-containing component as blocks can be used as a binder resin for the overcoat layer or the photoconductive layer. Examples of such polymer segments containing a photo- and/or heat-curable group-containing component are described in JP-A-5-197169. Alternatively, a photo- and/or heat-curable resin may be used in combination with the fluorine atom and/or silicon atom-containing resin in the present invention.

The polymer comprising a polymer component containing a fluorine atom and/or a silicon atom effectively used for modifying the surface of the electrophotographic light-sensitive element in the manner as described above to obtain the electrophotographic light-sensitive element having the surface of releasability as well as the electrophotographic light-sensitive element mainly containing amorphous silicon may be in the form of a resin (hereinafter referred to as a resin (P) sometimes) or a resin grain (hereinafter referred to as a resin grain (L) sometimes).

Where the polymer containing a fluorine atom and/or silicon atom-containing polymer component used in the present invention is a random copolymer, the content of the fluorine atom and/or silicon atom-containing polymer component is preferably at least 60% by weight, and more preferably at least 80% by weight based on the total polymer component.

In a preferred embodiment, the above-described polymer is a block copolymer comprising at least one polymer segment (α) containing at least 50% by weight of a fluorine atom and/or silicon atom-containing polymer component and at least one polymer segment (β) containing 0 to 20% by weight of a fluorine atom and/or silicon atom-containing polymer component, the polymer segments (α) and (β) being bonded in the form of blocks. More preferably, the polymer segment (β) of the block copolymer contains at least one polymer component containing at least one photo- and/or heat-curable functional group.

It is preferred that the polymer segment (β) of the block copolymer does not contain any fluorine atom and/or silicon atom-containing polymer component.

As compared with the random copolymer, the block copolymer comprising the polymer segments (α) and (β) (surface-localized type copolymer) is more effective not only for improving the surface releasability but also for maintaining such a releasability.

More specifically, where a film is formed in the presence of a small amount of resin (P) and/or resin grains (L) containing a fluorine atom and/or a silicon atom, the resins (P) or resin grains (L) easily migrate to the surface portion of the film and are concentrated there by the end of a drying step of the film to thereby modify the film surface so as to exhibit the releasability.

Where the resin (P) is the block copolymer in which the fluorine atom and/or silicon atom-containing polymer segment exists as a block, the other polymer segment containing no, or if any a small proportion of, fluorine atom and/or silicon atom-containing polymer component undertakes sufficient interaction with the film-forming binder resin since it has good compatibility therewith. Thus, during the formation of the transfer layer on the light-sensitive element, further migration of the resin into the transfer layer is inhibited or prevented by an anchor effect to form and maintain the definite interface between the transfer layer and the light-sensitive element.

Further, where the segment (β) of the block copolymer contains a photo- and/or heat-curable group, crosslinking between the polymer molecules takes place during the film formation to thereby ensure retention of the releasability at the interface between the light-sensitive element and the transfer layer.

The above-described polymer may be used in the form of resin grains as described above. Preferred resin grains (L) are resin grains dispersible in a non-aqueous solvent. Such resin grains are composed of a block copolymer comprising a non-aqueous solvent-insoluble polymer segment which contains a fluorine atom and/or silicon atom-containing polymer component and a non-aqueous solvent-soluble polymer segment which contains no, or if any not more than 20% of, fluorine atom and/or silicon atom-containing polymer component.

Where the resin grains (L) are used in combination with a binder resin, the insolubilized polymer segment undertakes migration and concentration of the grains to the surface portion while the soluble polymer segment exerts an interaction with the binder resin (an anchor effect) similarly to the above-described resin. When the resin grains contain a photo- and/or heat-curable group, further migration of the grains to the transfer layer can be avoided.

The polymer component containing a moiety having a fluorine atom and/or a silicon atom used in the resin (P) and resin grain (L) is the same as the polymer component (F) which may be incorporated into the resin (A) employed in the transfer layer described hereinbefore.

In the so-called surface-localized type copolymers of the resins (P) and resin grains (L), the content of the silicon atom and/or fluorine atom-containing polymer component present in the segment (α) is at least 50% by weight, preferably at least 70% by weight, and more preferably at least 80% by weight.

Also, the content of the fluorine atom and/or silicon atom-containing polymer component in the segment (β) is not more than 20% by weight, and preferably 0% by weight.

A weight ratio of segment (α)/segment (β) ranges usually from 1/99 to 95/5, and preferably from 5/95 to 90/10. In the range described above, the good migration effect and anchor effect of the resin (P) or resin grain (L) at the surface region of light-sensitive element are obtained.

The resin (P) preferably has a weight average molecular weight of from $5\times10^3$ to $1\times10^6$, and more preferably from $1\times10^4$ to $5\times10^5$. The segment (α) in the resin (P) preferably has a weight average molecular weight of at least $1\times10^3$.

The resin grain (L) preferably has an average grain diameter of from 0.001 to 1 μm, and more preferably from 0.05 to 0.5 μm.

A preferred embodiment of the so-called surface-localized type copolymer in the resin (P) will be described below.

Any type of the block copolymer can be used as far as the fluorine atom and/or silicon atom-containing polymer components are contained therein as a block. The term "to be contained as a block" means that the polymer has the polymer segment containing at least 50% by weight of the fluorine atom and/or silicon atom-containing polymer component based on the weight of the polymer segment. The forms of blocks include, for example, an A-B type block, an A-B-A type block, a B-A-B type block, a graft type block, and a starlike type block as described with respect to the resin (A) used in the transfer layer above.

These various types of block copolymers of the resins (P) can be synthesized in accordance with conventionally known polymerization methods. Specifically, methods described for the resin (A) containing the polymer components (F) as a block can be employed.

A preferred embodiment of the resin grains (L) according to the present invention will be described below.

As described above, the resin grains (L) preferably comprise the fluorine atom and/or silicon atom-containing polymer segment (α) insoluble in a non-aqueous solvent and the polymer segment (β) which is soluble in a non-aqueous solvent and contains substantially no fluorine atom and/or silicon atom. The polymer segment (α) constituting the insoluble portion of the resin grain may have a crosslinked structure.

Preferred methods for synthesizing the resin grains (L) include the non-aqueous dispersion polymerization method hereinbefore described with respect to the non-aqueous solvent-dispersed resin grains.

The non-aqueous solvents which can be used in the preparation of the non-aqueous solvent-dispersed resin grains include any organic solvents having a boiling point of not more than 200° C., either individually or in combination of two or more thereof.

Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

Dispersion polymerization in such a non-aqueous solvent system easily results in the production of mono-dispersed resin grains having an average grain diameter of not greater than 1 μm with a very narrow size distribution.

More specifically, a monomer corresponding to the polymer component constituting the segment (α) (hereinafter referred to as a monomer (a)) and a monomer corresponding to the polymer component constituting the segment (β) (hereinafter referred to as a monomer (b)) are polymerized by heating in a non-aqueous solvent capable of dissolving a monomer (a) but incapable of dissolving the resulting polymer in the presence of a polymerization initiator, for example, a peroxide (e.g., benzoyl peroxide or lauroyl peroxide), an azobis compound (e.g., azobisisobutyronitrile or azobisisovaleronitrile), or an organometallic compound (e.g., butyl lithium). Alternatively, a monomer (a) and a polymer comprising the segment (β) (hereinafter referred to as a polymer (Pβ)) are polymerized in the same manner as described above.

Further, the inside of the resin grain (L) may have a crosslinked structure. The formation of crosslinked structure can be conducted by any of conventionally known techniques.

For example, (1) a method wherein a polymer containing the polymer segment (α) is crosslinked in the presence of a crosslinking agent or a curing agent; (2) a method wherein at least the monomer (a) corresponding to the polymer segment (α) is polymerized in the presence of a polyfunctional monomer or oligomer containing at least two polymerizable functional groups to form a network structure over molecules; or (3) a method wherein the polymer segment (α) and a polymer containing a reactive group-containing polymer component are subjected to a polymerization reaction or a polymer reaction to cause crosslinking may be employed.

The crosslinking agents to be used in the method (1) include compounds commonly employed as crosslinking agents as described, e.g., in Shinzo Yamashita and Tosuke Kaneko (ed.), *Kakyozai Handbook*, Taiseisha (1981) and Kobunshi Gakkai (ed.), *Kobunshi Data Handbook* (*Kisohen*), Baifukan (1986).

Specific examples of suitable crosslinking agents include organosilane compounds (such as those known as silane Coupling agents, e.g., vinyltrimethoxysilane, vinyltributoxysilane, γ-glycidoxypropyltrimethoxysilane, γ-mercaptopropyltriethoxysilane, and γ-aminopropyltriethoxysilane), polyisocyanate compounds (e.g., toluylene diisocyanate, diphenylmethane diisocyanate, triphenylmethane triisocyanate, polymethylenepolyphenyl isocyanate, hexamethylene diisocyanate, isophorone diisocyanate, and polymeric polyisocyanates), polyol compounds (e.g., 1,4-butanediol, polyoxypropylene glycol, polyoxyethylene glycols, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), polyepoxy-containing compounds and epoxy resins (e.g., the compounds as described in Hiroshi Kakiuchi (ed.), *Shin-Epoxy Jushi*, Shokodo (1985) and Kuniyuki Hashimoto (ed.), *Epoxy Jushi*, Nikkan Kogyo Shinbunsha (1969)), melamine resins (e.g., the compounds as described in Ichiro Miwa and Hideo Matsunaga (ed.), *Urea.Melamine Jushi*, Nikkan Kogyo Shinbunsha (1969)), and poly(meth)acrylate compounds (e.g., the compounds as described in Shin Okawara, Takeo Saegusa, and Toshinobu Higashimura (ed.), *Oligomer*, Kodansha (1976), and Eizo Omori, *Kinosei Acryl-kei Jushi*, Techno System (1985)).

Specific examples of the polymerizable functional groups which are contained in the polyfunctional monomer or oligomer (the monomer will sometimes be referred to as a polyfunctional monomer (d)) having two or more polymerizable functional groups used in the method (2) above include $CH_2=CH-CH_2-$, $CH_2=CH-CO-O-$, $CH_2=CH-$, $CH_2=C(CH_3)-CO-O-$, $CH(CH_3)=CH-CO-O-$, $CH_2=CH-CONH-$, $CH_2=C(CH_3)-CONH-$, $CH(CH_3)=CH-CONH-$, $CH_2=CH-O-CO-$, $CH_2=C(CH_3)-O-CO-$, $CH_2=CH-CH_2-O-CO-$, $CH_2=CH-NHCO-$, $CH_2=CHCH_2-NHCO-$, $CH_2=CH-SO_2-$, $CH_2=CH-CO-$, $CH_2=CH-O-$, and $CH_2=CH-S-$. The two or more polymerizable functional groups present in the polyfunctional monomer or oligomer may be the same or different.

Specific examples of the monomer or oligomer having the same two or more polymerizable functional groups include styrene derivatives (e.g., divinylbenzene and trivinylbenzene); methacrylic, acrylic or crotonic acid esters, vinyl ethers or allyl ethers of polyhydric alcohols (e.g., ethylene glycol, diethylene glycol, triethylene glycol, polyethylene glycol 200, 400 or 600, 1,3-butylene glycol, neopentyl glycol, dipropylene glycol, polypropylene glycol, trimethylolpropane, trimethylolethane, and pentaerythritol) or polyhydric phenols (e.g., hydroquinone, resorcin, catechol, and derivatives thereof); vinyl esters, allyl esters, vinyl amides, or allyl amides of dibasic acids (e.g., malonic acid, succinic acid, glutaric acid, adipic acid, pimelic acid, maleic acid, phthalic acid, and itaconic acid); and condensation products of polyamines (e.g., ethylenediamine, 1,3-propylenediamine, and 1,4-butylenediamine) and vinyl group-containing carboxylic acids (e.g., methacrylic acid, acrylic acid, crotonic acid, and allylacetic acid).

Specific examples of the monomer or oligomer having two or more different polymerizable functional groups include reaction products between vinyl group-containing carboxylic acids (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a carboxylic acid anhydride) and alcohols or amines, vinyl group-containing ester derivatives or amide derivatives (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethylene acrylate, N-allylacrylamide, N-allylmethacrylamide, N-allylitaconamide, and methacryloylpropionic acid allylamide) and condensation products between amino alcohols (e.g., aminoethanol, 1-aminopropanol, 1-aminobutanol, 1-aminohexanol, and 2-aminobutanol) and vinyl group-containing carboxylic acids.

The monomer or oligomer containing two or more polymerizable functional groups is used in an amount of not more than 10 mol %, and preferably not more than 5 mol %, based on the total amount of monomer (a) and other monomers copolymerizable with monomer (a) to form the resin.

Where crosslinking between polymer molecules is conducted by the formation of chemical bonds upon the reaction of reactive groups in the polymers according to the method (3), the reaction may be effected in the same manner as usual reactions of organic low-molecular weight compounds.

From the standpoint of obtaining mono-dispersed resin grains having a narrow size distribution and easily obtaining fine resin grains having a diameter of 0.5 μm or smaller, the method (2) using a polyfunctional monomer is preferred for the formation of network structure in the dispersion polymerization. Specifically, a monomer (a), a monomer (b) and/or a polymer (Pβ) and, in addition, a polyfunctional monomer (d) are subjected to polymerization granulation reaction to obtain resin grains. Where the above-described polymer (Pβ) comprising the segment (β) is used, it is preferable to use a polymer (Pβ') which has a polymerizable double bond group copolymerizable with the monomer (a) in the side chain or at one terminal of the main chain of the polymer (Pβ).

The polymerizable double bond group is not particularly limited as far as it is copolymerizable with the monomer (a). Specific examples thereof include

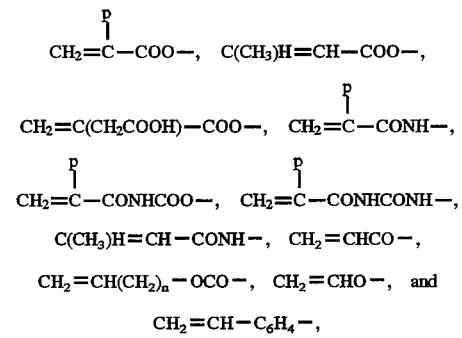

wherein p represents —H or —$CH_3$, and n represents 0 or an integer of from 1 to 3.

The polymerizable double bond group may be bonded to the polymer chain either directly or via a divalent organic residue. Specific examples of these polymers include those described, for example, in JP-A-61-43757, JP-A-1-257969, JP-A-2-74956, JP-A-1-282566, JP-A-2-173667, JP-A-3-15862, and JP-A-4-70669.

In the preparation of resin grains, the total amount of the polymerizable compounds used is from about 5 to about 80 parts by weight, preferably from 10 to 50 parts by weight, per 100 parts by weight of the non-aqueous solvent. The polymerization initiator is usually used in an amount of from 0.1 to 5% by weight based on the total amount of the polymerizable compounds. The polymerization is carried out at a temperature of from about 30+ to about 180° C., and preferably from 40° to 120° C. The reaction time is preferably from 1 to 15 hours.

Now, an embodiment in which the resin (P) contains a photo- and/or heat-curable group or the resin (P) is used in combination with a photo- and/or heat-curable resin will be described below.

The polymer components containing at least one photo- and/or heat-curable group, which may be incorporated into the resin (P), include those described in the above-cited literature references. More specifically, the polymer components containing the above-described polymerizable functional group(s) can be used.

The content of the polymer component containing at least one photo- and/or heat-curable group in the block copolymer (P) ranges from 0.1 to 40 parts by weight, and preferably from 1 to 30 parts by weight, based on 100 parts by weight of the polymer segment (β) therein.

When the content is 0.1 part by weight or more, curing of the photoconductive layer after film formation proceeds sufficiently, resulting in effective peeling off of the transfer layer. On the other hand, when the content is 40 parts by weight or less, the good electrophotographic characteristics of the photoconductive layer are obtained without deterioration in reproducibility of original in duplicated images and occurrence of background fog in non-image areas.

The photo- and/or heat-curable group-containing block copolymer (P) is preferably used in an amount of not more than 40% by weight based on the total binder resin. In the range described above the good electrophotographic characteristics of the light-sensitive element are obtained.

The fluorine atom and/or silicon atom-containing resin may also be used in combination with the photo- and/or heat-curable resin (D) in the present invention. Any of conventionally known curable resins may be used as the photo- and/or heat-curable resin (D). For example, resins containing the curable group as described with respect to the block copolymer (P) according to the present invention may be used.

Further, conventionally known binder resins for an electrophotographic light-sensitive layer are employed. These resins are described, e.g., in Takaharu Shibata and Jiro Ishiwatari, *Kobunshi,* Vol. 17, p. 278 (1968), Harumi Miyamoto and Hidehiko Takei, Imaging, Vol. 1973, No. 8, Koichi Nakamura (ed.), *Kiroku Zairyoyo Binder no Jissai Gijutsu,* Ch. 10, C.M.C. (1985), Denshishashin Gakkai (ed.), *Denshishashinyo Yukikankotai no Genjo Symposium* (preprint) (1985), Hiroshi Kokado (ed.), *Saikin no Kododenzairyo to Kankotai no Kaihatsu.Jitsuyoka,* Nippon Kagaku Joho (1986), Denshishashin Gakkai (ed.), *Denshishashin Gijutsu no Kiso To Oyo,* Ch. 5, Corona (1988), D. Tatt and S. C. Heidecker, *Tappi,* Vol. 49, No. 10, p. 439 (1966), E. S. Baltazzi and R. G. Blanchlotte, et al., *Photo. Sci. Eng.,* Vol. 16, No. 5, p. 354 (1972), and Nguyen Chank Keh, Isamu Shimizu and Eiichi Inoue, *Denshishashin Gakkaishi,* Vol. 18, No. 2, p. 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy group-modified silicone resins, polycarbonate resins, ketone resins, polyester resins, silicone resins, amide resins, hydroxy group- or carboxy group-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

More specifically, reference can be made to Tsuyoshi Endo, *Netsukokasei Kobunshi no Seimitsuka,* C.M.C. (1986), Yuji Harasaki, *Saishin Binder Gijutsu Binran,* Ch. II-1, Sogo Gijutsu Center (1985), Takayuki Otsu, *Acryl Jushi no Gosei-Sekkei to Shinyoto Kaihatsu,* Chubu Kei-ei Kaihatsu Center Shuppanbu (1985), and Eizo Omori, *Kinosei Acryl-Kei Jushi,* Techno System (1985).

As described above, when the uppermost layer of light-sensitive element, for example, the overcoat layer or the photoconductive layer contains at least one binder resin (B) and at least one block copolymer (P) for modifying the surface thereof, it is preferred that the layer further contains a small amount of photo- and/or heat-curable resin (D) and/or a crosslinking agent for further improving film curability.

The amount of photo- and/or heat-curable resin (D) and/or crosslinking agent to be added is from 0.01 to 20% by weight, and preferably from 0.1 to 15% by weight, based on the total amount of the binder resin (B) and the block copolymer (P). In the range described above, the effect of improving film curability is obtained without adversely affecting the electrophotographic characteristics.

A combined use of a crosslinking agent is preferable. Any of ordinarily employed crosslinking agents may be utilized. Suitable crosslinking agents are described, e.g., in Shinzo Yamashita and Tosuke Kaneko (ed.), *Kakyozai Handbook,* Taiseisha (1981) and Kobunshi Gakkai (ed.), *Kobunshi Data Handbook (Kisohen),* Baifukan (1986). Specific examples of the crosslinking agents include the compounds described as the crosslinking agents above.

In addition, monomers containing a polyfunctional polymerizable group (e.g., vinyl methacrylate, acryl methacrylate, ethylene glycol diacrylate, polyethylene glycol diacrylate, divinyl succinate, divinyl adipate, diacryl succinate, 2-methylvinyl methacrylate, trimethylolpropane trimethacrylate, divinylbenzene, and pentaerythritol polyacrylate) may also be used as the crosslinking agent.

As described above, the uppermost layer of the photoconductive layer [light-sensitive element] (a layer which will be in contact with the transfer layer (X)) is preferably cured after film formation. It is preferred that the binder resin (B), the block copolymer (P), the curable resin (D), and the crosslinking agent to be used in the photoconductiVe layer are so selected and combined that their functional groups easily undergo chemical bonding to each other.

Combinations of functional groups which easily undergo a polymer reaction are well known. Specific examples of such combinations are shown in Table 1 below, wherein a functional group selected from Group A can be combined with a functional group selected from Group B. However, the present invention should not be construed as being limited thereto.

TABLE 1

| Group A | Group B |
|---|---|
| —COOH, —$PO_3H_2$, —OH, —SH, —$NH_2$, —NHR, —$SO_2H$ | 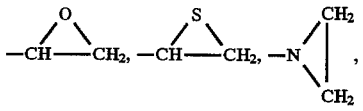 |
| | —COCl, —$SO_2Cl$, a cyclic acid anhydride group, |
| | —N=C=O, —N=C=S, |
| | 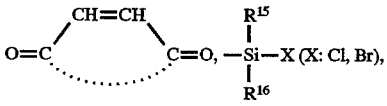 |
| | 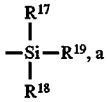 —$R^{19}$, a blocked isocyanate group, |
| | —NHCOOR' (R': 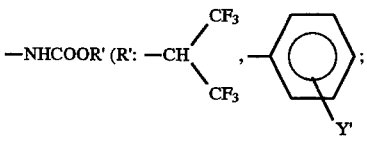 ; |
| | (Y': —$CH_3$, —Cl, —$OCH_3$), |

TABLE 1-continued

| Group A | Group B |
|---|---|
| | 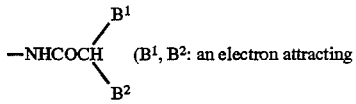 ($B^1$, $B^2$: an electron attracting group), |
| | 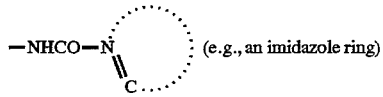 (e.g., an imidazole ring) |

In Table 1, $R^{15}$ and $R^{16}$ each represents an alkyl group; $R^{17}$, $R^{18}$, and $R^{19}$ each represents an alkyl group or an alkoxy group, provided that at least one of them is an alkoxy group; R represents a hydrocarbon group; $B^1$ and $B^2$ each represents an electron attracting group, e.g., —CN, $—CF_3$, $—COR^{20}$, $—COOR^{20}$, $—SO_2OR^{20}$ ($R^{20}$ represents a hydrocarbon group, e.g., $—C_nH_{2n+1}$ (n: an integer of from 1 to 4), $—CH_2C_6H_5$, or $—C_6H_5$).

If desired, a reaction accelerator may be added to the binder resin for accelerating the crosslinking reaction in the light-sensitive layer.

The reaction accelerators which may be used for the crosslinking reaction forming a chemical bond between functional groups include organic acids (e.g., acetic acid, propionic acid, burytic acid, benzenesulfonic acid, and p-toluenesulfonic acid), phenols (e.g., phenol, chlorophenol, nitrophenol, cyanophenol, bromophenol, naphthol, and dichlorophenol), organometallic compounds (e.g., zirconium acetylacetonate, zirconium acetylacetone, cobalt acetylacetonate, and dibutoxytin dilaurate), dithiocarbamic acid compounds (e.g., diethyldithiocarbamic acid salts), thiuram disulfide compounds (e.g., tetramethylthiuram disulfide), and carboxylic acid anhydrides (e.g., phthalic anhydride, maleic anhydride, succinic anhydride, butylsuccinic anhydride, benzophenone-3,3',4,4'-tetracarboxylic acid dianhydride, and trimellitic anhydride). The reaction accelerators which may be used for the crosslinking reaction involving polymerization include polymerization initiators, such as peroxides and azobis compounds.

After a coating composition for the light-sensitive layer is coated, the binder resin is cured by light and/or heat. Heat curing can be carried out by drying under severer conditions than those for the production of a conventional light-sensitive element. For example, elevating the drying temperature and/or increasing the drying time may be utilized. After drying the solvent of the coating composition, the film is preferably subjected to a further heat treatment, for example, at 60° to 150° C. for 5 to 120 minutes. The conditions of the heat treatment may be made milder by using the above-described reaction accelerator in combination.

Curing of the resin containing a photocurable functional group can be carried out by incorporating a step of irradiation of actinic ray into the production line in the present invention. The actinic rays to be used include visible light, ultraviolet light, far ultraviolet light, electron beam, X-ray, γ-ray, and α-ray, with ultraviolet light being preferred. Actinic rays having a wavelength range of from 310 to 500 nm are more preferred. In general, a low-, high- or ultrahigh-pressure mercury lamp or a halogen lamp is employed as a light source. Usually, the irradiation treatment can be sufficiently performed at a distance of from 5 to 50 cm for 10 seconds to 10 minutes.

Now, the second method for obtaining an electrophotographic light-sensitive element having the surface of releasability by adsorbing or adhering the compound (S) for imparting the desired releasability onto the surface of a conventional electrophotographic light-sensitive element before the formation of the transfer layer (X) will be described in detail below.

The compound (S) for imparting releasability is a compound containing at least a fluorine and/or silicon atom and is not particularly limited in its structure as far as it can improve releasability of the surface of electrophotographic light-sensitive element, and includes a low molecular weight compound, an oligomer, and a polymer.

When the compound (S) is an oligomer or a polymer, the moiety having a fluorine and/or silicon atom includes that incorporated into the main chain of the oligomer or polymer and that contained as a substituent in the side chain thereof. Of the oligomers and polymers, those containing repeating units containing the moiety having a fluorine and/or silicon atom as a block are preferred since they advantageously adsorb on the surface of electrophotographic light-sensitive element to impart good releasability.

The fluorine atom and/or silicon atom-containing moieties include those described with respect to the resin (A) used in the transfer layer above.

Specific examples of the compound (S) containing a fluorine atom and/or a silicon atom which can be used in the present invention include fluorine and/or silicon-containing organic compounds described, for example, in Tokiyuki Yoshida, et al. (ed.), *Shin-ban Kaimenkasseizai Handbook*, Kogaku Tosho (1987), Takao Karikome, *Saishin Kaimenkasseizai Oyo Gijutsu*, C.M.C. (1990), Kunio Ito (ed.), *Silicone Handbook*, Nikkan Kogyo Shinbunsha (1990), Takao Karikome, *Tokushukino Kaimenkasseizai*, C.M.C. (1986), and A. M. Schwartz, et al., *Surface Active Agents and Detergents*, Vol. II.

Further, the compound (S) according to the present invention can be synthesized by utilizing synthesis methods as described, for example, in Nobuo Ishikawa, *Fussokagobutsu no Gosei to Kino*, C.M.C. (1987), Jiro Hirano et al. (ed.), *Ganfussoyukikagobutsu—Soho Gosei to Oyo*, Gijutsu Joho Kokai (1991), and Mitsuo Ishikawa, *Yukikeiso Senryaku Shiryo*, Chapter 3, Science Forum (1991).

Specific examples of polymer components having the fluorine atom and/or silicon atom-containing moiety used in the oligomer or polymer include the polymer components (F) described with respect to the resin (A) above.

When the compound (S) according to the present invention is a so-called block copolymer, the compound (S) may be any type of copolymer as far as it contains the fluorine atom and/or silicon atom-containing polymer components as a block. The term "to be contained as a block" means that the compound (S) has a polymer segment comprising at least 70% by weight of the fluorine atom and/or silicon atom-containing polymer component based on the weight of the polymer segment. The forms of blocks include an A-B type block, an A-B-A type block, a B-A-B type block, a graft type block, and a starlike type block as schematically illustrated with respect to the resin (A) above. These block copolymers can be synthesized according to the methods described with respect to the resin (A) above.

In order to cause the compound (S) to adsorb or adhere to the surface of electrophotographic light-sensitive element, conventionally known various methods can be employed. Methods which can be appropriately applied to the apparatus used in the present invention are preferred.

For example, methods using an air doctor coater, a blade coater, a knife coater, a squeeze coater, a dip coater, a reverse roll coater, a transfer roll coater, a gravure coater, a kiss roll coater, a spray coater, a curtain coater, or a calender coater as described, for example, in Yuji Harasaki, *Coating Kogaku*, Asakura Shoten (1971), Yuji Harasaki, *Coating Hoshiki*, Maki Shoten (1979), and Hiroshi Fukada, *Hot-melt Secchaku no Jissai* Kobunshi Kankokai (1979) can be used.

A method wherein cloth, paper or felt impregnated with the compound (S) is pressed on the surface of light-sensitive element, a method of pressing a curable resin impregnated with the compound (S), a method wherein the light-sensitive element is wetted with a non-aqueous solvent containing the compound (S) dissolved therein, and then dried to remove the solvent, and a method wherein the compound (S) dispersed in a non-aqueous solvent is migrated and adhered on the surface of light-sensitive element by electrophoresis according to a wet-type electrodeposition method as described hereinafter can also be employed.

Further, the compound (S) can be applied on the surface of light-sensitive element by utilizing a non-aqueous solvent containing the compound (S) according to an ink jet method, followed by drying. The ink jet method can be performed with reference to the descriptions in Shin Ohno (ed.), *Non-impact Printing*, C.M.C. (1986).

More specifically, a Sweet process or Hartz process of a continuous jet type, a Winston process of an intermittent jet type, a pulse jet process of an ink on-demand type, a bubble jet process, and a mist process of an ink mist type are illustrated.

In any system, the compound (S) itself or diluted with a solvent is filled in an ink tank or ink head cartridge in place of an ink to use. The solution of compound (S) used ordinarily has a viscosity of from 1 to 10 cp and a surface tension of from 30 to 60 dyne/cm, and may contain a surface active agent, or may be heated if desired. Although a diameter of ink droplet is in a range of from 30 to 100 μm due to a diameter of an orifice of head in a conventional ink jet printer in order to reproduce fine letters, droplets of a larger diameter can also be used in the present invention. In such a case, an amount of jet of the compound (S) becomes large and thus a time necessary for the application can be shortened. Further, to use multiple nozzles is very effective to shorten the time for application.

When silicone rubber is used as the compound (S), it is preferred that silicone rubber is provided on a metal axis to cover and the resulting silicone rubber roller is directly pressed on the surface of electrophotographic light-sensitive element. In such a case, a nip pressure is ordinarily in a range of from 0.5 to 10 $Kgf/cm^2$ and a time for contact is ordinarily in a range of from 1 second to 30 minutes. Also, the light-sensitive element and/or silicone rubber roller may be heated up to a temperature of 150° C. According to this method, it is believed that a part of low molecular weight components contained in silicone rubber is moved from the silicone rubber roller onto the surface of light-sensitive element during the press. The silicone rubber may be swollen with silicone oil. Moreover, the silicone rubber may be a form of sponge and the sponge roller may be impregnated with silicone oil or a solution of silicone surface active agent.

The application method of the compound (S) is not particularly limited, and an appropriate method can be selected depending on a state (i.e., liquid, wax or solid) of the compound (S) used. A flowability of the compound (S) can be controlled using a heat medium, if desired.

In accordance with the present invention, the surface of electrophotographic light-sensitive element is provided with the desired releasability by the adsorption or adhesion of the compound (S) thereto, and preferably exhibits the adhesive strength of not more than 150 g·f before the formation of transfer layer (X). The step for the application of compound (S) is not always necessary to conduct in a series of the steps for the formation of a color image according to the present invention. The application may be suitably performed by an appropriate combination of a light-sensitive element, an ability of a compound (S) for imparting the releasability and a means for the application.

An amount of the compound (S) adsorbed or adhered to the surface of electrophotographic light-sensitive element is not particularly limited and is adjusted in a range wherein the electrophotographic characteristics of light-sensitive element do not adversely affected in substance. Ordinarily, a thickness of the coating is sufficiently 1 μm or less. By the formation of weak boundary layer as defined in Bikerman, *The Science of Adhesive Joints*, Academic Press (1961), the releasability-imparting effect of the present invention can be obtained.

Furthermore, the third method for obtaining an electrophotographic light-sensitive element having a surface of releasability is a method of conducting the impartation of releasability to the light-sensitive element simultaneously with the formation of transfer layer (X) on the light-sensitive element by incorporating a compound (S) for imparting the releasability into a dispersion for electrodeposition used for the formation of transfer layer (X) on the light-sensitive element according to the electrodeposition coating method.

Specifically, the peelable transfer layer (X) is formed by means of electrodeposition or adhesion of resin grains (AR) by electrophoresis on the surface of electrophotographic light-sensitive element to form a film using a dispersion for electrodeposition comprising resin grains (AR) having a glass transition point of not more than 140° C. or a softening point of not more than 180° C. dispersed in an electrically insulating organic solvent having a dielectric constant of not more than 3.5 and at least one compound (S) which has a fluorine atom and/or a silicon atom and is soluble at least 0.01 g per 1.0 liter of the organic solvent.

The compound (S) for imparting releasability contained in the dispersion for electrodeposition forming the transfer layer tends to adsorb or adhere onto the surface of light-sensitive element before the electrodeposition or adhesion of dispersed resin grains (AR) by electrophoresis on the surface of light-sensitive element, the light-sensitive element having the releasability is consequently obtained at the formation of transfer layer (X). The method will be described in more detail hereinafter.

The composition and material for the electrophotographic light-sensitive element which can be used in the present invention are not particularly limited, and any of those conventionally known may be employed.

Suitable examples of electrophotographic light-sensitive element used are described, for example, in R. M. Schaffert, *Electrophotography*, Forcal Press, London (1980), S. W. Ing, M. D. Tabak and W. E. Haas, *Electrophotography Fourth International Conference*, SPSE (1983), Isao Shinohara, Hidetoshi Tsuchida and Hideaki Kusakawa (ed.), *Kirokuzairyo to Kankoseijushi*, Gakkai Shuppan Center (1979), Hiroshi Kokado, *Kagaku to Kogyo*, Vol. 39, No. 3, p. 161 (1986), *Saikin no Kododen Zairyo to Kankotai no Kaihatsu.Jitsuyoka*, Nippon Kagaku Joho Shuppanbu (1986), Denshishashin Gakkai (ed.), *Denshishashin no Kiso to Oyo*, Corona (1986), and Denshishashin Gakkai (ed.), *Denshishashinyo Yukikankotai no Genjo Symposium* (preprint), (1985). Specifically, the photoconductive layer includes a single layer made of a photoconductive compound itself and a photoconductive layer comprising a binder resin having dispersed therein a photoconductive compound. The dispersed type photoconductive layer may have a single layer structure or a laminated structure.

The photoconductive compounds used in the present invention may be inorganic compounds or organic compounds.

Inorganic photoconductive compounds used in the present invention include those conventionally known for example, zinc oxide, titanium oxide, zinc sulfide, cadmium sulfide, selenium, selenium-tellurium, silicon, lead sulfide. These compounds are used together with a binder resin to form a photoconductive layer, or they are used alone to form a photoconductive layer by vacuum evaporation or spattering.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound.

As photoconductive layers using organic compounds, on the other hand, any of those conventionally known may be employed. Suitable photoconductive layers containing an organic photoconductive compound include a photoconductive layer mainly comprising an organic photoconductive compound, a sensitizing dye, and a binder resin as described, e.g., in JP-B-37-17162, JP-B-62-51462, JP-A-52-2437, JP-A-54-19803, JP-A-56-107246, and JP-A-57-161863; a layer mainly comprising a charge generating agent, a charge transporting agent, and a binder resin as described, e.g., in JP-A-56-146145, JP-A-60-17751, JP-A-60-17752, JP-A-60-17760, JP-A-60-254142, and JP-A-62-54266; and a double-layered structure containing a charge generating agent and a charge transporting agent in separate layers as described, e.g., in JP-A-60-230147, JP-A-60-230148, and JP-A-60-238853.

The photoconductive layer of the electrophotographic light-sensitive element according to the present invention may have any of the above-described embodiments.

The organic photoconductive compounds which may be used in the present invention include (a) triazole derivatives described, e.g., in U.S. Pat. No. 3,112,197, (b) oxadiazole derivatives described, e.g., in U.S. Pat. No. 3,189,447, (c) imidazole derivatives described in JP-B-37-16096, (d) polyarylalkane derivatives described, e.g., in U.S. Pat. Nos. 3,615,402, 3,820,989, and 3,542,544, JP-B-45-555, JP-B-51-10983, JP-A-51-93224, JP-A-55-108667, JP-A-55-156953, and JP-A-56-36656, (e) pyrazoline derivatives and pyrazolone derivatives described, e.g., in U.S. Pat. Nos. 3,180,729 and 4,278,746, JP-A-55-88064, JP-A-55-88065, JP-A-49-105537, JP-A-55-51086, JP-A-56-80051, JP-A-56-88141, JP-A-57-45545, JP-A-54-112637, and JP-A-55-74546, (f) phenylenediamine derivatives described, e.g., in U.S. Pat. No. 3,615,404, JP-B-51-10105, JP-B-46-3712, JP-B-47-28336, JP-A-54-83435, JP-A-54-110836, and JP-A-54-119925, (g) arylamine derivatives described, e.g., in U.S. Pat. Nos. 3,567,450, 3,180,703, 3,240,597, 3,658,520, 4,232,103, 4,175,961, and 4,012,376, JP-B-49-35702, West German Patent (DAS) 1,110,518, JP-B-39-27577, JP-A-55-144250, JP-A-56-119132, and JP-A-56-22437, (h) amino-substituted chalcone derivatives described, e.g., in U.S. Pat. No. 3,526,501, (i) N,N-bicarbazyl derivatives described, e.g., in U.S. Pat. No. 3,542,546, (j) oxazole derivatives described, e.g., in U.S. Pat. No. 3,257,203, (k) styrylanthracene derivatives described, e.g., in JP-A-56-46234, (l) fluorenone derivatives described, e.g., in JP-A-54-110837, (m) hydrazone derivatives described, e.g., in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749, and JP-A-57-104144, (n) benzidine derivatives described, e.g., in U.S. Pat. Nos. 4,047,948, 4,047,949, 4,265,990, 4,273,846, 4,299,897, and 4,306,008, (o) stilbene derivatives described, e.g., in JP-A-58-190953, JP-A-59-95540, JP-A-59-97148, JP-A-59-195658, and JP-A-62-36674, (p) polyvinylcarbazole and derivatives thereof described in JP-B-34-10966, (q) vinyl polymers, such as polyvinylpyrene, polyvinylanthracene, poly-2-vinyl-4-(4'-dimethylaminophenyl)-5-phenyloxazole, and poly-3-vinyl-N-ethylcarbazole, described in JP-B-43-18674 and JP-B-43-19192, (r) polymers, such as polyacenaphthylene, polyindene, and an acenaphthylene-styrene copolymer, described in JP-B-43-19193, (s) condensed resins, such as pyrene-formaldehyde resin, bromopyrene-formaldehyde resin, and ethylcarbazole-formaldehyde resin, described, e.g., in JP-B-56-13940, and (t) triphenylmethane polymers described in JP-A-56-90833 and JP-A-56-161550.

The organic photoconductive compounds which can be used in the present invention are not limited to the above-described compounds (a) to (t), and any of known organic photoconductive compounds may be employed in the present invention. The organic photoconductive compounds may be used either individually or in combination of two or more thereof.

The sensitizing dyes which can be used in the photoconductive layer include those conventionally known as described, e.g., in *Denshishashin*, Vol. 12, p. 9 (1973) and *Yuki Gosei Kagaku*, Vol. 24, No. 11, p. 1010 (1966). Specific examples of suitable sensitizing dyes include pyrylium dyes described, e.g., in U.S. Pat. Nos. 3,141,770 and 4,283,475, JP-A-48-25658, and JP-A-62-71965; triarylmethane dyes described, e.g., in Applied *Optics Supplement*, Vol. 3, p. 50 (1969) and JP-A-50-39548; cyanine dyes described, e.g., in U.S. Pat. No. 3,597,196; and styryl dyes described, e.g., in JP-A-60-163047, JP-A-59-164588, and JP-A-60-252517.

The charge generating agents which can be used in the photoconductive layer include various conventionally known charge generating agents, either organic or inorganic, for example, selenium, seleniumtellurium, cadmium sulfide, zinc oxide, and organic pigments, for example, (1) azo pigments (including monoazo, bisazo, and trisazo pigments) described, e.g., in U.S. Pat. Nos. 4,436,800 and 4,439,506, JP-A-47-37543, JP-A-58-123541, JP-A-58-192042, JP-A-58-219263, JP-A-59-78356, JP-A-60-179746, JP-A-61-148453, JP-A-61-238063, JP-B-60-5941, and JP-B-60-45664, (2) metal-free or metallized phthalocyanine pigments described, e.g., in U.S. Pat. Nos. 3,397,086 and 4,666,802, JP-A-51-90827, and JP-A-52-55643, (3) perylene pigments described, e.g., in U.S. Pat. No. 3,371,884 and JP-A-47-30330, (4) indigo or thioindigo derivatives described, e.g., in British Patent 2,237,680 and JP-A-47-30331, (5) quinacridone pigments described, e.g., in British Patent 2,237,679 and JP-A-47-30332, (6) polycyclic quinone dyes described, e.g., in British Patent 2,237,678, JP-A-59-184348, JP-A-62-28738, and JP-A-47-18544, (7) bisbenzimidazole pigments described, e.g., in JP-A-47-30331 and JP-A-47-18543, (8) squarylium salt pigments described, e.g., in U.S. Pat. Nos. 4,396,610 and 4,644,082, and (9) azulenium salt pigments described, e.g., in JP-A-59-53850 and JP-A-61-212542. These organic pigments may be used either individually or in combination of two or more thereof.

With respect to a mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur. In general, 5 to 120 parts by weight, and preferably from 10 to 100 parts by weight, of the organic photoconductive compound is used per 100 parts by weight of the total binder resins.

The binder resins (hereinafter referred to as binder resin (B) sometimes) which can be used in the light-sensitive element according to the present invention include those for conventionally known electrophotographic light-sensitive elements. A weight average molecular weight of the binder resin is preferably from $5\times10^3$ to $1\times10^6$, and more preferably from $2\times10^4$ to $5\times10^5$. A glass transition point of the binder resin is preferably from −40° to 200° C., and more preferably from −10° to 140° C. Binder resins which may be used in the present invention are described, e.g., in Takaharu Shibata and Jiro Ishiwatari, *Kobunshi*, Vol. 17, p. 278 (1968), Harumi Miyamoto and Hidehiko Takei, *Imaging, Vol.* 1973, No. 8, Koichi Nakamura (ed.), *Kiroku Zairyoyo Binder no Jissai Gijutsu*, Ch. 10, C.M.C. (1985), Denshishashin Gakkai (ed.), *Denshishashinyo Yukikankotai no Genjo Symposium* (preprint) (1985), Hiroshi Kokado (ed.), *Saikin no Kododen Zairyo to Kankotai no Kaihatsu.Jitsuyoka*, Nippon Kagaku Joho (1986), Denshishashin Gakkai (ed.), *Denshishashin Gijutsu no Kiso to Oyo*, Ch. 5, Corona (1988), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshi Shashin Gakkaishi*, Vol. 18, No. 2, p. 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy group-modified silicone resins, polycarbonate resins, ketone resins, polyester resins, silicone resins, amide resins, hydroxy group- or carboxy group-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

Further, the electrostatic characteristics of the photoconductive layer are improved by using, as a binder resin (B) for a photoconductive substance, a resin having a relatively low molecular weight (e.g., a weight average molecular weight of from $10^3$ to $10^4$) and containing an acidic group such as a carboxy group, a sulfo group or a phosphono group. For instance, JP-A-63-217354 discloses a resin having polymer components containing an acidic group at random in the polymer main chain, JP-A-64-70761 discloses a resin having an acidic group bonded at one terminal of the polymer main chain, JP-A-2-67563, JP-A-2-236561, JP-A-2-238458, JP-A-2-236562 and JP-A-2-247656 disclose a resin of graft type copolymer having an acidic group bonded at one terminal of the polymer main chain or a resin of graft type copolymer containing acidic groups in the graft portion, and JP-A-3-181948 discloses an AB block copolymer containing acidic groups as a block.

Moreover, in order to obtain a satisfactorily high mechanical strength of the photoconductive layer which may be insufficient by only using the low molecular weight resin, a medium to high molecular weight resin is preferably used together with the low molecular weight resin. For instance, JP-A-2-68561 discloses a thermosetting resin capable of forming crosslinked structures between polymers, JP-A-2-68562 discloses a resin partially having crosslinked structures, and JP-A-2-69759 discloses a resin of graft type copolymer having an acidic group bonded at one terminal of the polymer main chain. Also, in order to maintain the relatively stable performance even when ambient conditions are widely fluctuated, a specific medium to high molecular weight resin is employed in combination. For instance, JP-A-3-29954, JP-A-3-77954, JP-A-3-92861 and JP-A-3-53257 disclose a resin of graft type copolymer having an acidic group bonded at the terminal of the graft portion or a resin of graft type copolymer containing acidic groups in the graft portion. Moreover, JP-A-3-206464 and JP-A-3-223762 discloses a graft type copolymer having a graft portion formed from an AB block copolymer comprising an A block containing acidic groups and a B block containing no acidic group.

In a case of using these resins, the photoconductive substance is uniformly dispersed to form a photoconductive layer having good smoothness. Also, excellent electrostatic characteristics can be maintained even when ambient conditions are fluctuated or when a scanning exposure system using a semiconductor laser beam is utilized for the image exposure.

The photoconductive layer usually has a thickness of from 1 to 100 μm, and preferably from 10 to 50 μm.

Where a photoconductive layer functions as a charge generating layer of a laminated type light-sensitive element composed of a charge generating layer and a charge transporting layer, the charge generating layer has a thickness of from 0.01 to 5 μm, and preferably from 0.05 to 2 μm.

Depending on the kind of a light source for exposure, for example, visible light or semiconductor laser beam, various dyes may be used as spectral sensitizers. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described e.g., in Harumi Miyamoto and Hidehiko Takei, *Imaging*, Vol. 1973, No. 8, p. 12, C. J. Young et al., *RCA Review*, Vol. 15, p. 469 (1954), Kohei Kiyota et al., *Denkitsushin Gakkai Ronbunshi*, Vol. J 63-C, No. 2, p. 97 (1980), Yuji Harasaki et al., *Kogyo Kagaku Zasshi*, Vol. 66, p. 78 and 188 (1963), and Tadaaki Tani, *Nihon Shashin Gakkaishi*, Vol. 35, p. 208 (1972).

Specific examples of carbonium dyes, triphenylmethane dyes, xanthene dyes, and phthalein dyes are described, e.g., in JP-B-51-452, JP-A-50-90334, JP-A-50-114227, JP-A-53-39130; JP-A-53-82353, U.S. Pat. Nos. 3,052,540 and 4,054,450, and JP-A-57-16456.

Usable polymethine dyes, such as oxonol dyes, merocyanine dyes, cyanine dyes, and rhodacyanine dyes, are described in F. M. Hamer, *The Cyanine Dyes and Related Compounds*. Specific examples of these dyes are described, e.g., in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-B-48-7814, and JP-B-55-18892.

Further, polymethine dyes capable of performing spectral sensitization in the near infrared to infrared region of 700 nm or more include those described, e.g., in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure,* No. 216, pp. 117–118 (1982).

The light-sensitive element of the present invention is excellent in that the characteristics thereof hardly vary with the combined use of various sensitizing dyes.

If desired, the light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, phthalic anhydride, maleic anhydride, N-hydroxymaleimide, N-hydroxyphthalimide, 2,3-dichloro-5,6-dicyanobenzoquinone, dinitrofluorenone, trinitrofluorenone, tetracyanoethylene, nitrobenzoic acid, and dinitrobenzoic acid; and polyarylalkane compounds, hindered phenol compounds and p-phenylenediamine compounds as described in the literature references cited in Hiroshi Kokado, et al., *Saikin no Kododen Zairyo to Kankotai no Kaihatsu.Jitsuyoka*, Chs. 4 to 6, Nippon Kagaku Joho (1986). In addition, the compounds as described in JP-A-58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer. The amount of the additive to be added is not particularly limited, but ordinarily ranges from 0.001 to 2.0 parts by weight per 100 parts by weight of the photoconductive substance.

The photoconductive layer of the present invention can be provided on a conventionally known support. In general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side). is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum,etc. has been vacuum deposited.

Specific examples of the conductive substrate and materials for rendering non-conductive substrates electrically conductive are described, for example, in Yukio Sakamoto, *Denshishashin,* Vol. 14, No. 1, pp. 2–11 (1975), Hiroyuki Moriga, *Nyumon Tokushushi no Kagaku*, Kobunshi Kankokai (1975), and M. F. Hoover, *J. Macromol. Sci. Chem.,* Vol. A-4, No. 6, pp. 1327–1417 (1970).

Now, the method of forming a color image according to the present invention will be described below.

First, the transfer layer (X) is formed on an electrophotographic light-sensitive element having the surface of releasability.

According to the present invention, the formation of transfer layer (X) on a light-sensitive element can be performed in connection with the steps of electrophotographic process and transfer or independently therefrom. Also, the transfer layer (X) may be previously formed or may be formed each time on demand. When the transfer layer is previously formed independently from these steps, a conventional layer-forming method can be employed. For instance, a solution or dispersion containing the composition for the transfer layer is applied onto the surface of light-sensitive element in a known manner.

The formation of transfer layer (X) is preferably performed each time in an apparatus in which the steps of electrophotographic process and transfer are carried out. By such a method, the light-sensitive element can be repeatedly used in the same apparatus without throwing it away after using it only once. As a result, an advantage to reduce a cost of duplicate can be obtained. For such a purpose, a hot-melt coating method, transfer method or electrodeposition coating method is preferably employed.

The hot-melt coating method will be described as one method for forming the transfer layer in detail below.

The hot-melt coating method comprises hot-melt coating of the composition for the transfer layer by a known method. For such a purpose, a mechanism of a non-solvent type coating machine, for example, a hot-melt coating apparatus for a hot-melt adhesive (hot-melt coater) as described in the above-mentioned *Hot-melt Secchaku no Jissai*, pp. 197 to 215 can be utilized with modification to suit with coating onto the light-sensitive element drum. Suitable examples of coating machines include a direct roll coater, an offset gravure roll coater, a rod coater, an extrusion coater, a slot orifice coater, and a curtain coater.

A melting temperature of the thermoplastic resin at coating is usually in a range of from 50° to 180° C., while the optimum temperature is determined depending on the composition of the thermoplastic resin to be used. It is preferred that the resin is first molten using a closed pre-heating device having an automatic temperature controlling means and then heated in a short time to the desired temperature in a position to be coated on the light-sensitive element. To do so can prevent from degradation of the thermoplastic resin upon thermal oxidation and unevenness in coating.

A coating speed may be varied depending on flowability of the thermoplastic resin at the time of being molten by heating, a kind of coater, and a coating amount, etc., but is suitably in a range of from 1 to 100 mm/sec, preferably from 5 to 40 mm/sec.

The tansfer method will be described as one method for forming the transfer layer in detail below.

The transfer method comprises previously forming a transfer layer on release paper by hot-melt coating, solvent coating or electrodeposition of latex, etc. and heat-transferring the transfer layer onto the surface of electrophotographic light-sensitive element.

The release paper having the transfer layer thereon is simply supplied to an electrophotographic device in the form of a roll or sheet.

The release paper which can be employed in the present invention include those conventionally known as described, for example, in *Nenchaku (Nensecchaku) no Shin Gijutsu to Sono Yoto.Kakushu Oyoseihin no Kaihatsu Siryo*, published by Keiei Kaihatsu Center Shuppan-bu (May 20, 1978), and *All Paper Guide Shi no Shohin Jiten, Jo Kan, Bunka Sangyo Hen,* published by Shigyo Times Sha (Dec. 1, 1983). Specifically, the release paper comprises a substrate such as nature Clupak paper laminated with a polyethylene resin, high quality paper pre-coated with a solvent-resistant resin, kraft paper, a PET film having an under-coating or glassine having coated thereon a release agent mainly composed of silicone.

A solvent type of silicone is usually employed and a solution thereof having a concentration of from 3 to 7% by weight is coated on the substrate, for example, by a gravure roll or a wire bar, dried and then subjected to heat treatment at not less than 150° C. to be cured. The coating amount is usually about 1 g/m$^2$.

Release paper for tapes, labels, formation industry use and cast coat industry use each manufactured by a paper makingcompany and put on sale are also generally employed. Specific examples thereof include Separate Shi (manufactured by Oji Paper Co., Ltd.), King Rease (manufactured by Shikoku Seishi K.K.), Sun Release (manufactured by Sanyo Kokusaku Pulp K.K.) and NK High Release (manufactured by Nippon Kako Seishi K.K.).

In order to form the transfer layer on release paper, a composition for the transfer layer mainly composed of resin is applied to releasing paper in a conventional manner, for example, by bar coating, spin coating or spray coating to form a film.

For a purpose of heat transfer of the transfer layer on release paper to an electrophotographic light-sensitive element, conventional heat transfer methods are utilized. Specifically, release paper having the transfer layer thereon is pressed on the electrophotographic light-sensitive element to heat transfer the transfer layer.

The conditions for transfer of the transfer layer from release paper to the surface of light-sensitive element are preferably as follows. A nip pressure of the roller is from 0.1 to 10 kgf/cm$^2$ and more preferably from 0.2 to 8 kgf/cm$^2$. A temperature at the transfer is from 25° to 100° C. and more preferably from 40° to 80° C. A speed of the transportation is from 0.5 to 100 mm/sec and more preferably from 3 to 50 mm/sec. The speed of transportation may differ from that of the electrophotographic step or that of the heat transfer step of the transfer layer to a receiving material.

Now, the electrodeposition coating method will be described as one method for forming the transfer layer in detail below.

According to the electrodeposition coating method, the thermoplastic resin as described above is electrodeposited or adhered on the surface of light-sensitive element in the form of resin grains (AR) and then transformed into a uniform thin film, for example, by heating, thereby the transfer layer (X) being formed.

The thermoplastic resin grains (AR) must have either a positive charge or a negative charge. The electroscopicity of the resin grains is appropriately determined depending on a charging property of the electrophotographic light-sensitive element to be used in combination.

An average grain diameter of the resin grains (AR) having the physical property described above is generally in a range of from 0.01 to 15 μm, preferably from 0.05 to 5 μm and more preferably from 0.1 to 1 μm. The resin grains may be employed as powder grains (in case of dry type electrodeposition) or grains dispersed in a non-aqueous system (in case of wet type electrodeposition). The resin grains dispersed in a non-aqueous system are preferred since they can easily prepare the peelable transfer layer having a uniform and small thickness.

In particular, the transferability of transfer layer formed is further improved in case of using resin grains (ARW) containing in each grain at least two kind of resins having a glass transition point different from each other, prefrably at least one of the resins (AH) having a high glass transition point described above and at least one of the resins (AL) having a low glass transition point described above.

The resin grains having a fine grain size used in the present invention can be produced by a conventionally known mechanical powdering method or polymerization granulation method. These methods can be applied to the production of resin grains for both of dry type electrodeposition and wet type electrodeposition.

The mechanical powdering method for producing powder grains used in the dry type electrodeposition method includes a method wherein the resin is directly powdered by a conventionally known pulverizer to form fine grains (for example, a method using a ball mill, a paint shaker or a jet mill). If desired, mixing, melting and kneading of the materials for resin grains before the powdering and classification for a purpose of controlling a grain diameter and after-treatment for treating the surface of grain after the powdering may be performed in an appropriate combination. A spray dry method is also employed.

Specifically, the powder grains can be easily produced by appropriately using a method as described in detail, for example, in Shadanhojin Nippon Funtai Kogyo Gijutsu Kyokai (ed.), *Zoryu Handbook*, II ed., Ohm Sha (1991), Kanagawa Keiei Kaihatsu Center, *Saishin Zoryu Gijutsu no Jissai*, Kanagawa Keiei Kaihatsu Center Shuppan-bu (1984), and Masafumi Arakawa et al (ed.), *Saishin Funtai no Sekkei Gijutsu*, Techno System (1988).

The polymerization granulation methods include conventionally known methods using an emulsion polymerization reaction, a seed polymerization reaction or a suspension polymerization reaction each conducted in an aqueous system, or using a dispersion polymerization reaction conducted in a non-aqueous solvent system.

More specifically, grains are formed according to the methods as described, for example, in Soichi Muroi, *Kobunshi Latex no Kagaku*, Kobunshi Kankokai (1970), Taira Okuda and Hiroshi Inagaki, *Gosei Jushi Emulsion*, Kobunshi Kankokai (1978), soichi Muroi, *Kobunshi Latex Nyumon*, Kobunsha (1983), I. Pürma and P. C. Wang, *Emulsion Polymerization*, I. Pürma and J. L. Gaudon, *ACS Symp. Sev.*, 24, p. 34 (1974), Fumio Kitahara et al, *Bunsan Nyukakei no Kagaku*, Kogaku Tosho (1979), and Soichi Muroi (supervised), *Chobiryushi Polymer no Saisentan Gijutsu*, C.M.C. (1991), and then collected and pulverized in such a manner as described in the reference literatures cited with respect to the mechanical method above, thereby the resin grains being obtained.

In order to conduct dry type electrodeposition of the fine powder grains thus-obtained, a conventionally known method, for example, a coating method of electrostatic powder and a developing method with a dry type electrostatic developing agent can be employed. More specifically, a method for electrodeposition of fine grains charged by a method utilizing, for example, corona charge, triboelectrification, induction charge, ion flow charge, and inverse ionization phenomenon, as described, for example, in J. F. Hughes, *Seiden Funtai Toso*, translated by Hideo Nagasaka and Machiko Midorikawa, or a developing method, for example, a cascade method, a magnetic brush method, a fur brush method, an electrostatic method, an induction method, a touchdown method and a powder cloud method, as described, for example, in Koich Nakamura (ed.), *Saikin no Denshishashin Genzo System to Toner Zairyo no Kaihatsu.Jitsuyoka*, Ch. 1, Nippon Kogaku Joho (1985) is appropriately employed.

The production of a latex in a non-aqueous system which are used in the wet type electrodeposition method can also be performed by any of the mechanical powdering method and polymerization granulation method as described above.

The mechanical powdering method includes a method wherein the resin is dispersed together with a dispersion polymer in a wet type dispersion machine (for example, a ball mill, a paint shaker, Keddy mill, and Dyno-mill), and a method wherein the materials for resin grains and a dispersion assistant polymer (or a covering polymer) have been previously kneaded, the resulting mixture is pulverized and then is dispersed together with a dispersion polymer. Specifically, a method of producing paints or electrostatic developing agents can be utilized as described, for example, in Kenji Ueki (translated), *Toryo no Ryudo to Ganryo Bunsan*, Kyoritsu Shuppan (1971), D. H. Solomon, *The Chemistry of Organic Film Formers*, John Wiley & Sons (1967), *Paint and Surface Coating Theory and Practice*, Yuji Harasaki, *Coating Kogaku*, Asakura Shoten (1971), and Yuji Harasaki, *Coating no Kiso Kagaku*, Maki Shoten (1977).

The polymerization granulation method includes a dispersion polymerization method in a non-aqueous system conventionally known and is specifically described, for example, in *Chobiryushi Polymer no Saisentan Gijutsu*, Ch. 2, mentioned above, *Saikin no Denshishashin Genzo System to Toner Zairyo no Kaihatsu.Jitsuyoka*, Ch. 3, mentioned above, and K. E. J. Barrett, *Dispersion Polymerization in Organic Media*, John Wiley & Sons (1975).

The resin grains (ARW) containing in each grain at least two kind of resins having a glass transition point different from each other described above can be easily prepared using a seed polymerization method. Specifically, fine grains of the resin (AL) or resin (AH) are first prepared by a conventionally known dispersion polymerization method in a non-aqueous system and then using these fine grains as seeds, a monomer corresponding to the resin (AH) or resin (AL) is supplied to conduct polymerization in the same manner as above, whereby the resin grains (ARW) are preferably obtained.

The resin grains composed of a random copolymer containing the polymer component (F) to increase the peelability of the resin (A) can be easily obtained by performing a polymerization reaction using one or more monomers forming the resin (A) which are soluble in an organic solvent but becomes insoluble therein by being polymerized together with a monomer corresponding to the polymer component (F) according to the polymerization granulation method described above.

The resin grains containing the polymer component (F) as a block can be prepared by conducting a polymerization reaction using, as a dispersion stabilizing resins, a block copolymer containing the polymer component (F) as a block, or conducting polymerization reaction using a monofunctional macromonomer having a weight average molecular weight of from $1\times10^3$ to $2\times10^4$, preferably from $3\times10^3$ to $1.5\times10^4$ and containing the polymer component (F) as the main repeating unit together with one or more monomers forming the resin (A). Alternatively, the resin grains composed of block copolymer can be obtained by conducting a polymerization reaction using a polymer initiator (for example, azobis polymer initiator or peroxide polymer initiator) containing the polymer component (F) as the main repeating unit.

As the non-aqueous solvent used in the dispersion polymerization method in a non-aqueous system, there can be used any of organic solvents having a boiling point of at most 200° C., individually or in a combination of two or more thereof.

Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

When the dispersed resin grains are synthesized by the dispersion polymerization method in a non-aqueous solvent system, the average grain diameter of the dispersed resin grains can readily be adjusted to at most 1 μm while simultaneously obtaining grains of mono-disperse system with a very narrow distribution of grain diameters.

A dispersive medium used for the resin grains dispersed in a non-aqueous system at the electrodeposition is usually a non-aqueous solvent having an electric resistance of not less than $10^8$ Ω·cm and a dielectric constant of not more than 3.5, since the dispersion is employed in a method wherein the resin grains are electrodeposited utilizing a wet type electrostatic photographic developing process or electrophoresis in electric fields.

The insulating solvents which can be used include straight chain or branched chain aliphatic hydrocarbons, alicyclic hydrocarbons, aromatic hydrocarbons, and halogen-substituted derivatives thereof. Specific examples of the solvent include octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 Solvent (Amsco: trade name of Americal Mineral Spirits Co.). They may be used singly or as a combination thereof.

The insulating organic solvent described above is preferably employed as a non-aqueous solvent from the beginning of polymerization granulation of resin grains dispersed in the non-aqueous system. However, it is also possible that the granulation is performed in a solvent other than the above-described insulating solvent and then the dispersive medium is substituted with the insulating solvent to prepare the desired dispersion.

Another method for the preparation of a latex in non-aqueous system is that a block copolymer comprising a polymer portion which is soluble in the above-described non-aqueous solvent having an electric resistance of not less than $10^8$ Ω·cm and a dielectric constant of not more than 3.5 and a polymer portion which is insoluble in the non-aqueous solvent, is dispersed in the non-aqueous solvent by a wet type dispersion method. Specifically, the block copolymer comprising a soluble polymer component and an insoluble polymer component is first synthesized in an organic solvent which dissolves the resulting block copolymer according to the synthesis method of block copolymer as described above and then dispersed in the non-aqueous solvent described above.

In order to electrodeposit dispersed grains in a dispersive medium upon electrophoresis, the grains must be electroscopic grains of positive charge or negative charge. The impartation of electroscopicity to the grains can be performed by appropriately utilizing techniques on developing agents for wet type electrostatic photography. More specifically, it can be carried out using electroscopic materials and other additives as described, for example, in *Saikin no Denshishashin Genzo System to Toner Zairyo no Kaihatsu.Jitsuyoka*, pp. 139 to 148, mentioned above, Denshishashin Gakkai (ed.), *Denshishashin Gijutsu no Kiso to Oyo*, pp. 497 to 505, Corona Sha (1988), and Yuji Harasaki, *Denshishashin*, Vol. 16, No. 2, p. 44 (1977).

Further, compounds as described, for example, in British Patents 893,429 and 934,038, U.S. Pat. Nos. 1,122,397, 3,900,412 and 4,606,989, JP-A-60-179751, JP-A-60-185963 and JP-A-2-13965.

The latex in a non-aqueous system which can be employed for electrodeposition usually comprises from 0.1 to 20 g of grains containing the thermoplastic resin, from 0.01 to 50 g of a dispersion stabilizing resin and if desired, from 0.0001 to 10 g of a charge control agent in one liter of an electrically insulating dispersive medium.

Furthermore, if desired, other additives may be added to the dispersion of resin grains in order to maintain dispersion stability and charging stability of grains. Suitable examples of such additives include rosin, petroleum resins, higher alcohols, polyethers, silicone oil, paraffin wax and triazine derivatives. However, the present invention showed not be construed as being limited thereto.

The total amount of these additives is restricted by the electric resistance of the dispersion. Specifically, if the electric resistance of the dispersion becomes lower than $10^8$ Ω·cm, a sufficient amount of the thermoplastic resin grains deposited is reluctant to obtain and, hence, it is necessary to control the amounts of these additives in the range of not lowering the electric resistance than $10^8$ Ω·cm.

The thermoplastic resin grains which are prepared, provided with an electrostatic charge and dispersed in an electrically insulting liquid behave in the same manner as an electrophotographic wet type developing agent. For instance, the resin grains can be subjected to electrophoresis on the surface of light-sensitive element using a developing device, for example, a slit development electrode device as described in *Denshishashin Gijutsu no Kiso to Oyo*, pp. 275 to 285, mentioned above. Specifically, the grains comprising the thermoplastic resin are supplied between the electrophotographic light-sensitive element and an electrode placed in face of the light-sensitive element, and migrate by electrophoresis according to a potential gradient applied from an external power source to adhere to or electrodeposit on the electrophotographic light-sensitive element, thereby a film being formed.

In general, if the charge of grains is positive, an electric voltage was applied between an electroconductive support of the light-sensitive element and a development electrode of a developing device from an external power source so that the light-sensitive material is negatively charged, thereby the grains being electrostatically electrodeposited on the surface of light-sensitive element.

Electrodeposition of grains can also be performed by wet type toner development in a conventional electrophotographic process. Specifically, the light-sensitive element is uniformly charged and then subjected to a conventional wet type toner development without exposure to light or after conducting a so-called print-off in which only unnecessary regions are exposed to light, as described in *Denshishashin Gijutsu no Kiso to Oyo*, pp. 46 to 79, mentioned above.

The amount of thermoplastic resin grain adhered to the light-sensitive element can be appropriately controlled, for example, by an external bias voltage applied, a potential of the light-sensitive element charged and a developing time.

After the electrodeposition of grains, the developing solution is wiped off upon squeeze using a rubber roller, a gap roller or a reverse roller. Other known methods, for example, corona squeeze and air squeeze can also be employed. Then, the deposit is dried with cool air or warm air or by a infrared lamp preferably to be rendered the thermoplastic resin grains in the form of a film, thereby the transfer layer being formed.

Further, the impartation of releasability and formation of transfer layer (X) onto a light-sensitive element can be performed at the same time using a dispersion for electrodeposition to form the transfer layer (X) containing a compound (S) having at least a fluorine atom and/or a silicon atom at the formation of the transfer layer (X) on the light-sensitive element according to the present invention. Thus, a conventional electrophotographic light-sensitive element can be utilized without employing a specific means for imparting the releasability onto the light-sensitive element.

The compound (S) used for such a purpose includes the same compound as described with respect to the compound (S) for imparting releasability above and is soluble at least 0.01 g per one liter of an electrically insulating organic solvent having a dielectric constant of not more than 3.5 (at a temperature of 25° C.). By using the compound (S) which is soluble at least 0.01 g per liter of the electrically insulating organic solvent, the stable releasability is constantly, provided on the surface of light-sensitive element without the occurrence of unevenness in adsorption of the compound (S).

Any compound (S) which has the property can be employed in that when a solution containing the compound (S) dissolved at a concentration of 0.01 g per liter in an electrically insulating organic solvent described above is applied to an electrophotographic light-sensitive element to be used and set to touch, and then the resulting light-sensitive element is measured its adhesive strength according to JIS Z 0237-1980 "Testing methods of pressure sensitive adhesive tapes and sheets" described above, the adhesive strength is not more than 150 g·f, preferably not more than 100 g·f, and more preferably not more than 50 g·f. Specific examples thereof are same as those described with respect to the compound (S) above.

The amount of compound (S) added to the electrically insulating organic solvent may be varied depending on the compound (S) and the electrically insulating organic solvent to be used. A suitable amount of the compound (S) is determined taking the effect to be obtained and adverse affects on electrophoresis of resin grains (e.g., decrease in electric resistance or increase in viscosity of the solution) into consideration. A preferred range of the compound (S) added is ordinarily from 0.01 to 20 g per liter of electrically insulating organic solvent.

Then, toner images are formed on the transfer layer (X) provided on the surface of electrophotographic light-sensitive element via a conventional electrophotographic process according to the present invention. Specifically, each step of charging, light exposure, development and fixing is performed in a conventionally known manner.

The developers which can be used in the present invention include conventionally known developers for electrostatic photography, either dry type or liquid type developers for electrostatic photography.

For example, specific examples of the developer are described in *Denshishashin Gijutsu no Kiso to Oyo*, supra, pp. 497–505, Koichi Nakamura (ed.), *Toner Zairyo no Kaihatsuo.Jitsuyoka*, Ch. 3, Nippon Kagaku Joho (1985), Gen Machida, *Kirokuyo Zairyo to Kankosei Jushi*, pp. 107–127 (1983), and Denshishasin Gakkai (ed.), *Imaging*, Nos. 2–5, "Denshishashin no Genzo.Teichaku.Taiden.Tensha", Gakkai Shuppan Center.

Dry developers practically used include one-component magnetic toners, two-component toners, one-component non-magnetic toners, and capsule toners. Any of these dry developers may be employed in the present invention.

Particularly, a combination of a scanning exposure system using a laser beam based on digital information and a development system using a liquid developer is an advantageous process since the process is particularly suitable to form highly accurate images. One specific example of the formation of toner image is illustrated below.

An electrophotographic light-sensitive material is positioned on a flat bed by a register pin system and fixed on the flat bed by air suction from the backside. Then it is charged by means of a charging device, for example, the device as described in Denshishashin Gakkai (ed.), *Denshishashin Gijutsu no Kiso to Oyo*, p. 212 et seq., Corona Sha (Jun. 15, 1988). A corotron or scotron system is usually used for the charging process. In a preferred charging process, the charging conditions may be controlled by a feedback system of the information on charged potential from a detector connected to the light-sensitive material thereby to control the surface potential within a predetermined range. Thereafter, the charged light-sensitive material is exposed to light by scanning with a laser beam in accordance with the system described, for example, in *ibidem*, p. 254 et seq.

Toner development is then conducted using a liquid developer. The light-sensitive material charged and exposed is removed from the flat bed and developed according to a wet type developing method as described, for example, in *ibidem*, p. 275 et seq. The exposure mode is determined in accord with the toner image development mode. Specifically, in case of reversal development, a negative image is irradiated with a laser beam, and a toner having the same charge polarity as that of the charged light-sensitive material is electrodeposited on the exposed area with a bias voltage applied. For the details, reference can be made to *ibidem*, p. 157 et. seq.

After the toner development, the light-sensitive material is squeezed to remove the excess developer as described in *ibidem*, p. 283 and dried. Preferably, the light-sensitive material may be rinsed with the carrier liquid used in the liquid developer alone before squeezing.

The typical liquid developer is basically composed of an electrically insulating organic solvent, for example, an isoparaffinic aliphatic hydrocarbon (e.g., Isopar H or Isopar G (manufactured by Esso Chemical Co.), Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein a colorant (e.g., an inorganic or organic dye or pigment) and a resin for imparting dispersion stability, fixability, and chargeability to the developer (e.g., an alkyd resin, an acrylic resin, a polyester resin, a styrene-butadiene resin, and rosin). If desired, the liquid developer can contain various additives for enhancing charging characteristics or improving image characteristics.

The colorant is appropriately selected from known dyes and pigments, for example, benzidine type, azo type, azomethine type, xanthene type, anthraquinone type, phthalocyanine type (including metallized type), titanium white, nigrosine, aniline black, and carbon black.

Other additives include, for example, those described in Yuji Harasaki, *Denshishashin*, Vol. 16, No. 2, p. 44, such as di-2-ethylhexylsufosuccinic acid metal salts, naphthenic acid metal salts, higher fatty acid metal salts, alkylbenzenesulfonic acid metal salts, alkylphosphoric acid metal salts, lecithin, polyvinylpyrrolidone, copolymers containing a maleic acid monoamido component, coumarone-indene resins, higher alcohols, polyethers, polysiloxanes, and waxes. However, the present invention should not be construed as being limited thereto.

With respect to the content of each of the main components of the liquid developer, toner particles mainly comprising a resin (and, if desired, a colorant) are preferably present in an amount of from 0.5 to 50 parts by weight per 1000 parts by weight of a carrier liquid. If the toner content is less than 0.5 part by weight, the image density is insufficient, and if it exceeds 50 parts by weight, the occurrence of fog in the non-image areas may be tended to. If desired, the above-described resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the amount of each additive should be controlled so that the liquid developer exclusive of toner particles has an electrical resistivity of not less than $10^9$ Ωcm. If the resistivity is less than $10^9$ Ωcm, a continuous gradation image of good quality can hardly be obtained.

The liquid developer can be prepared, for example, by mechanically dispersing a colorant and a resin in a dispersing machine, e.g., a sand mill, a ball mill, a jet mill, or an attritor, to produce colored particles, as described, for example, in JP-B-35-5511, JP-B-35-13424, JP-B-50-40017, JP-B-49-98634, JP-B-58-129438, and JP-A-61-180248.

The colored particles may also be obtained by a method comprising preparing dispersed resin grains having a fine grain size and good monodispersity in accordance with a non-aqueous dispersion polymerization method and coloring the resulting resin grains. In such a case, the dispersed grains prepared can be colored by dyeing with an appropriate dye as described, e.g., in JP-A-57-48738, or by chemical bonding of the dispersed grains with a dye as described, e.g., in JP-A-53-54029. It is also effective to polymerize a monomer already containing a dye at the polymerization granulation to obtain a dye-containing copolymer as described, e.g., in JP-B-44-22955.

Then, a transfer layer (Y) is formed on the surface bearing the toner image.

According to the present invention, the formation of transfer layer (Y) on the toner image can be performed independently from the steps of electrophotographic process and transfer or in an apparatus in which these steps are conducted. When the formation of transfer layer (Y) is carried out independently from these steps, a conventional layer-forming method can be employed. For instance, a solution or dispersion containing the compositions for the transfer layer is applied onto the toner image in a known manner.

The formation of transfer layer (Y) is preferably performed each time in an apparatus in which the steps of electrophotographic process and transfer are carried out. By such a method, the light-sensitive element can be repeatedly used in the same apparatus without throwing it away after using it only once. As a result, an advantage to reduce a cost of duplicate can be obtained. For such a purpose, a hot-melt coating method, transfer method or electrodeposition coating method is preferably employed.

A thickness of the transfer layer (Y) formed is preferably from 0.1 to 10 μm, more preferably from 0.5 to 7 μm.

Specific embodiments of the above-described application methods are same as those described with respect the formation of transfer layer (X) hereinbefore.

The toner image on the light-sensitive material is then heat-transferred to a receiving material together with the transfer layers (X) and (Y). The heat-transfer of the toner image can be performed using known methods and apparatus.

An example of the apparatus for transferring the transfer layers with the toner image therebetween to a receiving material is illustrated in FIG. 2.

The apparatus is composed of a pair of rollers covered with rubber 4 each containing therein a heating means 5 which are driven with a predetermined nip pressure applied. The surface temperature of rollers 4 is preferably in a range of from 50° to 150° C., and more preferably from 80° to 120° C., the nip pressure between rollers 4 is preferably in a range of from 0.2 to 20 kgf/cm$^2$, and more preferably from 0.5 to 10 kgf/cm$^2$, and the transportation speed is preferably in a range of from 0.1 to 300 mm/sec, and more preferably from 10 to 250 mm/sec. As a matter of course, these conditions should be optimized according to the physical properties of the materials of the transfer layer, light-sensitive layer and support of the light-sensitive material employed.

The temperature of roller surface is preferably maintained within a predetermined range by means of known surface temperature detective means 6 and temperature controller 7. A pre-heating means and a cooling means for the light-sensitive material may be provided in front of and at the rear of the heating roller portion, respectively.

Although not shown in FIG. 2, as a means for pressing two rollers, a pair of springs provided at both ends of the shaft of at least one roller or an air cylinder using compressed air may be employed.

It is preferred in the present invention that the transfer layers (X) and (Y) are formed on an electrophotographic light-sensitive element whose surface has the adhesive strength of not more than 150 g·f and toner images, respectively, in an apparatus wherein an electrophotographic process is performed, as described above. By such a method, the light-sensitive element can be repeatedly used in without apparatus without throwing it away after using it only once, and the electrophotographic process can be conducted continuously. As a result, an advantage to remarkably reduce a cost of duplicate formed can be obtained.

In order to form the transfer layer (X) on the surface of a light-sensitive element or to form the transfer layer (Y) on toner images in the apparatus wherein an electrophotographic process is conducted, the hot-melt coating method, transfer method or electrodeposition coating method is preferably employed. The transfer layer (X) and transfer layer (Y) may be formed by the same method or different methods.

A thickness of the transfer layer (X) formed is preferably from 0.1 to 10 μm, more preferably from 0.5 to 7 μm.

The receiving material used in the present invention is not particularly limited and any material conventionally known can be employed. Suitable examples of the receiving materials include those of reflective type, for example, natural paper such as high quality paper, coated paper or art paper, synthetic paper, a metal plate such as an aluminum, iron or SUS plate, and those of transmittive type, for example, a plastic film such as a polyester, polyolefin, polyvinyl chloride or polyacetate film.

Now, preferred embodiments of the method of forming a color image according to the present invention will be described in greater detail with reference to the accompanying drawings hereinbelow.

FIG. 3 is a schematic view of a color image-forming apparatus using the hot-melt coating method as a method for forming the transfer layer.

As described above, when an electrophotographic light-sensitive element 11 whose surface has been modified to have releasability, a transfer layer 12 is formed on the light-sensitive element 11. On the other hand, when releasability of the surface of light-sensitive element 11 is insufficient, a device is provided to cause the compound (S) to absorb or adhere to the surface of light-sensitive element before the formation of transfer layer 12, thereby the desired releasability being imparted to the surface of light-sensitive element 11. Specifically, the compound (S) is supplied from an applying device for compound (S) 30 which utilizes any one of the embodiments as described above onto the surface of light-sensitive element 11. The applying device for compound (S) 30 may be stationary or movable.

Thermoplastic resin **12*a* is coated on the surface of a light-sensitive element 11 provided on the peripheral surface of a drum by a hot-melt coater 20 and is caused to pass under a suction/exhaust unit 15 to be cooled to a predetermined temperature. After the hot-melt coater 20 is moved to the stand-by position indicated as 20*a*, a liquid developing unit set 14 is moved to the position where the hot-melt coater 20 was. The unit set 14 is provided with a developing units 14*y*, 14*m*, 14*c* and 14*b*** containing yellow, magenta, cyan and black liquid developers respectively. Each of the developing unit may be equipped with a pre-bathing means, a rinsing means and a squeezing means in order to prevent the occurrence of stain in the non-image areas, if desired. As the pre-bath and the rinse solution, a carrier liquid for a liquid developer is conventionally used.

The light-sensitive element 11 bearing thereon the transfer layer (X) 12 composed of thermoplastic resin is then subjected to the electrophotographic process. Specifically, when the light-sensitive element 11 is uniformly charged to, for instance, a positive polarity by a corona charger 18 and then is exposed imagewise by an exposure device (e.g., a semiconductor laser) 19 on the basis of yellow image information, the potential is lowered in the exposed regions and thus, a contrast in potential is formed between the exposed regions and the unexposed regions. The yellow liquid developing unit **14*y* containing a liquid developer comprising yellow pigment particles having a positive electrostatic charge dispersed in an electrically insulating liquid is brought near the surface of a light-sensitive element 11** and is kept stationary with a gap of 1 mm therebetween.

The light-sensitive element 11 is first pre-bathed by a pre-bathing means provided in the developing unit, and then the yellow liquid developer is supplied on the surface of the light-sensitive element while applying a developing bias voltage between the light-sensitive element and a development electrode by a bias voltage source and wiring (not shown). The bias voltage is applied so that it is slightly lower than the surface potential of the unexposed regions, while the development electrode is charged to positive and the light-sensitive element is charged to negative. When the bias voltage applied is too low, a sufficient density of the toner image cannot be obtained.

The liquid developer adhering to the surface of light-sensitive element is subsequently washed off by a rinsing means installed in the developing unit 14 and the rinse solution adhering to the surface of the light-sensitive material is removed by a squeeze means. Then, the light-sensitive material is dried by passing under the suction/exhaust unit 15. The above described electrophotographic process is repeated with respect to each image information of magenta, cyan and black. Meanwhile a heat transfer means 17 is kept away from the surface of the light-sensitive element.

After four color images are formed on the transfer layer (X) 12, a transfer layer (Y) 13 is provided on the four color toner images in the same manner as the transfer layer. (X) 12 described above.

Then, the transfer layer is pre-heated in a predetermined range by a pre-heating means 17*a* for heat transfer, pressed against a rubber roller 17*b* having therein a heater with a temperature control means with the receiving material 16 intervening therebetween, and then passed under a cooling roller 17*c*, thereby heat-transferring the toner images to the receiving material 16 together with the transfer layer (X) 12 and transfer layer (Y) 13. Thus a cycle of steps is terminated.

The heat transfer means 17 for heating-transferring the transfer layer (X) 12 and transfer layer (Y) 13 to the receiving material 16 comprises the pre-heating means 17*a*, the heating roller 17*b* which is in the form of a metal roller having therein a heater and is covered with rubber, and the cooling roller 17*c*. As the pre-heating means 17*a*, a non-contact type heater such as an infrared line heater, a flash heater or the like is used, and the transfer layer is pre-heated in a range below a temperature of the surface of the light-sensitive element achieved with heating by the heating roller 17*b*. The surface temperature of light-sensitive element heated by the heating roller 17*b* is preferably in a range of from 50° to 150° C., and more preferably from 80° to 120° C.

The cooling roller 17*c* comprises a metal roller which has a good thermal conductivity such as aluminum, copper or the like and is covered with silicone rubber. It is preferred that the cooling roller 17*c* is provided with a cooling means therein or on a portion of the outer surface which is not brought into contact with the receiving material in order to radiate heat. The cooling means includes a cooling fan, a coolant circulation or a thermoelectric cooling element, and it is preferred that the cooling means is coupled with a temperature controller so that the temperature of the cooling roller 17*c* is maintained within a predetermined range.

The nip pressure of the rollers is preferably in a range of from 0.2 to 20 kgf/cm$^2$ and more preferably from 0.5 to 15 kgf/cm$^2$. Although not shown, the rollers may be pressed by springs provided on opposite ends of the roller shaft or by an air cylinder using compressed air.

A speed of the transportation is preferably in a range of from 0.1 to 100 mm/sec and more preferably in a range of from 1 to 30 mm/sec. The speed of transportation may differ between the electrophotographic step and the heat transfer step.

By stopping the apparatus in the state where the transfer layer has been formed, the next operation can start with the electrophotographic process. Thus, the transfer layer acts to protect the light-sensitive element and prevent the properties of the light-sensitive element from deteriorating due to environmental influence.

It is needless to say that the above-described conditions should be optimized depending on the physical properties of the light-sensitive material (i.e., the transfer layer, the light-sensitive layer and support) and the receiving material employed. Especially it is important to determine the conditions of pre-heating, roller heating and cooling in the heat transfer step taking into account the factors such as glass transition point, softening temperature, flowability, tackiness, film properties and film thickness of the transfer layer. Specifically, the conditions should be set so that the tackiness of the transfer layer increases and the transfer layer is closely adhered to the receiving material when the transfer layer softened to a certain extent by the pre-heating means passes the heating roller, and so that the temperature of the transfer layer is decreased to reduce the flowability and the tackiness after the transfer layer subsequently passes the cooling roller and thus the transfer layer is peeled as a film from the surface of the light-sensitive element together with the toner.

A device for simply forming a transfer layer utilizing release paper on a light-sensitive element is schematically illustrated in FIG. 5.

In FIG. 5, release paper 10 having provided thereon a transfer layer (X) 12 is heat-pressed on the light-sensitive element 11 by a heating roller 117*b*, thereby the transfer layer (X) 12 being transferred on the surface of light-sensitive element 11. The release paper 10 is cooled by a cooling roller 117*c* and recovered. The light-sensitive element 11 is heated by a pre-heating means 17*a* to improve transferability of the transfer layer (X) 12 upon heat-press, if desired.

One example of specific embodiment of an apparatus for conducting the electrophotographic process and the heat-transfer onto a receiving material in which a device for forming a transfer layer by transferring from release paper is installed is schematically illustrated in FIG. 4.

The apparatus of FIG. 4 has essentially the same constitution as the apparatus (FIG. 3) using the hot-melt coating method described above except for a transfer means 117 for forming a transfer layer (X) 12 or transfer layer (Y) 13.

In FIG. 4, the transfer layer (X) 12 is transferred from release paper 10 to a light-sensitive element, a toner image is formed on the transfer layer (X) by an electrophotographic process, and the transfer layer (Y) is formed on the toner image in the same manner as the formation of transfer layer (X) using the transfer mean 117. Then, the transfer means 117 is substituted with a transfer means 17 having a receiving material 16, and heat-transfer is conducted in the same manner as described with respect to the hot-melt coating method above. Alternatively, both a transfer means for transferring the transfer layer (X) 12 and transfer layer (Y) 13 from release paper 10 onto the light-sensitive element 11 and a transfer means for transferring the transfer layer (X) 12 and transfer layer (Y) 13 having a toner image therebetween onto the receiving material 16 are installed in the apparatus.

The conditions for transfer of the transfer layer (X) 12 from release paper 10 to the surface of light-sensitive element 11 are preferably as follows. A nip pressure of the roller is from 0.1 to 10 kgf/cm$^2$ and more preferably from 0.2 to 8 kgf/cm$^2$. A temperature at the transfer is from 25° to 100° C. and more preferably from 40° to 80° C. A speed of the transportation is from 0.5 to 100 mm/sec and more preferably from 3 to 50 mm/sec. The speed of transportation may differ from that of the electrophotographic step or that of the heat transfer step of the transfer layer to a receiving material.

The formation of transfer layer by the electrodeposition coating method will be described in greater detail with reference to the accompanying drawings below. FIG. 6 is a schematic view of an electrophotographic transfer image-forming apparatus having installed therein a device for forming a transfer layer by the electrodeposition coating method. The apparatus of FIG. 6 has essentially the same constitution as the apparatus using the hot-melt coating method described above except for a means for forming a transfer layer (X) 12 or transfer layer (Y) 13.

A dispersion **12*b* of thermoplastic resin grains is supplied to an electrodeposition unit 14T provided in a movable liquid developing unit set 14. The electrodeposition unit 14T is first brought near the surface of the light-sensitive element 11 and is kept stationary with a gap of 1 mm between a development electrode of the electrodeposition unit 14 and the light-sensitive element. The light-sensitive element 11 is rotated while supplying the dispersion 12*b* of thermoplastic resin grains into the gap and applying an electric voltage across the gap from an external power source (not shown), whereby the grains are deposited over the entire image-forming areas of the surface of the light-sensitive element 11**.

The dispersion **12*b* of thermoplastic resin grains excessively adhered to the surface of the light-sensitive element 11 is removed by a squeezing device built in the electrodeposition unit 14T, and the light-sensitive element is dried by passing under the suction/exhaust unit 15. Then the thermoplastic resin grains are fused by the pre-heating means 17*a* and thus a transfer layer (X) 12** in the form of thermoplastic resin film is obtained.

Thereafter the transfer layer is cooled to a predetermined temperature, if desired, from an outside of the light-sensitive element or from an inside of the drum of the light-sensitive element by a cooling device which is similar to the suction/exhaust unit 15, although not shown. After moving away the electrodeposition unit 14T, the liquid developing unit set 14 is posited. After the formation of toner image, a transfer layer (Y) 13 is formed thereon in the same manner as the transfer layer (X) 12 described above.

When the formation of transfer layer (X) and formation of transfer layer (Y) are conducted in an apparatus wherein an electrophotographic process is carried out and the light-sensitive element 11 is repeatedly employed, the transfer layer (X) and transfer layer (Y) which may have the same composition or different compositions from each other are provided by appropriately moving the same device for forming transfer layer. When transfer layers having different compositions are provided, two devices for forming transfer layer may be utilized. In such a case, the same process for forming transfer layer or a combination of different processes for forming transfer layer may be used. Specifically, the device(s) are appropriately designed so as to be positioned at the formation of transfer layer in place of other process unit in an apparatus for electrophotographic process.

Preferred embodiments of the present invention include the following.

(1) A method of forming a color image comprising forming at least one color toner image on a first peelable transfer layer provided on the surface of an electrophotographic light-sensitive element whose surface has releasability by an electrophotographic process, forming a second transfer layer on the toner image and transferring the toner image together with the first transfer layer and the second transfer layer onto a receiving material.

(2) The method of forming a color image as described in (1) above, wherein the surface of electrophotographic light-sensitive element has an adhesive strength measured according to JIS Z 0237-1980 "Testing methods of pressure sensitive adhesive tapes and sheets" of not more than 150 gram·force.

(3) The method of forming a color image as described in (1) or (2) above, wherein the first transfer layer and the second transfer layer mainly contain a thermoplastic resin having a glass transition point of not more than 140° C. or a softening point of not more than 180° C.

(4) The method of forming a color image as described in (3) above, wherein the first transfer layer mainly contains a thermoplastic resin (AH) having a glass transition point of from 10° C. to 140° C. or a softening point of from 35° C. to 180° C. and the second transfer layer mainly contains a thermoplastic resin (AL) having a glass transition point of not more than 45° C. or a softening point of not more than 60° C. in which a difference in the glass transition point or softening point between the thermoplastic resin (AH) and the thermoplastic resin (AL) is at least 2° C.

(5) The method of forming a color image as described in (1) above, wherein the transfer layer is formed by at least one of a hot-melt coating method, an electrodeposition coating method and a transfer method.

(6) The method of forming a color image as described in (1) above, wherein the transfer layer is formed by electrodepositing or electrostatically adhering grains mainly contain a thermoplastic resin grain (ARW) having a glass transition point of not more than 140° C. or a softening point of not more than 180° C. and containing at least one thermoplastic resin having a glass transition point of from 10° C. to 140° C. or a softening point of from 35° C. to 180° C. and at least one thermoplastic resin having a glass transition point of not more than 45° C. or a softening point of not more than 60° C.

(7) The method of forming a color image as described in (1) above, wherein the electrophotographic light-sensitive element contains a polymer having a polymer component containing at least one of a silicon atom and a fluorine atom in its surface region adjacent to the first transfer layer.

(8) The method of forming a color image as described in (1) above, wherein the electrophotographic light-sensitive element is caused by adsorption or adherence of a compound (S) containing at least a fluorine atom and/or a silicon atom onto its surface.

(9) The method of forming a color image as described in (1) above, wherein the first transfer layer is formed by means of electrodeposition or adhesion of resin grains (AR) by electrophoresis on the surface of electrophotographic light-sensitive element to form a film using a dispersion-for electrodeposition comprising resin grains (AR) having a glass transition point of not more than 140° C. or a softening point of not more than 180° C. dispersed in an electrically insulating organic solvent having a dielectric constant of not more than 3.5 and at least one compound (S) which has a fluorine atom and/or a silicon atom and is soluble at least 0.01 g per 1.0 liter of the organic solvent.

(10) The method of forming a color image as described in (9) above, wherein the resin grains (AR) are supplied between the electrophotographic light-sensitive element and an electrode placed in face of the light-sensitive element and migrated by electrophoresis according to a potential gradient applied from an external power source to adhere to or electrodeposit on the electrophotographic light-sensitive element, to thereby form a film.

(11) The method of forming a color image as described in (1) above, wherein the receiving material has a thermoplastic resin layer on its side to come into contact with the transfer layer.

(12) A method of forming a color image comprising performing the following steps (i) to (iv) in the same apparatus:

(i) a step of forming a first peelable transfer layer on an electrophotographic light-sensitive element, (ii) a step of forming at least one color toner image on the first transfer layer by an electrophotographic process, (iii) a step of forming a second peelable transfer layer on the toner image, and (iv) a step of transferring the toner image together with the first transfer layer and the second transfer layer onto a receiving material.

(13) The method of forming a color image as described in (12) above, wherein the following step (a) is performed before the step (i) in the same apparatus.

(a) a step of causing a compound (S) containing at least one of a fluorine atom and a silicon atom to adsorb or adhere onto the surface of electrophotographic light-sensitive element.

(14) An apparatus for forming a color image comprising a means for forming a first peelable transfer layer on the surface of an electrophotographic light-sensitive element, a means for forming at least one color toner image on the transfer layer by an electrophotographic process, a means for forming a second peelable transfer layer on the toner image formed on the first transfer layer and a means for transferring the toner image together with the first transfer layer and the second transfer layer onto a receiving material.

(15) The apparatus for forming a color image as described in (14) above, which further comprises a means for causing a compound (S) containing at least one of a fluorine atom and a silicon atom to adsorb or adhere onto the surface of electrophotographic light-sensitive element.

Figure 1:
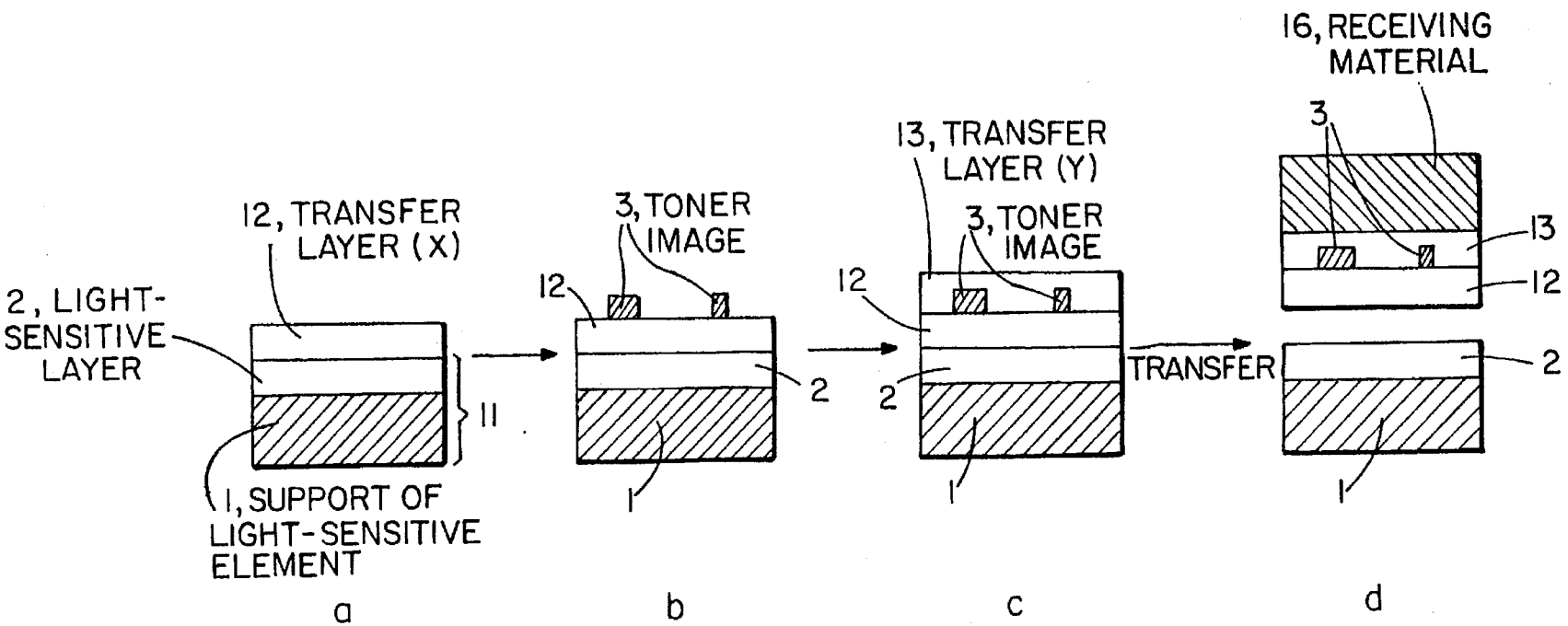
FIG. 1 is a schematic view for explanation of the method according to the present invention.
Figure 2:
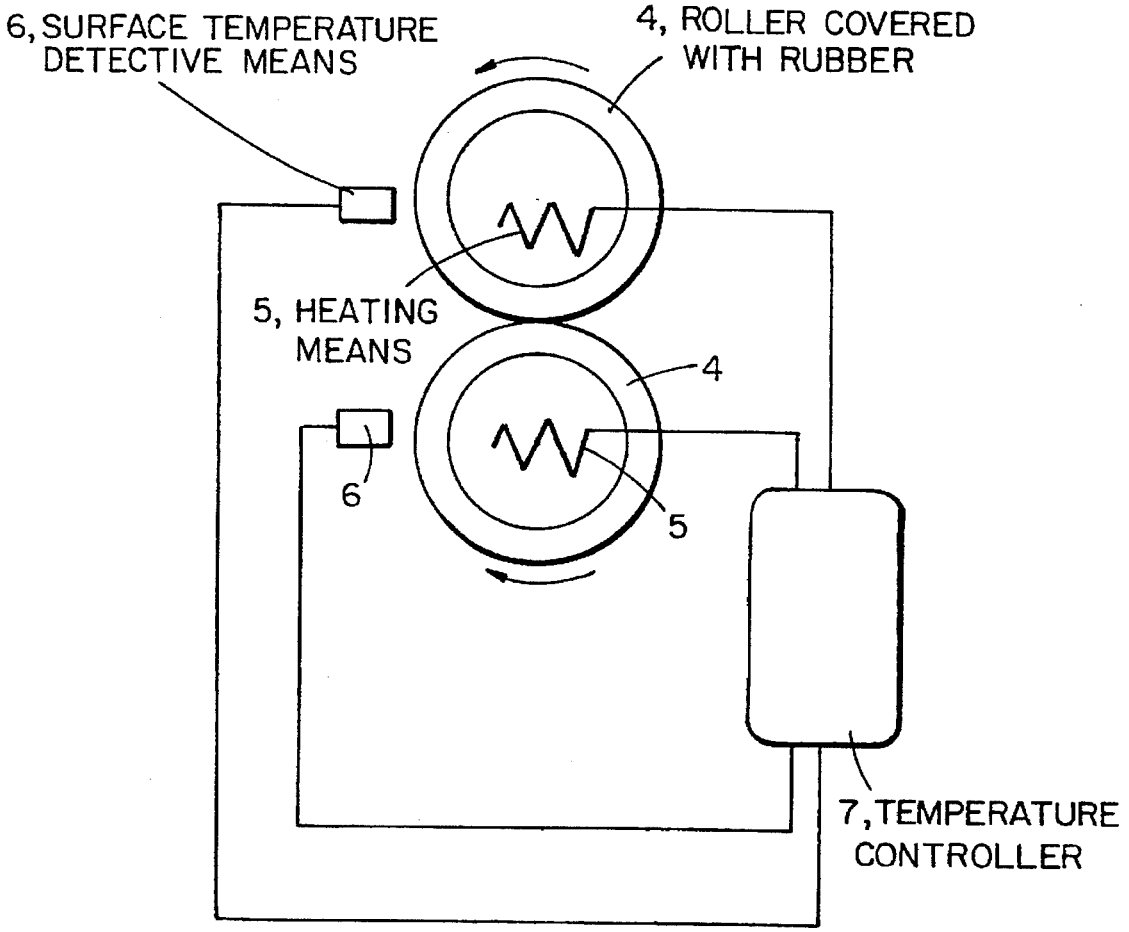
FIG. 2 is a schematic view of a device for heat-transfer of transfer layer to a receiving material.

Explanation of the Symbols:

1 Support of light-sensitive element
2 Light-sensitive layer
3 Toner image
4 Roller covered with rubber
5 Heating means
6 Surface temperature detective means
7 Temperature controller
10 Release paper
11 Light-sensitive element
12 Transfer layer (X)
13 Transfer layer (Y)
14 Liquid developing unit set
14T Electrodeposition unit
**14*y*** Yellow liquid developing unit
**14*m*** Magenta liquid developing unit
**14*c*** Cyan liquid developing unit
**14*b*** Black liquid developing unit
15 Suction/exhaust unit
**15*a*** Suction part
**15*b*** Exhaust part
16 Receiving material
17 Heat transfer means
**17*a*** Pre-heating means
**17*b*** Heating roller
**17*c*** Cooling roller
18 Corona charger
19 Exposure device
20 Hot-melt coater
**20*a*** Stand-by position of hot-melt coater
30 Applying unit for compound (S)
117 Heat transfer means
**117*b*** Heating roller
**117*c*** Cooling roller
120 Transfer roll
121 Metering roll
122 Compound (S)

BEST MODE FOR CONDUCTING THE INVENTION

The present invention is illustrated in greater detail with reference to the following examples, but the present invention is not to be construed as being limited thereto.

Synthesis Examples of Resin Grain (ARH) for Transfer Layer:

SYNTHESIS EXAMPLE 1 OF RESIN GRAIN (ARH): (ARH-1)

A mixed solution of 10 g of Dispersion Stabilizing Resin (Q-1) having the structure shown below, 100 g of vinyl acetate, and 384 g of Isopar H was heated to a temperature of 70° C. under nitrogen gas stream while stirring. To the solution was added 0.8 g of 2,2'-azo-bis(isovaleronitrile) (abbreviated as AIVN) as a polymerization initiator, followed by reacting for 3 hours. Twenty minutes after the addition of the polymerization initiator, the reaction mixture became white turbid, and the reaction temperature rose to 88° C. Then, 0.5 g of the above-described initiator was added to the reaction mixture, the reaction were carried out for 2 hours. The temperature was raised to 100° C. and stirred for 2 hours to remove the unreacted vinyl acetate by distillation. After cooling, the reaction mixture was passed through a nylon cloth of 200 mesh to obtain a white dispersion which was a latex of good monodispersity with a polymerization ratio of 90% and an average grain diameter of 0.23 μm. The grain diameter was measured by CAPA-500 manufactured by Horiba Ltd.

A part of the white dispersion was centrifuged at a rotation of $1\times10^4$ r.p.m. for 60 minutes and the resin grains precipitated were collected and dried. A weight average molecular weight (Mw) and a glass transition point (Tg) of the resin grain were measured (Mw and Tg of resin grain being measured in the same manner hereinafter).

Mw: $2\times10^5$ (measured by a GPC method and calculated in terms of polystyrene)

Tg: 38° C.

Dispersion Stabilizing Resin (Q-1)

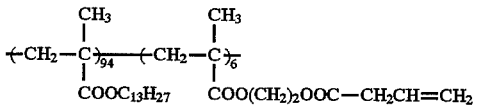

Mw: $4\times10^4$ (weight ratio)

SYNTHESIS EXAMPLE 2 OF RESIN GRAIN (ARH): (ARH-2)

A mixed solution of 15 g of Dispersion Stabilizing Resin (Q-2) having the structure shown below, 65 g of benzyl methacrylate, 35 g of methyl acrylate, 1.3 g of methyl 3-mercaptopropionate and 552 g of isopar H was heated to a temperature of 50° C. under nitrogen gas stream while stirring. To the solution was added 1 g of 2,2'-azobis(2-cyclopropylpropionitrile) (abbreviated as ACPP) as a polymerization initiator, followed by reacting for 2 hours. To the reaction mixture was added 0.8 g of ACPP, followed by reacting for 2 hours. Further, 0.8 g of AIVN was added thereto and the reaction temperature was adjusted to 75° C., and the reaction was continued for 3 hours. Then, the temperature was raised to 90° C., and the untreated monomers were distilled off under a reduced pressure of 20 to 30 mm Hg. After cooling the reaction mixture was passed through a nylon cloth of 200 mesh to obtain a white dispersion which was a latex of good monodispersity with a polymerization ratio of 98% and an average grain diameter of 0.20 μm. An Mw of the resin grain was $2.8\times10^4$ and a Tg thereof was 48° C.

Dispersion Stabilizing Resin (Q-2)

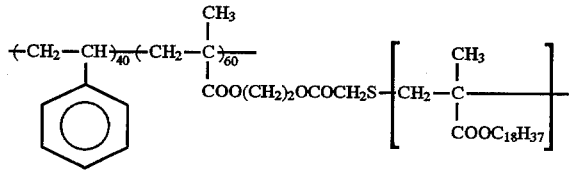

Mw: $5\times10^4$

SYNTHESIS EXAMPLE 3 OF RESIN GRAIN (ARH): (ARH-3)

A mixed solution of 14 g of Dispersion Stabilizing Resin (Q-3) having the structure shown below and 382 g of isopar G was heated to a temperature of 50° C. under nitrogen gas stream while stirring. To the solution was added dropwise a mixture of 75 g of benzyl methacrylate, 25 g of 2-ethylhexyl methacrylate and 0.8 g of ACPP over a period of one hour, followed by reacting for one hour. To the reaction mixture was further added 0.8 g of ACPP, followed by reacting for 2 hours. Then, 0.8 g of AIVN was added thereto and the temperature was adjusted to 80° C., and the reaction was continued for 2 hours. To the reaction mixture was further added 0.5 g of AIVN, followed by reacting for 2 hours. Then, the temperature was raised to 100° C., and the unreacted monomers were distilled off under a reduced pressure of 10 to 20 mm Hg. After cooling, the reaction mixture was passed through a nylon cloth of 200 mesh to obtain a white dispersion which was a latex of good monodispersity with a polymerization ratio of 90% and an average grain diameter of 0.17 μm. An Mw of the resin grain was $1\times10^5$ and a Tg thereof was 45° C.

Dispersion Stabilizing Resin (Q-3)

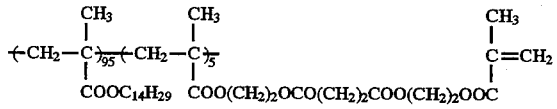

Mw: $5\times10^4$

SYNTHESIS EXAMPLE 4 OF RESIN GRAIN (ARH): (ARH-4)

A mixed solution of 14 g of Dispersion Stabilizing Resin (Q-4) having the structure shown below, 10 g of a monofunctional macromonomer of dimethylsiloxane (Macromonomer (M-1)) (Placcel FM-0725 manufactured of Chisso Corp.; a weight average molecular weight (Mw): $1\times10^4$) and 553 g of Isopar H was heated to a temperature of 50° C. under nitrogen gas stream while stirring. To the solution was added dropwise a mixture of 70 g of methyl methacrylate, 20 g of ethyl acrylate, 2.6 g of methyl 3-mercaptopropionate and 1.0 g of ACPP over a period of 30 minutes, followed by reacting for 1.5 hours. To the reaction mixture was further added 0.8 g of ACPP, followed by reacting for 2 hours. Then, 0.8 g of AIVN was added thereto and the temperature was adjusted to 80° C., and the reaction was continued for 2 hours. To the reaction mixture was further added 0.5 g of ACPP, followed by reacting for 2 hours. After cooling, the reaction mixture was passed through a nylon cloth of 200 mesh to obtain a white dispersion which was a latex of good monodispersity with a polymerization ratio of 99% and an average grain diameter of 0.15 μm. An Mw of the resin grain was $9\times10^3$ and a Tg thereof was 40° C.

Dispersion Stabilizing Resin (Q-4)

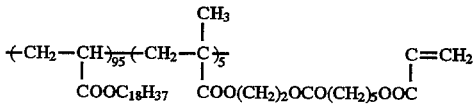

Mw: $4.5\times10^4$

SYNTHESIS EXAMPLES 5 TO 8 OF RESIN GRAIN (ARH): (ARH-5) TO (ARH-8)

Each of the resin grains (ARH-5) to (ARH-8) was synthesized in the same manner as in Synthesis Examples 4 of Resin Grain (ARH) except for using each of the macromonomers (Mw thereof being in a range of from $8\times10^3$ to $1\times10^4$) shown in Table 2 below in place of 10 g of Macromonomer (M-1) employed in Synthesis Example 4 of Resin Grain (ARH). A polymerization ratio of each of the resin grains was in a range of from 98 to 99% and an average grain diameter thereof was in a range of from 0.15 to 0.25 μm with good monodispersity of a narrow size distribution. An Mw of each of the resin grains was in a range of from $2.5\times10^4$ to $4\times10^4$ and a Tg thereof was in a range of from 40° C. to 70° C.

TABLE 2

| Synthesis Example of Resin Grain (ARH) | Resin Grain (ARH) | Macromonomer |
|---|---|---|
| 5 | ARH-5 | 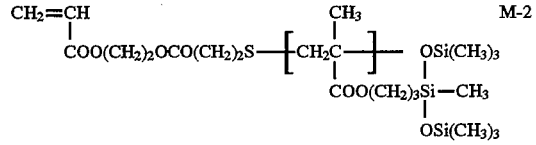 M-2 |
| 6 | ARH-6 | 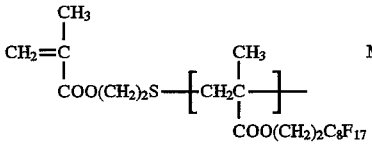 M-3 |
| 7 | ARH-7 | 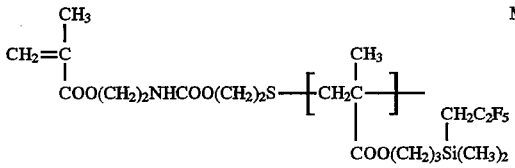 M-4 |
| 8 | ARH-8 | 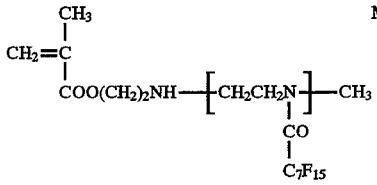 M-5 |

SYNTHESIS EXAMPLE 9 OF RESIN GRAIN (ARH): (ARH-9)

A mixture of 5 g of coarse powder of a styrene-butadiene copolymer (48/52 ratio by weight) (Sorprene 303 manufactured by Asahi Kasei Kogyo Kabushiki Kaisha) having a softening point of 45° C. pulverized by a trio-blender, 4 g of a dispersion stabilizing resin (Sorprene 1205 manufactured by Asahi Kasei Kogyo Kabushiki Kaisha) and 51 g of Isopar H was dispersed in a paint shaker (manufactured by Toyo Seiki Seisakusho Co.) with glass beads having a diameter of about 4 mm for 20 minutes. The resulting pre-dispersion was subjected to a wet type dispersion process using Dyno-mill KDL (manufactured by Sinmaru Enterprises Co., Ltd.) with glass beads having a diameter of from 0.75 to 1 mm at a rotation of 4500 r.p.m. for 6 hours, and then passed through a nylon cloth of 200 mesh to obtain a white dispersion which was a latex having an average grain diameter of 0.4 μm.

SYNTHESIS EXAMPLES 1 TO 16 OF RESIN GRAIN (ARL): (ARL-1) TO (ARL-16)

Each of the resin grains (ARL) was synthesized in the same manner as in Synthesis Example 3 of Resin Grain (ARH) except for using each of the monomers shown in Table 3 below in place of 75 g of benzyl methacrylate and 25 g of 2-ethylhexyl methacrylate employed in Synthesis Example 3 of Resin Grain (ARH). A polymerization ratio of each of the white dispersions obtained was in a range of from 90 to 99% and an average grain diameter thereof was in a range of from 0.13 to 0.20 μm with good monodispersity. A Tg of each of the resin grains was in a range of from 10° C. to 50° C.

TABLE 3

| Synthesis Example of Resin Grain (ARL) | Resin Grain (ARL) | Monomer | |
|---|---|---|---|
| 1 | ARL-1 | Vinyl acetate | 80 g |
| | | Vinyl propionate | 20 g |
| 2 | ARL-2 | Vinyl acetate | 85 g |
| | | Vinyl butyrate | 15 g |
| 3 | ARL-3 | Vinyl acetate | 90 g |
| | | Vinyl laurate | 10 g |
| 4 | ARL-4 | Phenethyl methacrylate | 70 g |
| | | Methyl acrylate | 30 g |
| | | 3-Phenylpropyl methacrylate | 75 g |
| 5 | ARL-5 | Ethyl acrylate | 25 g |
| 6 | ARL-6 | Methyl methacrylate | 65 g |
| | | 2-Butoxyethyl methacrylate | 35 g |
| 7 | ARL-7 | Benzyl methacrylate | 60 g |
| | | 2,3-Dipropoxypropyl methacrylate | 40 g |
| 8 | ARL-8 | Vinyl acetate | 95 g |
| | | N-Vinylpyrrolidone | 5 g |
| 9 | ARL-9 | Benzyl methacrylate | 75 g |
| | | Ethylene glycol monomethylether monomethacrylate | 25 g |
| 10 | ARL-10 | 2-Phenyl-2-methylethyl methacrylate | 75 g |
| | | Methyl acrylate | 25 g |
| 11 | ARL-11 | Methyl methacrylate | 60 g |
| | | Methyl acrylate | 40 g |
| 12 | ARL-12 | Styrene | 70 g |
| | | Vinyl toluene | 30 g |
| 13 | ARL-13 | Methyl methacrylate | 65 g |
| | | Octadeyl methacrylate | 35 g |
| 14 | ARL-14 | Methyl methacrylate | 65 g |
| | | Ethyl methacrylate | 30 g |
| | | Macromonomer FMO-725 | 5 g |

TABLE 3-continued

| Synthesis Example of Resin Grain (ARL) | Resin Grain (ARL) | Monomer | |
|---|---|---|---|
| 15 | ARL-15 | Vinyl acetate | 97 g |
| | | Crotonic acid | 3 g |
| 16 | ARL-16 | Methyl methacrylate | 60 g |
| | | Ethyl acrylate | 35 g |
| | | N-Methylacrylamide | 5 g |

SYNTHESIS EXAMPLE 1 OF RESIN GRAIN (AR): (AR-1)

A mixed solution of 20 g of Dispersion Stabilizing Resin (Q-1) having the structure described above, 40 g of methyl methacrylate, 60 g of methyl acrylate, 1.3 g of methyl 3-mercaptopropionte and 542 g of Isopar H was heated to a temperature of 60° C. under nitrogen gas stream while stirring. To the solution was added 0.8 g of 2,2'-azobis (isovaleronitrile) (abbreviated as AIVN) as a polymerization initiator, followed by reacting for 2 hours. Twenty minutes after the addition of the polymerization initiator, the reaction mixture became white turbid, and the reaction temperature rose to 88° C. Then, 0.5 g of the above-described initiator was added to the reaction mixture, the reaction were carried out for 2 hours, and 0.3 g of the initiator was further added thereto, followed by reacting for 3 hours. After cooling, the reaction mixture was passed through a nylon cloth of 200 mesh to obtain a white dispersion which was a latex of good monodispersity with a polymerization ratio of 99% and an average grain diameter of 0.18 μm. The grain diameter was measured by CAPA-500 manufactured by Horiba Ltd.

A mixed solution of the whole amount of the above-described resin grain dispersion (as seed) and 10 g of Dispersion Stabilizing Resin (Q-1) was heated to a temperature of 60° C. under nitrogen gas stream with stirring. To the mixture was added dropwise a mixture of 85 g of benzyl methacrylate, 15 g of methyl acrylate, 1.0 g of methyl 3-mercaptopropionate, 0.8 g of AIVN and 200 g of Isopar H over a period of 2 hours, followed by further reacting for 2 hours. Then 0.8 g of AIVN was added to the reaction mixture, the temperature thereof was raised to 70° C., and the reaction was conducted for 2 hours. Further, 0.6 g of AIVN was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.25 μm.

In order to investigate that the resin grain thus-obtained was composed of the two kind of resins, the state of resin grain was observed using a scanning electron microscope (SEM).

Specifically, the dispersion of Resin Grain (AR-1) was applied to a polyethylene terephthalate film so that the resin grains were present in a dispersive state on the film, followed by heating at a temperature of 45° C. or 70° C. for 5 minutes to prepare a sample. Each sample was observed using a scanning electron microscope (JSL-T330 Type manufactured by JEOL Co., Ltd.) of 20,000 magnifications. As a result, the resin grains were observed with the sample heated at 45° C. On the contrary, with the sample heated at 70° C. the resin grains had been melted by heating and were not observed.

The state of resin grain was observed in the same manner as described above with respect to resin grains formed from respective two kind of resins (copolymers) constituting Resin Grain (AR-1), i.e., Comparative Resin Grains (1) and (2) described below and a mixture of Comparative Resin Grains (1) and (2) in a weight ratio of 1:1. As a result, it was found that with Comparative Resin Grain (1), the resin grains were not observed in the sample heated at 45° C., although the resin grains were observed in the sample before heating. On the other hand, with Comparative Resin Grain (2), the resin grains were not observed in the sample heated at 70° C. Further, with the mixture of two kind of resin grains, disappearance of the resin grains was observed in the sample heated at 45° C. in comparison with the sample before heating.

From these results it was confirmed that Resin Grain (AR-1) described above was not a mixture of two kind of resin grains but contained two kind of resins therein, and had a core/shell structure wherein the resin having a relatively high Tg formed shell portion and the resin having a relatively low Tg formed core portion.

The structure of resin grains (AR) is not particularly limited and includes a core/shell structure composed of the resin (AH) having a relatively high Tg and the resin (AL) having a relatively low Tg as described above, a core/shell structure composed of a combination of an inverse order of the resins or a structure composed of a mixture of the resins without localization.

Preparation of Comparative Resin Grain (1)

A mixed solution of 10 g of Dispersion Stabilizing Resin (Q-1), 20 g of methyl methacrylate, 30 g of methyl acrylate, 0.65 g of methyl 3-mercaptopriopionate and 329 g of Isopar H was heated to a temperature of 60° C. under nitrogen gas stream while stirring. To the solution was added 0.4 g of AIVN as a polymerization initiator, followed by reacting for 2 hours. Twenty minutes after the addition of the polymerization initiator, the reaction mixture became white turbid, and the reaction temperature rose to 88° C. Then, 0.2 g of AIVN was added to the reaction mixture, the reaction were carried out for 2 hours, and 0.3 g of AIVN was added thereto, followed by reacting for 3 hours. After cooling, the reaction mixture was passed through a nylon cloth of 200 mesh to obtain a white dispersion which was a latex of good monodispersity with a polymerization ratio of 99% and an average grain diameter of 0.25 μm. A Tg of the resin grain thus-obtained was 38° C.

Preparation of Comparative Resin Grain (2)

The same procedure as in Preparation of Comparative Resin Grain (1) described above was repeated except for using a mixed solution of 10 g of Dispersion Stabilizing Resin (Q-1) described above, 42.5 g of benzyl methacrylate, 7.5 g of methyl acrylate, 0.5 g of methyl 3-mercaptopropionate and 326 g of Isopar H. The white dispersion thus-obtained was a latex of good monodispersity with a polymerization ratio of 98% and an average grain diameter of 0.24 μm. A Tg of the resin grain was 65° C.

SYNTHESIS EXAMPLE 2 OF RESIN GRAIN (AR): (AR-2)

(1) Synthesis of Dispersion Stabilizing Resin (Q-5)

A mixed solution of 99.5 g of dodecyl methacrylate, 0.5 g of divinylbenzene and 200 g of toluene was heated to a temperature of 80° C. under nitrogen gas stream while stirring. To the solution was added 2 g of 2,2'-azobis (isobutyronitrile) (abbreviated as AIBN), followed by reacting for 3 hours, then further was added 0.5 g of AIBN, the reaction was carried out for 4 hours. The solid content of the resulting copolymer was 33.3% by weight, and an Mw thereof was $4\times10^4$.

(2) Synthesis of Resin Grain

A mixed solution of 18 g (solid basis) of Dispersion Stabilizing Resin (Q-5) described above, 80 g of vinyl acetate, 20 g of vinyl propionate and 382 g of Isopar H was heated to a temperature of 80° C. under nitrogen gas stream while stirring. To the solution was added 1.6 g of AIVN, followed by reacting for 1.5 hours, then was added 0.8 g of AIVN, followed by reacting for 2 hours. Further, 0.5 g of AIVN was added to the reaction mixture, the reaction were carried out for 3 hours. The temperature was raised to 100° C. and stirred for 2 hours to remove the unreacted monomers by distillation. After cooling, the reaction mixture was passed through a nylon cloth of 200 mesh to obtain a white dispersion which was a latex of good monodispersity with a polymerization ratio of 87% and an average grain diameter of 0.17 μm.

A mixture of the whole amount of the above-described resin grain dispersion (as seed) and 20 g of Dispersion Stabilizing Resin (Q-5) was heated to a temperature of 60° C. under nitrogen gas stream with stirring. To the mixture was added dropwise a mixture of 65 g of methyl methacrylate, 35 g of butyl methacrylate, 2.6 g of methyl 3-mercaptopropionate, 0.8 g of AIVN and 200 g of Isopar H over a period of 2 hours, followed by reacting for one hour. Then 0.8 g of AIVN was added to the reaction mixture, the temperature thereof was raised to 75° C., and the reaction was conducted for 2 hours. Further, 0.6 g of AIVN was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.23 μm.

SYNTHESIS EXAMPLE 3 OF RESIN GRAIN (AR): (AR-3)

A mixed solution of 25 g of Dispersion Stabilizing Resin (Q-3) having the structure described above and 546 g of Isopar H was heated to a temperature of 60° C. under nitrogen gas stream while stirring. To the solution was added dropwise a mixture of 65 g of benzyl methacrylate, 35 g of ethyl methacrylate, 1.8 g of 2-mercaptoethanol, 1.0 of AIVN and 200 g of Isopar H over a period of one hour, followed by further reacting for one hour. To the mixture was added 0.8 g of AIVN, followed by reacting for 2 hours, then 0.5 g of AIVN was added to the reaction mixture, the temperature thereof was raised to 80° C., and the reaction was conducted for 2 hours. Further, 0.5 g of AIBN was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.17 μm.

A mixture of the whole amount of the above-described resin grain dispersion (as seed) and 15 g of Dispersion Stabilizing Resin (Q-3) was heated to a temperature of 60° C. under nitrogen gas stream with stirring. To the mixture was added dropwise a mixture of 80 g of methyl methacrylate, 20 g of hexyl methacrylate, 2 g of 3-mercaptopropionic acid, 0.8 g of AIVN and 564 g of Isopar H over a period of 2 hours, followed by further reacting for 2 hours. Then 0.8 g of AIBN as a polymerization initiator was added to the reaction mixture, the temperature thereof was raised to 80° C., and the reaction was conducted for 2 hours. Further, 0.6 g of AIBN was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.24 μm.

SYNTHESIS EXAMPLE 4 OF RESIN GRAIN (AR): (AR-4)

A mixed solution of 15 g of Dispersion Stabilizing Resin (Q-4), 60 g of methyl methacrylate, 40 g of 2,3-dipropionyloxypropy methacrylate, 2.0 g of methyl 3-mercaptopropionate and 549 g of Isopar H was heated to a temperature of 60° C. under nitrogen gas stream while stirring. To the solution was added 0.8 g of AIVN as a polymerization initiator, followed by reacting for 2 hours. Twenty minutes after the addition of the polymerization initiator, the reaction mixture became white turbid, and the reaction temperature rose to 88° C. Then, 0.5 g of AIVN was added to the reaction mixture, the reaction were carried out for 2 hours, and 0.3 g of AIVN was further added thereto, followed by reacting for 3 hours. After cooling, the reaction mixture was passed through a nylon cloth of 200 mesh to obtain a white dispersion which was a latex of good monodispersity with a polymerization ratio of 98% and an average grain diameter of 0.18 μm.

A mixture of 260 g of the above-described resin grain dispersion (as seed), 14 g of Dispersion Stabilizing Resin (Q-1), 10 g of Macromonomer (M-1) having the structure shown below and 553 g of Isopar H was heated to a temperature of 55° C. under nitrogen gas stream while stirring. To the solution was added dropwise a mixture of 60 g of benzyl methacrylate, 30 g of 3-phenyl methacrylate, 2 g of methyl 3-mercatoporopionate, 1.0 g of 2,2'-azobis(2-cyclopropylpropionitrile) (abbreviated as ACPP) and 200 g of Isopar H over a period of one hour, followed by reacting for one hour with stirring. To the reaction mixture was added 0.8 g of ACPP, followed by reacting for 2 hours. Further, 0.5 g of AIVN was added thereto and the reaction temperature was adjusted to 80° C., and the reaction was continued for 3 hours. After cooling the reaction mixture was passed through a nylon cloth of 200 mesh to obtain a white dispersion which was a latex of good monodispersity with a polymerization ratio of 97% and an average grain diameter of 0.24 μm.

Macromonomer (M-1)

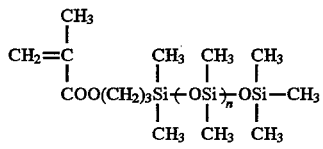

Mw $1\times10^4$

SYNTHESIS EXAMPLES 5 TO 10 OF RESIN GRAIN (AR): (AR-5) TO (AR-10)

Each latex dispersion was prepared according to a wet type dispersion process in the same manner as in Synthesis Example 9 of Resin Grain (ARH) except for using each of the compounds shown in Table 4 below in place of Sorprene 303 as the resin (R) employed in Synthesis Example 9 of Resin Grain (AR). An average grain diameter of each of the dispersion obtained was in a range of from 0.35 to 0.5 μm.

TABLE 4

| Synthesis Example of Resin Grain (AR) | Resin Grain (AR) | Resin (A) |
|---|---|---|
| 5 | AR-5 | Ethylene/methacrylic acid copolymer (96.4:3.6 by molar ratio) (Nimacrel N-699 manufactured by DuPont-Mitsui Polychemicals Co., Ltd.) |
| 6 | AR-6 | Ethylene/vinyl acetate copolymer (Evaflex 420 manufactured by DuPont-Mitsui Polychemicals Co., Ltd.) |
| 7 | AR-7 | Ethylene/ethyl acrylate copolymer (Evalfex-EEA, A-703 manufactured by DuPont-Mitsui Polychemicals Co., Ltd.) |
| 8 | AR-8 | Vinyl chloride/vinyl acetate copolymer (UCAR-VYHH manufactured by Union Carbide Co., Ltd.) |
| 9 | AR-9 | Cellulose acetate butyrate (Cellidor Bsp. manufactured by Bayer AG) |
| 10 | AR-10 | Polyvinyl butyral resin (S-Lec manufactured by Sekisui Chemical Co., Ltd.) |

Synthesis Examples of Resin (P):

SYNTHESIS EXAMPLE 1 OF RESIN (P): (P-1)

A mixed solution of 80 g of methyl methacrylate, 20 g of a dimethylsiloxane macromonomer (Macromonomer (M-1)) (Placcel FM-0725 manufactured by Chisso Corp.; Mw: $1\times10^4$), and 200 g of toluene was heated to a temperature of 75° C. under nitrogen gas stream. To the solution was added 1.0 g of AIBN, followed by reacting for 4 hours. To the mixture was further added 0.7 g of AIBN, and the reaction was continued for 4 hours. An Mw of the copolymer thus-obtained was $5.8\times10^4$ (as measured by a GPC method).

Resin (P-1)

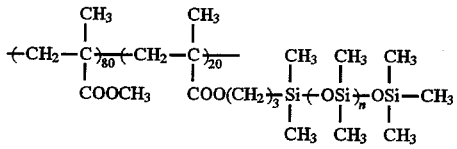

SYNTHESIS EXAMPLES 2 TO 9 OF RESIN (P): (P-2) TO (P-9)

Each of copolymers was synthesized in the same manner as in Synthesis Example 1 of Resin (P), except for replacing methyl methacrylate and Macromonomer (M-1) (Placcel FM-0725) used in Synthesis Example 1 of Resin (P) with each monomer corresponding to the polymer component shown in Table 5 below. An Mw of each of the resulting polymers was in a range of from $4.5\times10^4$ to $6\times10^4$.

TABLE 5

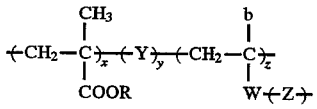

| Synthesis Example of Resin (P) | Resin (P) | −R | −Y− | −b | −W− | −Z− | x/y/z (weight ratio) |
|---|---|---|---|---|---|---|---|
| 2 | P-2 | $-C_2H_5$ | 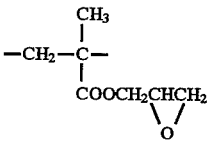 | $-CH_3$ | $-COO(CH_2)_2S-$ | 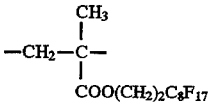 | 65/15/20 |
| 3 | P-3 | $-CH_3$ | 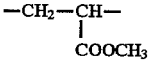 | −H | 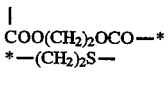 | 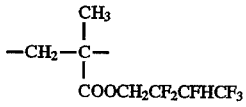 | 60/10/30 |
| 4 | P-4 | $-CH_3$ | 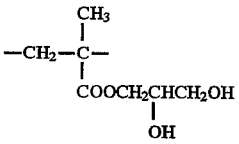 | $-CH_3$ | 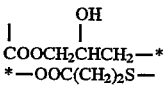 | 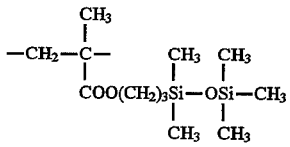 | 65/10/25 |
| 5 | P-5 | $-C_3H_7$ | 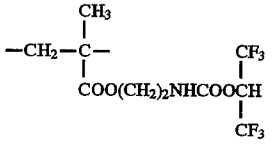 | $-CH_3$ | 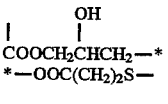 | 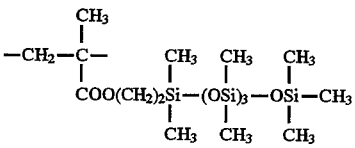 | 65/15/20 |

TABLE 5-continued

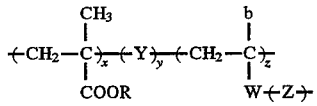

| Synthesis Example of Resin (P) | Resin (P) | −R | −Y− | −b | −W− | −Z− | x/y/z (weight ratio) |
|---|---|---|---|---|---|---|---|
| 6 | P-6 | $-CH_3$ | $-CH_2-C(CH_3)(COO(CH_2)_3Si(OC_2H_5)_3)-$ | $-CH_3$ | $-COOCH_2CHOHCH_2-*$ <br> $*-OOC(CH_2)_2S-$ | $-CH_2-C(CH_3)(COO(CH_2)_3Si(OSi(CH_3)_3)_2-O-Si(CH_3)_3)-$ | 50/20/30 |
| 7 | P-7 | $-C_2H_5$ | 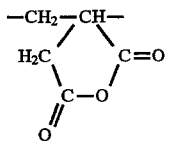 | $-H$ | $-CONH(CH_2)_2S-$ | $-CH_2-C(CH_3)(COOCH(CF_3)_2)-$ | 57/8/35 |
| 8 | P-8 | $-CH_3$ | $-CH_2-CH(CONH(CH_2)_6OH)-$ | $-H$ | $-COO(CH_2)_2OCO-*$ <br> $*-CH_2S-$ | $-CH_2-CH(CONHC_{17}F_{35})-$ | 70/15/15 |
| 9 | P-9 | $-C_2H_5$ | $-CH_2-C(CH_3)(COO(CH_2)_2NHCOCH(COCH_3)_2)-$ | $-CH_3$ | $-COO(CH_2)_2OCO-*$ <br> $*-CH_2S-$ | $-CH_2-C(CH_3)(COO(CH_2)_3SO_2NHC_{12}F_{25})-$ | 70/10/20 |

SYNTHESIS EXAMPLE 10 OF RESIN (P): (P-10)

A mixed solution of 60 g of 2,2,3,4,4,4-hexafluorobutyl methacrylate, 40 g of a methyl methacrylate macromonomer (AA-6 manufactured by Toagosei Chemical Industry Co., Ltd.; Mw: $1\times10^4$), and 200 g of benzotrifluoride was heated to a temperature of 75° C. under nitrogen gas stream. To the solution was added 1.0 g of AIBN, followed by reacting for 4 hours. To the mixture was further added 0.5 g of AIBN, and the reaction was continued for 4 hours. An Mw of the copolymer thus-obtained was $6.5\times10^4$.

SYNTHESIS EXAMPLES 11 TO 12 OF RESIN (P): (P-11) TO (P-12)

Each of copolymers was synthesized in the same manner as in Synthesis Example 10 of Resin (P), except for replacing the monomer and the macromonomer used in Synthesis Example 10 of Resin (P) with each monomer and each macromonomer both corresponding to the polymer components shown in Table 6 below. An Mw of each of the resulting copolymers was in a range of from $4.5\times10^4$ to $6.5\times10^4$.

TABLE 6

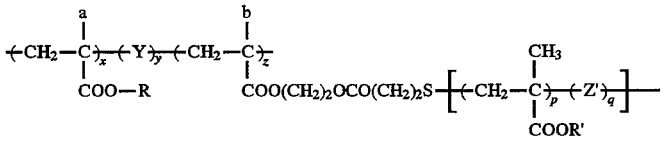

| Synthesis Example of Resin (P) | Resin (P) | −a | −R | −Y− | −b |
|---|---|---|---|---|---|
| 11 | P-11 | $-CH_3$ | $-(CH_2)_2C_nF_{2n+1}$ n = 8 ~ 1 | — | $-CH_3$ |
| 12 | P-12 | $-CH_3$ | $-(CH_2)_2CF_2CFHCF_3$ | $-CH_2-C(CH_3)(COO(CH_2)_3Si(CF_3)-C_2H_5)-$ | $-H$ |

TABLE 6-continued

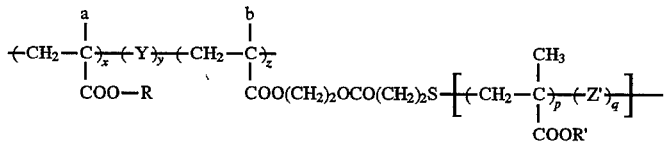

| Synthesis Example of Resin (P) | −R' | −Z'− | x/y/z (weight ratio) | p/g (weight ratio) |
|---|---|---|---|---|
| 11 | $-CH_3$ | $-CH_2-C(CH_3)(COOCH_2CH(O)CH_2)-$ | 70/0/30 | 70/30 |
| 12 | $-CH_3$ | $-CH_2-C(CH_3)(COO(CH_2)_3Si(OCH_3)_2)-CH_3$ | 30/30/40 | 70/30 |

SYNTHESIS EXAMPLE 13 OF RESIN (P): (P-13)

A mixed solution of 67 g of methyl methacrylate, 22 g of methyl acrylate, 1 g of methacrylic acid, and 200 g of toluene was heated to a temperature of 80° C. under nitrogen gas stream. To the solution was added 10 g of Polymer Azobis Initiator (PI-1) having the structure shown below, followed by reacting for 8 hours. After completion of the reaction, the reaction mixture was poured into 1.5 l of methanol, and the precipitate thus-deposited was collected and dried to obtain 75 g of a copolymer having an Mw of $3\times10^4$.

Polymer Initiator (PI-1)

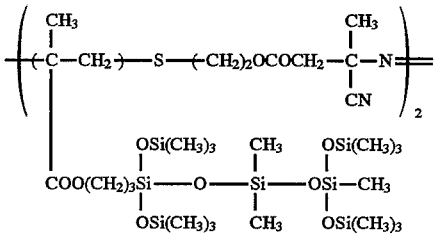

Polymer (P-13)

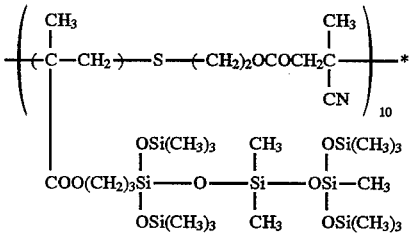

-continued

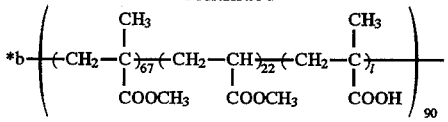

−b−: a bond between blocks

SYNTHESIS EXAMPLE 14 OF RESIN (P): (P-14)

A mixture of 50 g of ethyl methacrylate, 10 g of glycidyl methacrylate, and 4.8 g of benzyl N,N-diethyldithiocarbamate was sealed into a container under nitrogen gas stream and heated to a temperature of 50° C. The mixture was irradiated with light from a high-pressure mercury lamp of 400 W at a distance of 10 cm through a glass filter for 6 hours to conduct photopolymerization. The reaction mixture was dissolved in 100 g of tetrahydrofuran, and 40 g of Monomer (m-3) shown below was added thereto. After displacing the atmosphere with nitrogen, the mixture was again irradiated with light for 10 hours. The reaction mixture obtained was reprecipitated in 1 l of methanol, and the precipitate was collected and dried to obtain 73 g of a polymer having an Mw of $4.8\times10^4$.

Monomer (m-3)

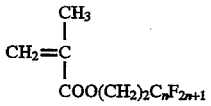

(n: an integer of from 8 to 10)

-continued

Resin (P-14)

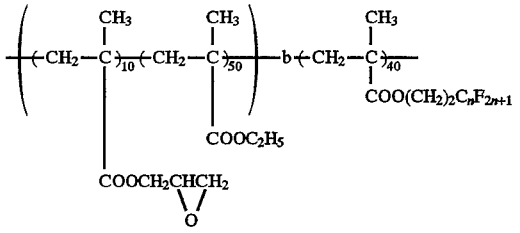

(n: an integer of from 8 to 10)

SYNTHESIS EXAMPLES 15 TO 18 OF RESIN (P): (P-15) TO (P-18)

Each of copolymers shown in Table 7 below was prepared in the same manner as in Synthesis Example 14 of Resin (P). An Mw of each of the resulting polymers was in a range of from $3.5\times10^4$ to $6\times10^4$.

TABLE 7

| Synthesis Example of Resin (P) | Resin (P) | A-B Type Block Copolymer (weight ratio) |
|---|---|---|
| 15 | P-15 | 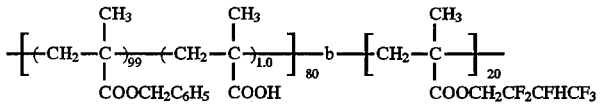 |
| 16 | P-16 | 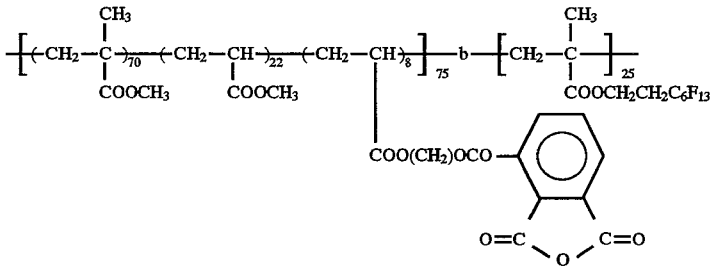 |
| 17 | P-17 | 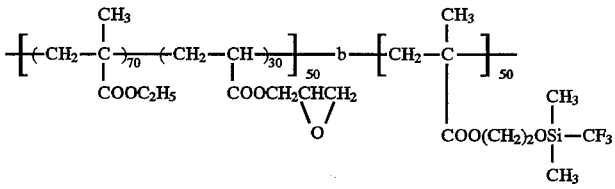 |
| 18 | P-18 | 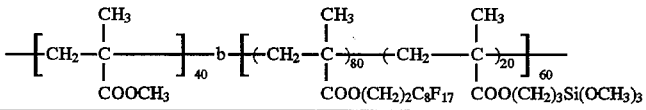 |

SYNTHESIS EXAMPLE 19 OF RESIN (P): (P-19)

A copolymer having an Mw of $4.5\times10^4$ was prepared in the same manner as in Synthesis Example 14 of Resin (P), except for replacing benzyl N,N-diethyldithiocarbamate used in Synthesis Example 14 of Resin (P) with 18 g of Initiator (I-11) having the structure shown below.

Initiator (I-11)

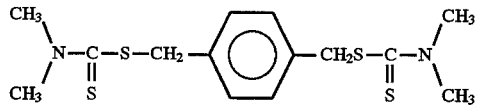

Resin (P-19)

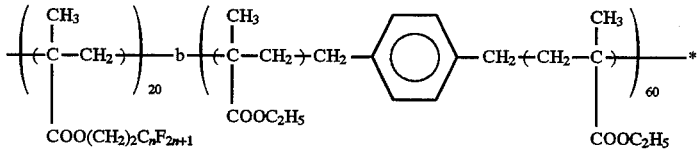

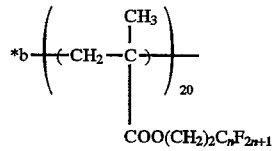

(n: an integer of from 8 to 10)

SYNTHESIS EXAMPLE 20 OF RESIN (P): (P-20)

A mixed solution of 68 g of methyl methacrylate, 22 g of methyl acrylate, 10 g of glycidyl methacrylate, 17.5 g of Initiator (I-12) having the structure shown below, and 150 g of tetrahydrofuran was heated to a temperature of 50° C. under nitrogen gas stream. The solution was irradiated with light from a high-pressure mercury lamp of 400 W at a distance of 10 cm through a glass filter for 10 hours to conduct photopolymerization. The reaction mixture obtained was reprecipitated in 1 l of methanol, and the precipitate was collected and dried to obtain 72 g of a polymer having an Mw of $4.0\times10^4$.

A mixed solution of 70 g of the resulting polymer, 30 g of Monomer (M-1), and 100 g of tetrahydrofuran was heated to a temperature of 50° C. under nitrogen gas stream and irradiated with light under the same conditions as above for 13 hours. The reaction mixture was reprecipitated in 1.5 l of methanol, and the precipitate was collected and dried to obtain 78 g of a copolymer having an Mw of $6\times10^4$.

Initiator (I-12)

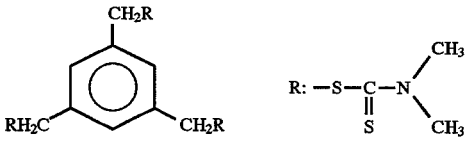

Resin (P-20)

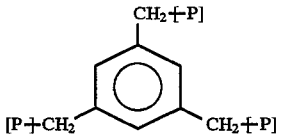

-continued

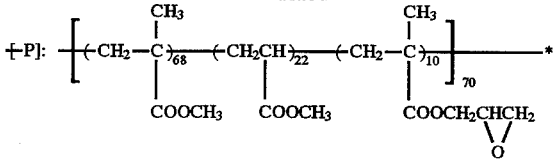

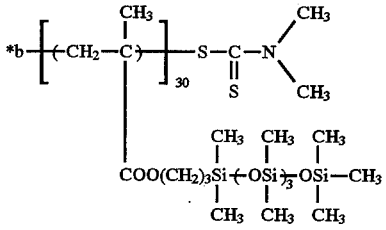

SYNTHESIS EXAMPLES 21 TO 25 OF RESIN (P): (P-21) TO (P-25)

In the same manner as in Synthesis Example 20 of Resin (P), except for replacing 17.5 g of Initiator (I-12) used in Synthesis Example 20 g of Resin (P) with 0.031 mol of each of the initiators shown in Table 8 below, each of the copolymers shown in Table 8 was obtained. A yield thereof was in a range of from 70 to 80 g and an Mw thereof was in a range of from $4\times10^4$ to $6\times10^4$.

TABLE 8
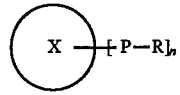
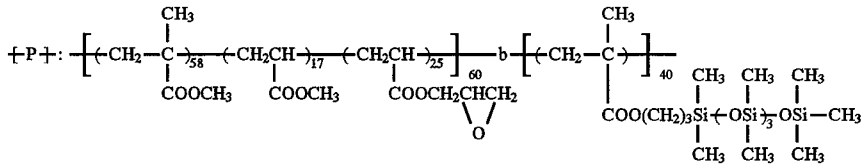
| Synthesis Example of Resin (P) | Resin (P) | Initiator (I) | −R | 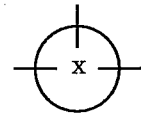 |
|---|---|---|---|---|
| 21 | P-21 | 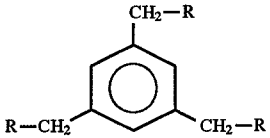 (I-13) | 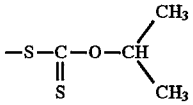 | 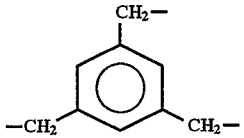 |
| 22 | P-22 | 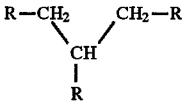 (I-14) | 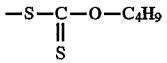 | 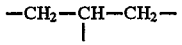 |
| 23 | P-23 | 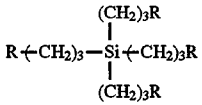 (I-15) | 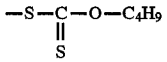 | 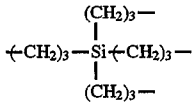 |
| 24 | P-24 | 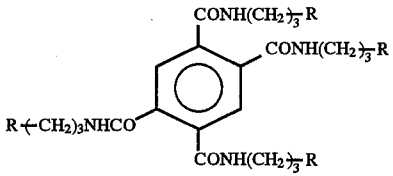 (I-16) | 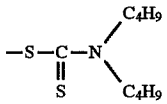 | 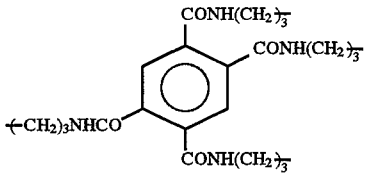 |

TABLE 8-continued
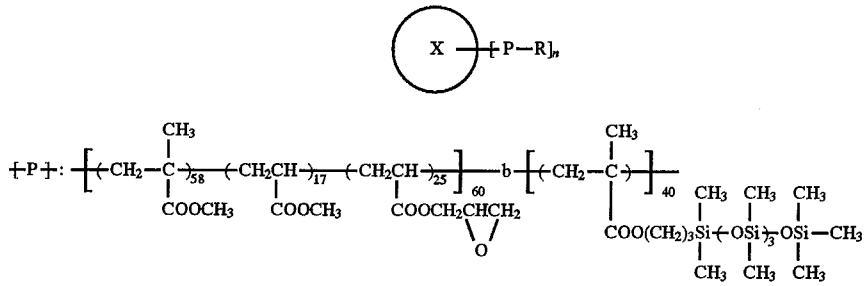
| Synthesis Example of Resin (P) | Resin (P) | Initiator (I) | −R | 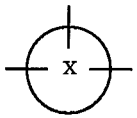 |
|---|---|---|---|---|
| 25 | P-25 | 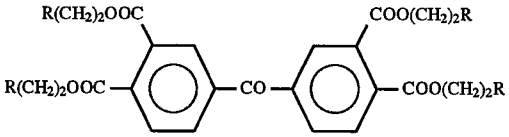 (I-17) | 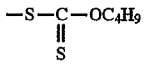 | 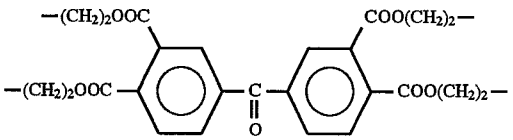 |

Synthesis Examples of Resin Grain (L):

SYNTHESIS EXAMPLE 1 OF RESIN GRAIN (L): (L-1)

A mixed solution of 40 g of Monomer (LM-1) having the structure shown below, 2 g of ethylene glycol dimethacrylate, 4.0 g of Dispersion Stabilizing Resin (LP-1) having the structure shown below, and 180 g of methyl ethyl ketone was heated to a temperature of 60° C. with stirring under nitrogen gas stream. To the solution was added 0.3 g of AIVN, followed by reacting for 3 hours. To the reaction mixture was further added 0.1 g of AIVN, and the reaction was continued for 4 hours. After cooling, the reaction mixture was passed through a nylon cloth of 200 mesh to obtain a white dispersion. The average grain diameter of the latex was 0.25 μm. The grain diameter was measured by CAPA-500 manufactured by Horiba, Ltd.

Monomer (LM-1)

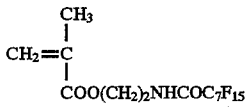

Dispersion Stabilizing Resin (LP-1)

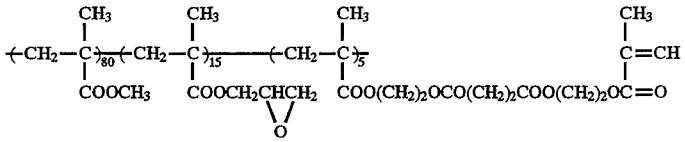

Mw: $3 \times 10^4$

SYNTHESIS EXAMPLE 2 OF RESIN GRAIN (L): (L-2)

A mixed solution of 5 g of AB-6 (a monofunctional macromonomer comprising a butyl acrylate unit, manufactured by Toagosei Chemical Industry Co., Ltd.) as a dispersion stabilizing resin and 140 g of methyl ethyl ketone was heated to a temperature of 60° C. under nitrogen gas stream while stirring. To the solution was added dropwise a mixed solution of 40 g of Monomer (LM-2) having the structure shown below, 1.5 g of ethylene glycol diacrylate, 0.2 g of AIVN, and 40 g of methyl ethyl ketone over a period of one hour. After the addition, the reaction was continued for 2 hours. To the reaction mixture was further added 0.1 g of AIVN, followed by reacting for 3 hours to obtain a white dispersion. After cooling, the dispersion was passed through a nylon cloth of 200 mesh. The average grain diameter of the dispersed resin grains was 0.35 μm.

Monomer (LM-2)

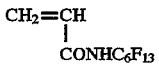

Dispersion Stabilizing Resin (LP-2)

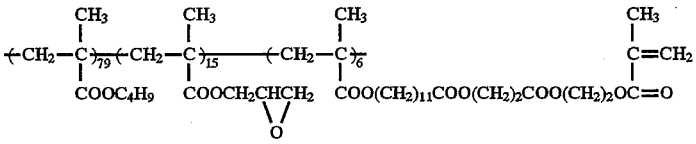

Mw: $4 \times 10^4$

SYNTHESIS EXAMPLES 3 TO 6 OF RESIN GRAIN (L): (L-3) TO (L-6)

Each of resin grains was synthesized in the same manner as in Synthesis Example 1 of Resin Grain (L), except for replacing Monomer (LM-1), ethylene glycol dimethacrylate and methyl ethyl ketone used in Synthesis Example 1 of Resin Grain (L) with each of the compounds shown in Table 9 below, respectively. An average grain diameter of each of the resulting resin grains was in a range of from 0.15 to 0.30 μm.

TABLE 9

| Synthesis Example of Resin Grain (L) | Resin Grain (L) | Monomer (LM) | Polyfunctional Monomer for Crosslinking | Amount | Reaction Solvent |
|---|---|---|---|---|---|
| 3 | L-3 | $CH_2=C(CH_3)COO(CH_2)_2SO_2NHC_{10}F_{21}$ (LM-3) | Ethylene glycol dimethacrylate | 2.5 g | Methyl ethyl ketone |
| 4 | L-4 | 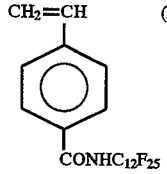 (LM-4) | Divinylbenzene | 3 g | Methyl ethyl ketone |
| 5 | L-5 | $CH_2=CH(CONHC_{12}F_{25})$ (LM-5) | — | | Methyl ethyl ketone |
| 6 | L-6 | $CH_2=CH(COO(CH_2)_2CONHC_8F_{17})$ (LM-8) | Trimethylolpropane trimethacrylate | 2.5 g | Methyl ethyl ketone |

EXAMPLE 1

A mixture of 2 g of X-form metal-free phthalocyanine (manufactured by Dainippon Ink and Chemicals, Inc.), 16 g of Binder Resin (B-1) having the structure shown below, 2 g of Binder Resin (B-2) having the structure shown below, separated by filtration to prepare a dispersion for a light-sensitive layer.

Binder Resin (B-1)

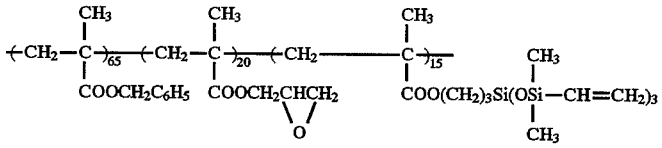

Mw: $6\times10^4$ (weight ratio)

Binder Resin (B-2)

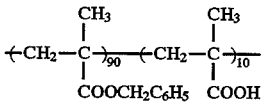

Mw: $8\times10^4$ (weight ratio)

Compound (A)

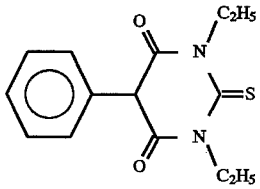

0.15 g of Compound (A) having the structure shown below, and 80 g of tetrahydrofuran was put into a 500 ml-volume glass container together with glass beads and dispersed in a paint shaker (manufactured by Toyo Seiki Seisakusho Co.) for 60 minutes. To the dispersion were further added 0.1 g of phthalic anhydride and 0.02 g of o-chlorophenol, followed by dispersing for 5 minutes. The glass beads were The resulting dispersion was coated on an aluminium plate having a thickness of 0.2 mm, which had been subjected to degrease treatment, by a wire bar, set to touch, and heated at 120° C. for 20 minutes to form a light-sensitive layer having a thickness of 8 μm.

Then, a surface layer for imparting releasability having a thickness of 1.5 μm was provided on the light-sensitive layer.

Formation of Surface Layer for Imparting Releasability

A coating composition comprising 10 g of silicone resin having the structure shown below, 1 g of crosslinking agent having the structure shown below, 0.1 g of platinum as a catalyst for crosslinking and 100 g of isoheptane was coated by a wire round rod, set to touch, and heated at 120° C. for 10 minutes to form the surface layer having a thickness of 1.5 μm. The adhesive strength of the surface of the resulting light-sensitive element measured according to JIS Z 0237-1980 "Testing methods of pressure sensitive adhesive tapes and sheets" was not more than 1.0 g·f.

Silicone Resin

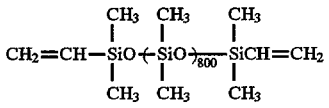

(presumptive structure)

Crosslinking Agent

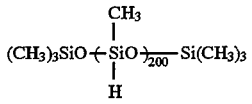

(presumptive structure)

Figure 6:
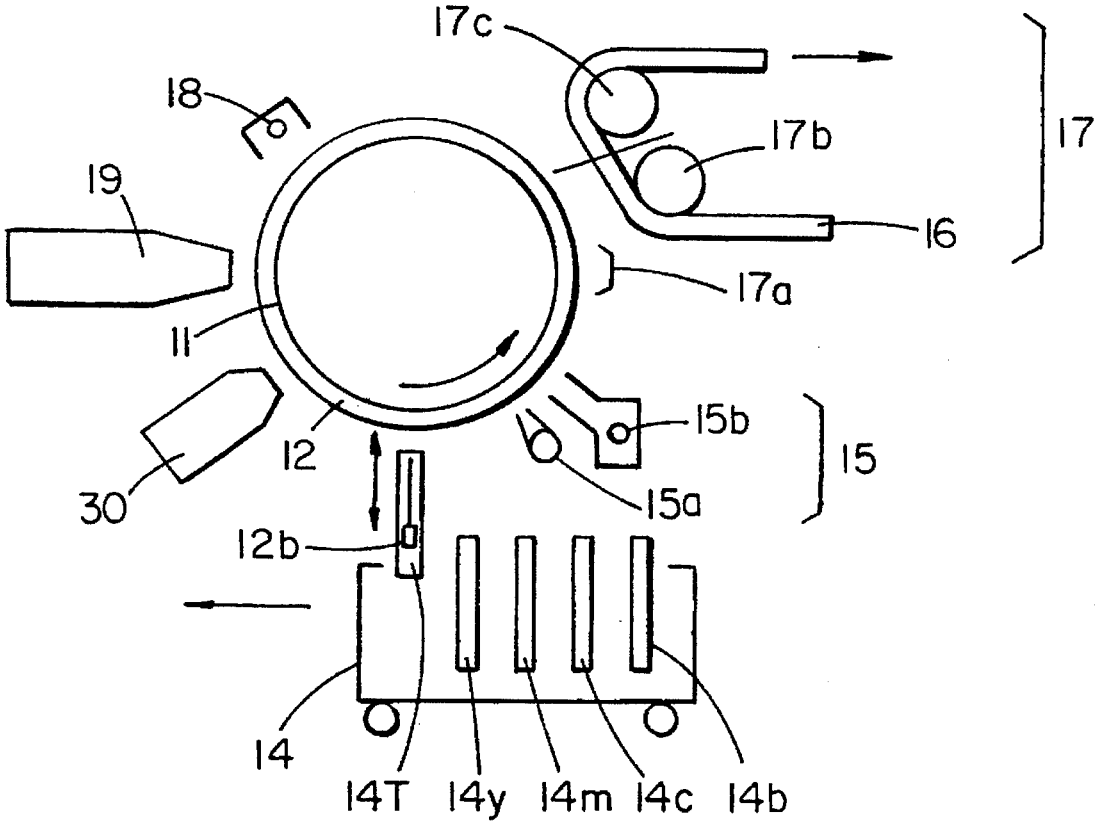
FIG. 6 is a schematic view of a transfer apparatus using an electrodeposition coating method for the formation of transfer layer.

The above-described light-sensitive element having the surface of releasability was installed in an apparatus as shown in FIG. 6 as an electrophotographic light-sensitive element. Transfer layer (X) was formed according to the electrodeposition coating method while applying Dispersion of Resin (A) (L-1) having the composition shown below to the surface of light-sensitive element using a device as shown in FIG. 6.

Dispersion of Resin (A) (L-1)

| | |
|---|---|
| Dispersion of Resin Grain (A): (ARH-1) | 5 g (solid basis) |
| Dispersion of Resin Grain (A): (ARL-1) | 5 g (solid basis) |
| Charge Control Compound (D-1) (octadecyl vinyl ether/N-tert-octyl maleic monoamide copolymer) | 0.03 g |
| Branched tetradecyl alcohol (FOC-1400 manufactured by Nissan Chemical Industries, Ltd.) | 10 g |
| Isopar G | up to make 1 liter |

Specifically, on the surface of light-sensitive element installed on a drum which was rotated at a circumferential speed of 150 mm/sec, Dispersion (L-1) described above was supplied using a slit electrodeposition device, while putting the light-sensitive element to earth and applying an electric voltage of −120 V to an electrode of the slit electrodeposition device, whereby the resin grains were electrodeposited. The dispersion medium was removed by air-squeezing using a suction/exhaust unit, and the resin grains were fused by a pre-heating means of an infrared line heater at a temperature of 100° C. to form a film, whereby a transfer layer composed of a thermoplastic resin was prepared on the light-sensitive element. A thickness of the transfer layer was 1.3 μm.

As a result of investigations on various characteristics of the electrophotographic light-sensitive element having the transfer layer and that having no transfer layer, almost same results were obtained although the former exhibited a residual potential 50 V higher than the latter.

An electrophotographic process was then performed. Specifically, the light-sensitive element 11 having the transfer layer (X) 12 provided thereon was charged to +550 V with a corona charger 18 in dark and image-exposed to light using a semiconductor laser having an oscillation wavelength of 788 nm as an exposure device 19 at an irradiation dose on the surface of the light-sensitive element of 30 erg/cm$^2$. The image exposure was in a negative image mode based on digital image data on an information for yellow color separation among digital image data on informations for yellow, magenta, cyan and black color separations which had been obtained by reading an original by a color scanner, conducting color separation and several corrections relating to color reproduction peculiar to a system and stored in a hard disc.

Thereafter, the exposed light-sensitive element was subjected to reversal development using a liquid developer prepared by diluting a positively charged yellow liquid developer for Signature System (manufactured by Eastman Kodak Co.) with 75-fold by weight Isopar H (manufactured by Esso Standard Oil Co.) and supplied to a yellow liquid developing unit 14*y* while a bias voltage of +350 V was applied to the yellow liquid developing unit 14*y* to thereby electrodeposit toner particles on the exposed areas. The light-sensitive element was then rinsed in a bath of Isopar H alone to remove any stains in the non-image areas, and dried by passing under a suction/exhaust unit 15 and a pre-heating means 17*a*.

The above procedure was repeated using each information for magenta, cyan and black in place of the information for yellow to form color toner images.

The light-sensitive element was then heated using the pre-heating means 17*a* and a temperature controller 17 so as to maintain the surface temperature of light-sensitive element at 50° C.

Formation of Transfer Layer (Y) on Toner Image

Transfer layer (Y) was formed using Dispersion of Resin (A) (L-2) having the composition shown below in the same manner as the formation of transfer layer (X) on the surface of light-sensitive element by the electrodeposition coating method using Dispersion of Resin (A) (L-1) above.

Dispersion of Resin (A) (L-2)

| | |
|---|---|
| Dispersion of Resin Grain (A): (ARL-2) | 10 g (solid basis) |
| Charge Control Compound (D-1) | 0.025 g |
| FOC-1400 | 10 g |
| Isopar G | up to make 1 liter |

By applying an electric voltage of −130 V to the electrophotographic light-sensitive element bearing the toner image, the transfer layer having a thickness of 1.5 μm was formed.

Then, as a receiving material coated paper was superimposed on the light-sensitive element 11 having the transfer layer formed on the toner images without cooling and they were brought into contact with a rubber roller for transfer, the surface temperature of which had been adjusted at 60° C. and subjected to heating and pressing under a nip pressure of 4 Kgf/cm$^2$ and at a drum circumferential speed of 200 mm/sec, whereby the toner images were wholly transferred together with the transfer layers onto the coated paper.

The duplicated images thus-formed on coated paper were visually observed their non-image areas and toner image areas using an optical microscope of 200 magnifications. Background stain due to toner in the non-image area was not observed.

Also, the color toner images were wholly transferred onto the coated paper without remaining on the light-sensitive element, and the duplicated images were excellent without cutting or disorder of images of high definition such as fine lines or fine letters and cutting or disorder of dots in highly accurate image portions such as half tone images.

Further, duplications of color image were conducted using high quality paper, plane paper, copying paper for PPC, recycled paper for copying and a PET film as receiving materials, respectively, in place of coated paper. On each of these receiving materials, duplicated images of good image quality similar to those on coated paper were obtained. The color images on the receiving materials had a sufficient strength since they were covered with the transfer layer (X), and they did not fall off when they were rubbed and did not peel in case of filing in various filing sheets. Moreover, retouching and sealing properties of the duplicates obtained were also good similar to those of plane paper.

The following comparative examples were conducted.

COMPARATIVE EXAMPLE 1

Color images were formed on coated paper in the same manner as in Example 1 of the present invention except for eliminating the formation of transfer layer (X) and transfer layer (Y). Partial cuttings of fine letters and fine lines were observed in the toner image areas on coated paper, and thus the duplicated image was poor.

Then, the transfer was conducted in the same manner as above except for changing the transfer conditions of Example 1 to conditions of heating and pressing and a transfer speed as described below. As a result, toner images were wholly transferred on coated paper and no residual toner was observed on the light-sensitive element. However, severe disorder of image on coated paper due to the occurrence of spreading or thinning of fine lines and fine letters was observed.

Transfer Conditions

| | |
|---|---|
| Temperature: | 120° C. |
| Pressure: | 10 Kgf/cm$^2$ |
| Transfer Speed: | 2 mm/sec |

COMPARATIVE EXAMPLE 2

Color images were formed on coated paper in the same manners as in Example 1 of the present invention except for eliminating the formation of transfer layer (Y). The transfer layer (X) and toner images were incompletely transferred and the residue thereof was observed on the light-sensitive element. Thus cuttings of toner images were formed in the color duplicate formed on coated paper.

Then, the transfer was conducted in the same manner as above except for changing the transfer conditions to those as described below. As a result, the toner images and transfer layer (X) were wholly transferred onto coated paper and cutting or disorder of image was not observed. A color duplicate equivalent to one in Example 1 was obtained.

Transfer Conditions

| | |
|---|---|
| Temperature: | 90° C. |
| Pressure: | 5 Kgf/cm$^2$ |
| Transfer Speed: | 50 mm/sec |

COMPARATIVE EXAMPLE 3

Color images were formed on coated paper in the same manners as in Example 1 of the present invention except for eliminating the formation of transfer layer (X). The result obtained was the same as that of Comparative Example 2 and specifically the transfer was incomplete.

Then, the transfer was conducted in the same manner as above except for changing the transfer conditions to those as described below. A color duplicate equivalent to one in Example 1 was obtained.

Transfer Conditions

| | |
|---|---|
| Temperature: | 80° C. |
| Pressure: | 5 Kgf/cm$^2$ |
| Transfer Speed: | 5 mm/sec |

From these results it can be seen that the transfer conditions can be moderated and the transfer speed can be increased according to the method of the present invention. Moreover, rapid transfer can be performed irrespective of the kind of a receiving material.

EXAMPLE 2

Figure 3:
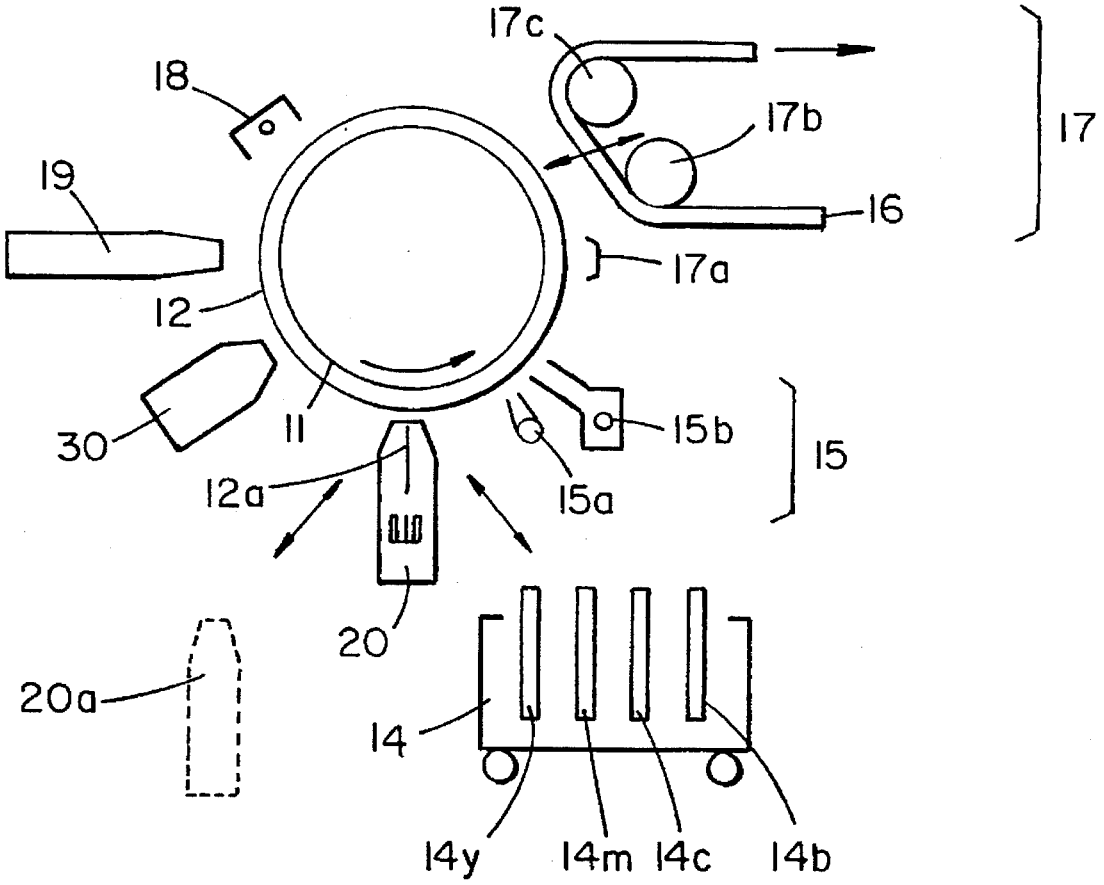
FIG. 3 is a schematic view of a transfer apparatus using a hot-melt coating method for the formation of transfer layer.

An amorphous silicon electrophotographic light-sensitive element (manufactured by KYOSERA Corp.) was installed in an apparatus as shown in FIG. 3.

Impartation of releasability to the light-sensitive element was conducted by dipping the light-sensitive element in a solution of the compound (S) according to the present invention (dip method) in the apparatus. Specifically, the light-sensitive element rotated at a circumferential speed of 10 mm/sec was brought into contact with a bath containing a solution prepared by dissolving 0.5 g of Compound (S-1) shown below in one liter of Isopar G (manufactured by Esso Standard Oil Co.) for 7 seconds and dried using air-squeezing. The adhesive strength of the surface of the light-sensitive element thus-treated was 3 g·f and the light-sensitive element exhibited good releasability.

Compound (S-1)

Silicone surface active agent (SILWet FZ-2171 manufactured by Nippon Unicar Co., Ltd.)

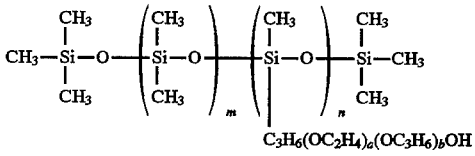

(presumptive structure)

Then, transfer layer (X) was formed on the light-sensitive element in the following manner.

An ethylene-vinyl acetate copolymer (content of vinyl acetate: 20% by weight; softening point measured by ring and ball method: 90° C.) was coated as a thermoplastic resin for the transfer layer (X) on the surface of light-sensitive element at a rate of 20 mm/sec by a hot melt coater adjusted at 120° C. and cooled by blowing cool air from a suction/exhaust unit, followed by maintaining the surface temperature of light-sensitive element at 30° C. A thickness of the transfer layer thus-formed was 2.0 μm.

The resulting electrophotographic light-sensitive material (hereinafter, simply referred to as light-sensitive material, sometimes) was charged to +700 V with a corona discharge in a dark place and exposed to light using a semiconductor laser having an oscillation wavelength of 780 nm on the basis of digital image data on an information for yellow color separation among digital image data on informations for yellow, magenta, cyan and black color separations which had been obtained by reading an original by a color scanner, conducting color separation and several corrections relating to color reproduction peculiar to a system and stored in a hard disc. The electric potential in the exposed area was +220 V while it was +600 V in the unexposed area.

The exposed light-sensitive material was pre-bathed with Isopar H (manufactured by Esso Standard Oil Co.) by a pre-bathing means installed in a developing unit and then subjected to reversal development by supplying a liquid developer prepared by diluting a positively charged yellow toner for an electrostatic color plotter (Versateck 3000 manufactured by Xerox Corp.) with 50-fold Isopar H from the developing unit to the surface of light-sensitive material while applying a bias voltage of +500 V to the developing unit side to thereby electrodeposite yellow toner particles on the unexposed areas. The light-sensitive material was then rinsed in a bath of Isopar H alone to remove stains in the non-image areas and dried by a suction/exhaust unit.

The above procedure was repeated using each information for magenta, cyan and black in place of the information for yellow.

On the toner images thus-formed was formed transfer layer (Y) using an ethylene-vinyl acetate copolymer in the same procedure described above. A thickness of the resulting transfer layer was 2.5 mμ.

Then, coated paper was superimposed on the light-sensitive material bearing the color toner images and they were passed between a pair of heating rubber rollers which were in contact with each other under a pressure of 5 Kgf/cm$^2$ and whose surface temperature was constantly maintained at 100° C. at a transportation speed of 100 mm/sec.

After cooling the sheets while being in contact with each other by passing under a cooling roller, the coated paper was stripped from the light-sensitive material whereby the toner images on the light-sensitive material were wholly heat-transferred together with the transfer layers onto the coated paper. Further, the toner images were completely covered with the thermoplastic resin of the transfer layer on the coated paper and thus they did not fall off when they were rubbed.

EXAMPLE 3

A mixture of 2 g of X-form metal-free phthalocyanine (manufactured by Dainippon Ink. and Chemicals, inc.), 17 g of Binder Resin (B-3) having the structure shown below, 0.15 g of Compound (B) having the structure shown below, and 80 g of tetrahydrofuran was put into a 500 ml-volume glass container together with glass beads and dispersed in a paint shaker (manufactured by Toyo Seiki Seisakusho Co.) for 60 minutes. To the dispersion were further added 3.2 g of Resin (P-2) described above, 0.05 g of phthalic anhydride, and 0.002 g of o-chlorophenol, followed by dispersing for 2 minutes. The glass beads were separated by filtration to prepare a dispersion for a light-sensitive layer.

Binder Resin (B-3)

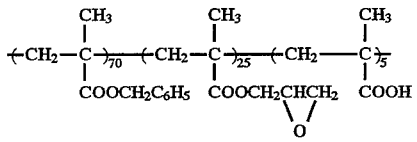

Mw: $7 \times 10^4$

Compound (B)

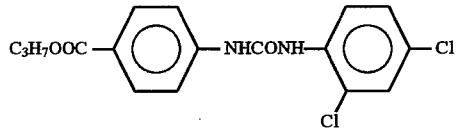

The resulting dispersion was coated on an aluminum plate having a thickness of 0.2 mm, which had been subjected to degrease treatment, by a wire bar, set to touch, and heated in a circulating oven at 120° C. for one hour to cure, whereby a light-sensitive layer having a thickness of 8 μm was formed. The adhesion strength of the surface of the resulting electrophotographic light-sensitive element measured according to JIS Z 0237-1980 "Testing methods of pressure sensitive adhesive tapes and sheet" was 1 g·f.

For comparison, an electrophotographic light-sensitive element was prepared in the same manner as described above except for eliminating 3.2 g of Resin (P-2) according to the present invention. The adhesive strength of the surface thereof was more than 400 g·f and did not exhibit releasability.

Figure 4:
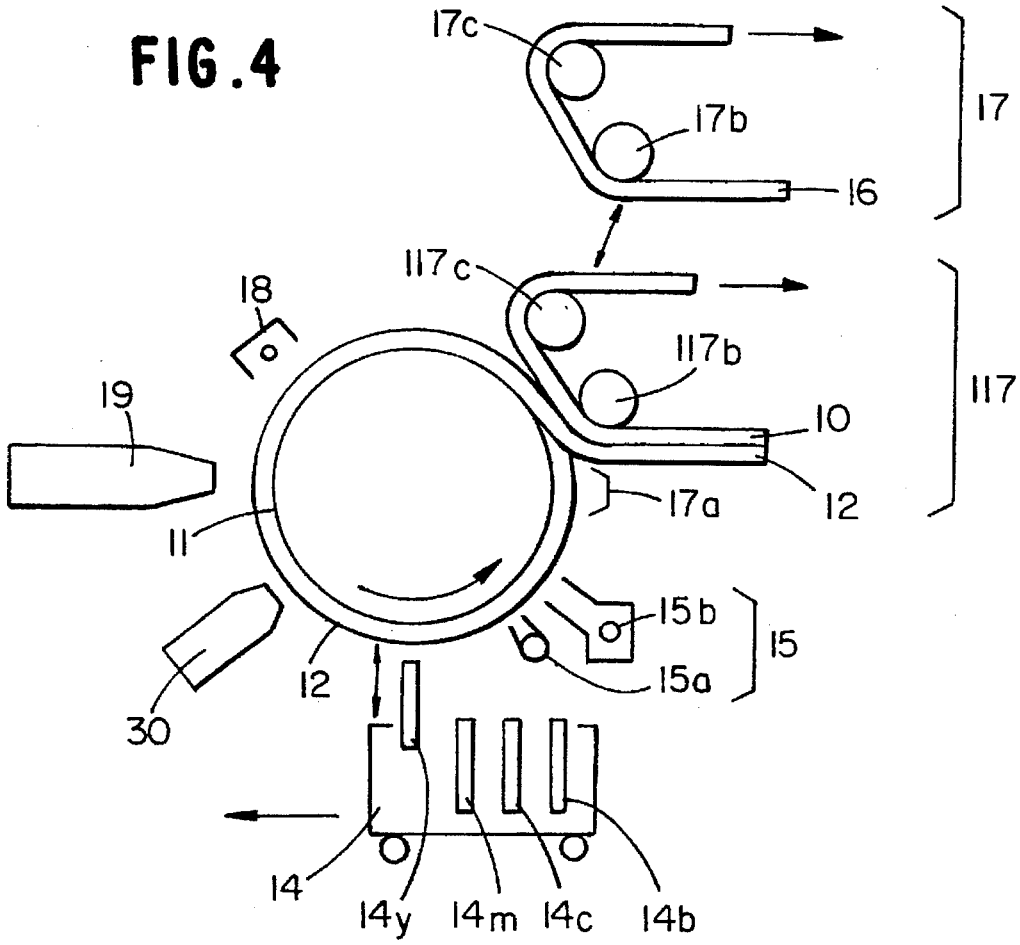
FIG. 4 is a schematic view of a transfer apparatus using a transfer method for the formation of transfer layer.

The light-sensitive element according to the present invention was installed in an apparatus as shown in FIG. 4. Transfer layer (X) was formed by the transfer method from release paper as shown in FIG. 4.

Specifically, on Separate Shi (manufactured by Oji Paper Co., Ltd.) as release paper, was coated a mixture of poly (vinyl acetate) having a glass transition point of 38° C. and poly(phenetyl methacrylate) having a glass transition point of 50° C. (5:5 by weight) to prepare the transfer layer having a thickness of 3 μm. The resulting paper was brought into contact with the light-sensitive element under the condition of a pressure between rollers of 3 Kgf/cm$^2$, surface temperature of 60° C. and a transportation speed of 10 mm/sec, whereby the transfer layer having a thickness of 3 μm was formed on the surface of light-sensitive element.

The resulting light-sensitive material was subjected to the formation of color images in the same manner as in Example 1 and then transfer layer (Y) having a thickness of 3 μm was formed thereon in the same procedure described above.

Transfer of the color toner images onto coated paper was performed in the same manner as in Example 1 to form a color duplicate. The color images obtained on coated paper were good and free from stain and had excellent image strength similar to those in Example 1.

EXAMPLE 4

An amorphous silicon electrophotographic light-sensitive element (manufactured by KYOCERA Corp.) was installed in an apparatus as shown in FIG. 6. Impartation of releasability and formation of transfer layer (X) on the surface of light-sensitive element were simultaneously conducted in the following manner thereby providing the transfer layer (X).

On the surface of light-sensitive element installed on a drum, whose surface temperature was adjusted to 50° C. and which was rotated at a circumferential speed of 10 mm/sec, Dispersion of Resin (A) (L-3) having the composition shown below was supplied using a slit electrodeposition device, while putting the light-sensitive element to earth and applying an electric voltage of −130 V to an electrode of the slit electrodeposition device, whereby the resin grains were electrodeposited and fixed. The transfer layer having a thickness of 1.5 μm was formed.

Dispersion of Resin (A) (L-3)

Resin Grain (AR-1) 8 g (solid basis)

Charge Control Compound (D-2) having the structure shown below 0.028 g

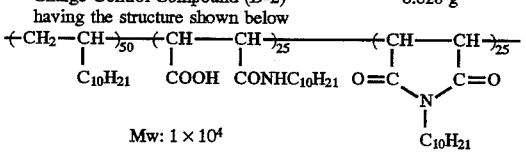

Mw: $1\times10^4$

Compound (S-2) 1.0 g

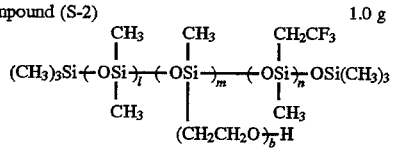

(presumptive structure)

Isopar G up to make 1 liter

On the light-sensitive material obtained by the imparation of releasability and formation of transfer layer (X) on the surface of light-sensitive element, color images were formed and transfer layer (Y) was provided thereon, then the color images were transferred onto coated paper in the same manner as in Example 2 to obtain a color duplicate.

The color images obtained were excellent because they were clear without the formation of background stain and degradation of image quality was hardly recognized as compared with the original.

EXAMPLE 5

A color duplicate was formed on coated paper in the same manner as in Example 2, except for replacing the means for imparting releasability to the light-sensitive element with the method described below. Good results similar to those in Example 2 were obtained.

Specifically, a metering roll having a silicone rubber layer on the surface thereof was brought into contact with a bath containing an oil of Compound (S-3) shown below on one side and with the light-sensitive. element on the other side and they were rotated at a circumferential speed of 15 mm/sec for 20 seconds. The adhesive strength of the surface of resulting light-sensitive element was 5 g·f.

Compound (S-3)

Carboxy-modified silicone oil (TSF 4770 manufacutured by Toshiba Silicone Co., Ltd.)

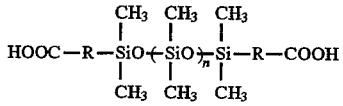

Further, a transfer roll having a styrenebutadiene layer on the surface thereof was placed between the metering roll dipped in the silicone oil bath of Compound (S-3) and the light-sensitive element, and the treatment was conducted in the same manner as above. Good result similar to the above was obtained.

Figure 7:
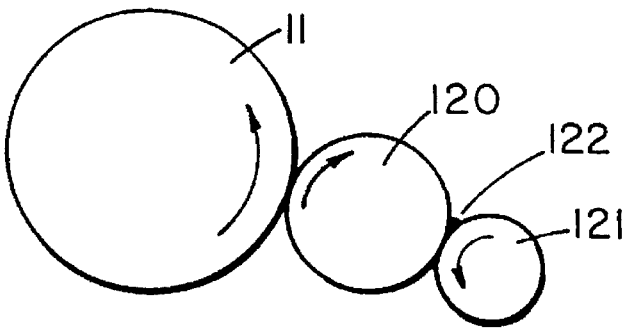
FIG. 7 is a schematic view of a device for applying a compound (S).

Moreover, in the above-described method using a metering roll/transfer roll system, Compound (S-3) was supplied between the metering roll 121 and the transfer roll 120 as shown in FIG. 7 and the treatment was conducted in the same manner as above. Again, good result similar to the above was obtained.

EXAMPLE 6

Color images were formed on coated paper in the same manner as in Example 2, except for replacing the means for imparting releasability to the light-sensitive element with the following method.

Specifically, an AW-treated felt (material: wool having a thickness of 15 mm and a width of 20 mm) impregnated uniformly with 2 g of Compound (S-5), i.e., dimethyl silicone oil KF-96L-2.0 (manufactured by Shin-Etsu Silicone Co., Ltd.) was pressed under a pressure of 200 g on the light-sensitive element and the light-sensitive element was rotated at a circumferential speed of 20 mm/sec for 30 seconds. The adhesive strength of the surface of light-sensitive element thus-treated was 6 g·f. The final color images on coated paper thus-obtained were good similar to those in Example 2.

EXAMPLE 7

Color images were formed on coated paper in the same manner as in Example 2, except for replacing the means for imparting releasability to the light-sensitive element with the following method.

Specifically, a rubber roller having a heating means integrated therein and covered with cloth impregnated with Compound (S-6), i.e., fluorine-containing surface active agent (Sarflon S-141 manufactured by Asahi Glass Co., Ltd.) was heated to a surface temperature of 60° C., then brought into contact with the light-sensitive element and they were rotated at a circumferential speed of 20 mm/sec for 30 seconds. The adhesive strength of the surface of light-sensitive element thus-treated was 3 g·f. The final color images on coated paper thus-obtained were good similar to those in Example 2.

EXAMPLE 8

Color images were formed on coated paper in the same manner as in Example 2, except for replacing the means for imparting releasability to the light-sensitive element with the following method.

Specifically, a silicone rubber roller comprising a metal axis covered with silicone rubber (manufactured by Kinyosha K.K.) was pressed on the light-sensitive element at a nip pressure of 600 g·f/cm$^2$ and rotated at a circumferential speed of 15 mm/sec for 10 seconds. The adhesive strength of the surface of light-sensitive element thus-treated was 18 g·f. The final color images on coated paper thus-obtained were good similar to those in Example 2.

EXAMPLES 9 TO 26

Color duplicates were prepared in the same manner as in Example 1 except for using each of the resin grains shown in Table 10 below in place of each of the resin grains (A) employed for the transfer layer (X) and transfer layer (Y).

TABLE 10

| Example | Transfer Layer (X) | | Transfer Layer (Y) | |
|---|---|---|---|---|
| 9 | ARH-4 | (100) | ARL-2 | (100) |
| 10 | ARH-5 | (50) | ARL-3 | (100) |
| | ARL-1 | (50) | | |
| 11 | AR-2 | (100) | ARL-1 | (100) |
| 12 | ARH-7 | (100) | ARL-3 | (100) |
| 13 | ARH-3 | (60) | ARL-5 | (100) |
| | ARL-8 | (40) | | |
| 14 | AR-10 | (100) | ARL-6 | (100) |
| 15 | AR-9 | (90) | ARL-15 | (100) |
| | ARL-15 | (10) | | |
| 16 | ARH-6 | (40) | ARL-12 | (100) |
| | ARL-7 | (60) | | |
| 17 | ARH-8 | (40) | ARL-16 | (100) |
| | ARL-3 | (60) | | |
| 18 | ARH-3 | (50) | ARL-8 | (100) |
| | ARL-5 | (50) | | |
| 19 | ARH-1 | (70) | ARL-9 | (100) |
| | ARL-12 | (30) | | |
| 20 | AR-3 | (100) | ARL-10 | (100) |
| 21 | AR-4 | (100) | ARL-4 | (100) |
| 22 | AR-5 | (100) | ARL-11 | (100) |
| 23 | ARH-3 | (100) | ARL-13 | (100) |
| 24 | ARH-1 | (100) | ARL-2 | (10) |
| | | | ARL-14 | (90) |
| 25 | ARH-9 | (70) | ARL-1 | (100 |
| | ARL-12 | (30) | | |
| 26 | AR-3 | (100) | ARL-3 | (100) |

A weight ratio is indicated in ( ).

The color images obtained on coated paper were clear duplicated images free from background stain and had sufficient image strength. Further, the residue of transfer layer was not observed at all on the surface of light-sensitive element after the transfer procedure.

Moreover, each of the coated paper obtained was held in a commercially available file made of vinyl chloride sheets, loaded with a weight of 1 kg and stored under condition of 30° C. and 80% RH for one week to visually evaluate the occurrence of transfer of the transfer layer and toner images onto the vinyl chloride sheet. As a result, it was found that the color images did not peel and had excellent image preservability.

Furthermore, the color duplicates had good retouching property by a pencil having hardness of HB or a ball-point pen of an aqueous type or an oily type and sealing property similar to those of plane paper.

EXAMPLES 27 TO 42

The procedure for the formation of transfer image same as in Example 2 was repeated except that each of the resins shown in Table 11 below was used in place of the ethylene-vinyl acetate copolymer for the transfer layer used in Example 2. Similar results to those in Example 2 were obtained. A glass transition point of each resin shown in Table 11 was in a range of from 20° C. to 80° C.

TABLE 11

| Example | Resin |
|---|---|
| 27 | Cellulose Acetate Butyrate (Cellidor Bsp manufactured by Bayer AG) |
| 28 | Polyvinyl Butyral Resin (S-Lec manufactured by Sekisui Chemical Co., Ltd.) |
| 29 | Cellulose Propionate (Cellidoria manufacture Daicel Co., Ltd.) |
| 30 | Polyvinyl Acetate |
| 31 | Mixture of Vinyl Acetate/Crotonic Acid (99/1 by weight) Copolymer and Cellidor Bsp (8/2 by weight) |
| 32 | Methyl Methacrylate/Methyl Acrylate (60/40 by weight) Copolymer |
| 33 | Polypropyl Methacrylate |
| 34 | Mixture of Polyvinyl Methyl Ether and Polyvinyl Acetate (5/5 by weight) |
| 35 | Styrene/Butadiene Copolymer |
| 36 | Styrene/Butadiene Copolymer (Sorprene 1204 manufactured by Asahi Kasei Kogyo K.K.) |
| 37 | Polydecamethylene Terephthalate |
| 38 | Polydecamethylene Isophthalate |
| 39 | Styrene/Vinyl Acetate (20/80 by weight) Copolymer |
| 40 | Polyhexamethylene Succinate |
| 41 | Poly-4-methylpentene-1 |
| 42 | Polypentamethylene Carbonate |

EXAMPLES 43 TO 49

Color images were formed on coated paper in the same manner as in Example 3 except that the formation of transfer layer was performed in the following manner.

Formation of Transfer Layer

Figure 5:
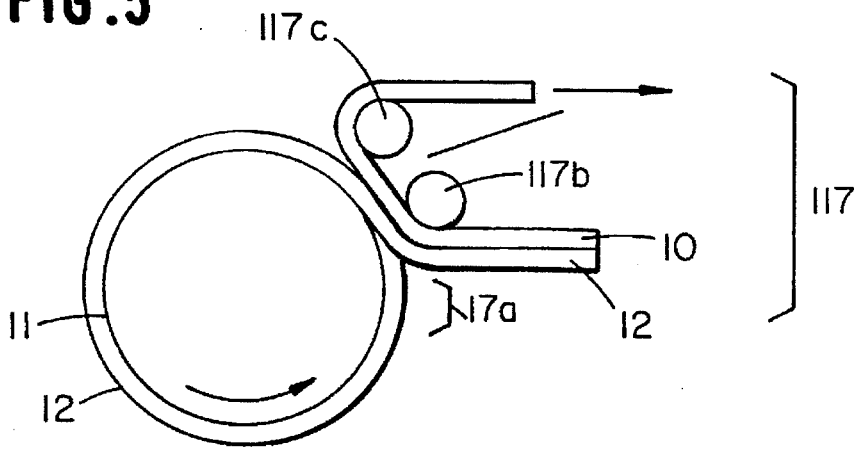
FIG. 5 is a schematic view of a device for the formation of transfer layer on a light-sensitive element utilizing release paper.

On release paper (Sanrelease manufactured by Sanyo-Kokusaku Pulp Co., Ltd.) was provided a transfer layer having a thickness of 4 μm composed of each of the resins (A) shown in Table 12 below. The resulting paper was installed in a heat transfer means 117 of a device shown in FIG. 5 and the transfer layer was peeled from the release paper and transferred onto the surface of light-sensitive element under conditions of a nip pressure of the rollers of 3 Kgf/cm$^2$, surface temperature of 80° C. and a transportation speed of 50 mm/sec. A glass transition point of each resin shown in Table 12 was in a range of from 10° C. to 60° C.

TABLE 12

| Example | Resin (A) |
|---|---|
| 43 | Mixture of Vinyl Acetate/Vinyl Butyrate (8/2 by weight) Copolymer and Benzyl Methacrylate/Methyl Methacrylate (8/2 by weight) Copolymer (60/40 by weight) |

TABLE 12-continued

| Example | Resin (A) |
|---|---|
| 44 | 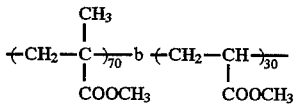 Mw: $4\times10^4$ (—b— indicates a bond between blocks) |
| 45 | 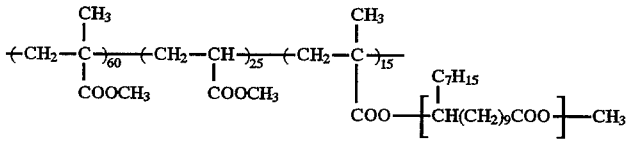 Mw: $4\times10^4$ (Mw of graft portion $4\times10^3$) |
| 46 | 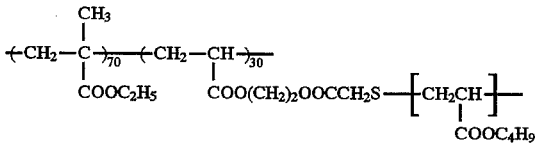 Mw: $4\times10^4$ (Mw of graft portion $6\times10^3$) |
| 47 | Mixture of Vinyl Acetate/Vinyl Propionate (7/3 by weight) Copolymer and Evaflex ® 420 (70/30 by weight) |
| 48 | Mixture of 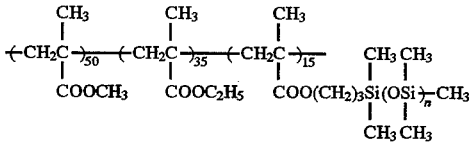 Mw: $5\times10^4$ (Mw of graft portion $1\times10^4$) and Polyvinyl Acetate (40/60 by weight) |
| 49 | Mixture of 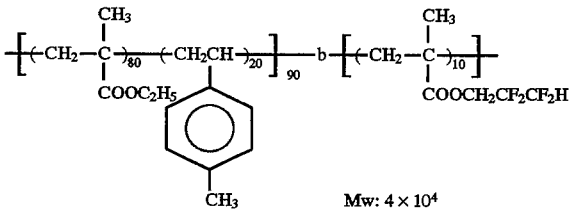 Mw: $4\times10^4$ and Vinyl Acetate/Vinyl Butyrate/Crotonic Acid (82/15/3 by weight) Copolymer (5/5 by weight) |

The color images obtained were clear and free from background stain, and degradation of image quality was not substantially observed as compared with the original.

These results illustrate that in a case wherein a first transfer layer (X) is formed on the light-sensitive element using release paper and, after the formation of toner image, a second transfer layer (Y) is formed in the same manner as above thereon, then both transfer layers are transferred onto coated paper, the transfer layer is uniformly and completely transferred at each transfer step without any adverse effect on image quality.

EXAMPLE 50

5 g of 4,4'-bis(diethylamino)-2,2'-dimethyltriphenylmethane as an organic photoconductive substance, 4 g of Binder Resin (B-4) having the structure shown below, 0.8 g of Resin (P-3) described above, 40 mg of Dye (D-2) having the structure shown below, and 0.2 g of Anilide Compound (C) having the structure shown below as a chemical sensitizer were dissolved in a mixed solvent of 30 ml of methylene chloride and 30 ml of ethylene chloride to prepare a dispersion for light-sensitive layer.

Binder Resin (B-4)

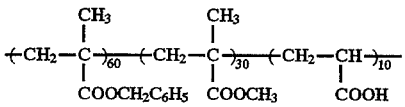

Mw $8\times10^4$

-continued

Dye (D-2)

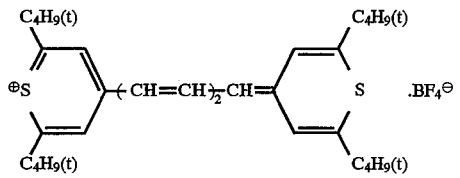

Anilide Compound (C)

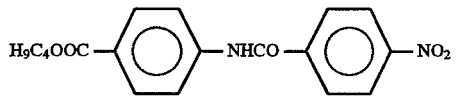

The resulting dispersion for light-sensitive layer was coated on a conductive transparent substrate composed of a 100 μm-thick polyethylene terephthalate film having a deposited layer of indium oxide thereon (surface resistivity: $10^3\Omega$) by a wire round rod to prepare a light-sensitive element having an organic light-sensitive layer having a thickness of about 4 μm.

Using the resulting light-sensitive element in place of the light-sensitive element employed in Example 1, the same procedure as in Example 1 was repeated to prepare transferred images. The color duplicated images obtained on coated paper were clear and free from background stain and the image strength thereof was also good.

EXAMPLE 51

A mixture of 3 g of X-form metal-free phthalocyanine (manufactured by Dainippon Ink. and Chemicals, Inc.), 10 g of Binder Resin (B-5) having the structure shown below, and 80 g of tetrahydrofuran was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

The resulting- dispersion was coated on an aluminum substrate having a thickness of 0.2 mm, which had been subjected to degrease treatment, by a wire bar, set to touch, and heated in a circulating oven at 110° C. for 30 minutes to form a light-sensitive layer having a thickness of 9 μm.

Binder Resin (B-5)

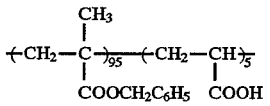

Mw: $8\times10^4$

In order to form an overcoat layer for imparting releasability on the surface of light-sensitive layer, a solution having the composition shown below was prepared.

Overcoat Solution

| Overcoat Solution | |
|---|---|
| Methyl methacrylate/glycidyl methacrylate (80/20 by weight) copolymer (Mw: $6\times10^4$) | 3 g |

-continued

| Overcoat Solution | |
|---|---|
| Resin (P-22) | 0.5 g |
| Phthalic anhydride | 25 mg |
| o-Chlorophenol | 2 mg |
| Toluene | 100 g |

The solution was coated on the light-sensitive layer with a wire bar at a dry thickness of 1.5 μm, dried in an oven at 100° C. for 20 seconds and then heated at 140° C. for 1 hour. The coated film was allowed to stand in a dark place at 20° C. and 65% RH for 24 hours to prepare an electrophotographic light-sensitive element.

The procedure same as in Example 1 was conducted except for using the resulting light-sensitive element in place of the light-sensitive element employed in Example 1 to prepare transferred images. The color duplicated images obtained on coated paper were clear and free from background stain and had good image strength.

EXAMPLES 52 TO 62

Each light-sensitive element was prepared in the same manner as in Example 3 except for using each of the resins (P) and/or resin grains (L) and compounds for crosslinking shown in Table 13 below in place of 1.5 g of Resin (P-2) and the compounds for crosslinking (i.e., phthalic anhydride and o-chlorophenol employed in Example 3.

TABLE 13

| Example | Resin (P) or Resin Grain (L) | Amount | Compound for Crosslinking | Amount |
|---|---|---|---|---|
| 52 | P-18 | 1.8 g | Phthalic anhydride | 0.2 g |
| | | | Zirconium acetylacetone | 0.001 g |
| 53 | P-22 | 3.0 g | Gluconic acid | 0.008 g |
| 54 | P-25 | 2.2 g | N-Methylaminopropanol | 0.25 g |
| | | | Dibutyltin dilaurate | 0.001 g |
| 55 | P-9 | 3.0 g | N,N'-Dimethylamino-propanediamine | 0.3 g |
| 56 | P-7 | 1.0 g | Propylene glycol | 0.2 g |
| | L-2 | 1.0 g | Tetrakis(2-ethylhexane-diolato)titanium | 0.008 g |
| 57 | L-6 | 3.5 g | — | |
| 58 | L-1 | 2 g | N,N-Dimethylpropanediamine | 0.25 g |
| | P-24 | 3.2 g | | |
| 59 | P-13 | 3.2 g | Divinyl adipate | 0.3 g |
| | | | 2,2'-Azobis(isobutyronitrile) | 0.001 g |
| 60 | P-14 | 2.5 g | Propyltriethoxysilane | 0.01 g |
| 61 | L-3 | 3.0 g | N,N-Diethylbutanediamine | 0.3 g |
| 62 | P-5 | 4.0 g | Ethylene diglycidyl ether | 0.2 g |
| | | | o-Chlorophenol | 0.01 g |

The same procedure as in Example 3 was conducted using each of the resulting light-sensitive element in a dark place to evaluate the image forming performance and transferability. The color duplicated images obtained on coated paper were clear and free from background stain and the image strength thereof was also good.

EXAMPLES 63 TO 68

Each color duplicate was prepared in the same manner as in Example 4 except for using each of the compounds (S) shown in Table 14 below in place of 1.0 g/l of Compound (S-2) employed in Example 4.

The results obtained were good and the same as those in Example 4. Specifically, the releasability is effectively imparted on the surface of light-sensitive element using the compound (S).

TABLE 14

| Example | | Compound (S) containing Fluorine and/or Silicon | Amount (g/l) |
|---|---|---|---|
| 63 | (S-7) | Higher fatty acid-modified silicone (TSF 411 manufactured by Toshiba Silicone Co., Ltd.) 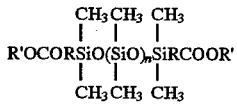 (presumptive structure) | 1.0 |
| 64 | (S-8) | Carboxy-modified silicone (X-22-3701E manufactured by Shin-Etsu Silicone Co., Ltd.) 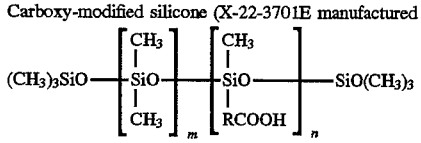 (presumptive structure) | 0.5 |
| 65 | (S-9) | Carbinol-modified silicone (X-22-176B manufactured by Shin-Etsu Silicone Co. , Ltd.) 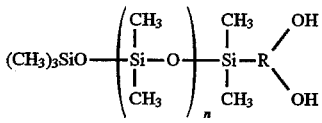 (presumptive structure) | 1.0 |
| 66 | (S-10) | Mercapto-modified silicone (X-22-167B manufactured by Shin-Etsu Silicone Co., Ltd.) 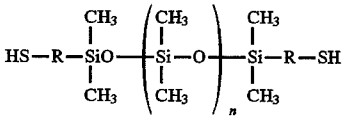 (presumptive structure) | 2 |
| 67 | (S-11) | 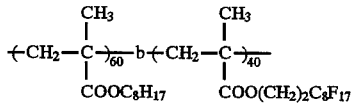 Mw: $6 \times 10^3$ | 1.5 |
| 68 | (S-12) | 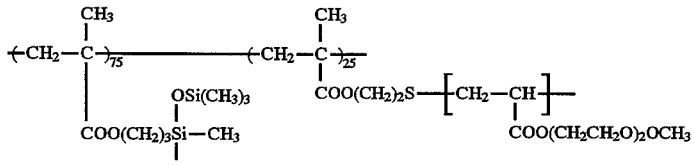 Mw: $8 \times 10^3$ (Mw of graft portion $3 \times 10^3$) | 2 |

EXAMPLE 69

A mixture of 5 g of a bisazo pigment having the structure shown below, 95 g of tetrahydrofuran, and 5 g of a polyester resin (Vylon 200 manufactured by Toyobo Co., Ltd.) was thoroughly pulverized in a ball mill. The mixture was added to 520 g of tetrahydrofuran with stirring. The resulting dispersion was coated on a conductive transparent substrate by a wire round rod to prepare a charge generating layer having a thickness of about 0.7 μm.

Bisazo Pigment

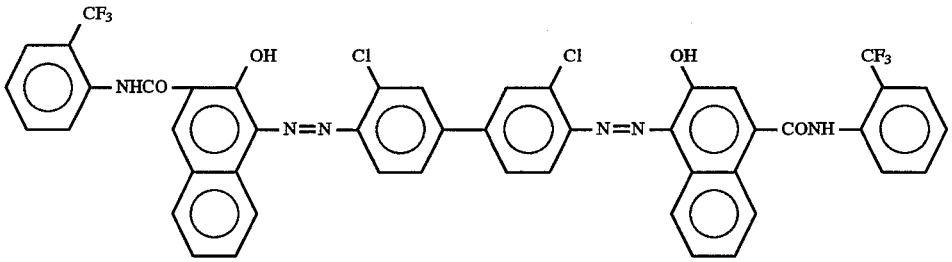

A mixed solution of 20 g of the hydrazone compound having the structure shown below, 20 g of a polycarbonate resin (Lexan 121 manufactured by General Electric Co., Ltd.) and 160 g of tetrahydrofuran was coated on the above-described charge generating layer by a wire round rod, dried at 60° C. for 30 seconds and then heated at 100° C. for 20 seconds to form a charge transporting layer having a thickness of about 18 μm whereby an electrophotographic light-sensitive element having a light-sensitive layer of a double-layered structure was prepared.

Hydrazone Compound

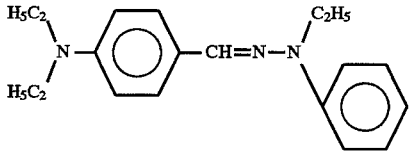

On the light-sensitive layer was formed a surface layer for imparting releasabiiity.

Formation of Surface Layer for Imparting Releasability

A coating composition comprising 10 g of silicone resin having the structure shown below, 1 g of crosslinking agent having the structure shown below, 0.2 g of crosslinking controller having the structure shown below, 0.1 g of platinum as a catalyst for crosslinking and 100 g of isoheptane was coated by a wire round rod, set to touch, and heated at 120° C. for 10 minutes to form the surface layer having a thickness of 1.5 μm.

Silicone Resin

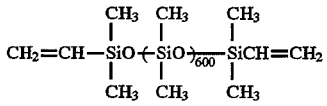

(presumptive structure)

Crosslinking Agent

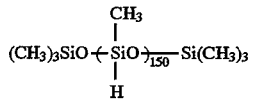

(presumptive structure)

Crosslinking Controller

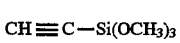

The adhesive strength of the surface of the resulting light-sensitive element measured according to JIS Z 0237-1980 "Testing methods of pressure sensitive adhesive tapes and sheets" was not more than 1.0 g·f.

The formation of toner images and transfer of the images onto coated paper were conducted in the same manner as in Example 1 using the resulting light-sensitive element in place of the light-sensitive element employed in Example 1 to prepare a color duplicate. However, electric charging and light exposure to the light-sensitive element were carried out in the following manner.

Specifically, the light-sensitive element 11 was charged to +500 V of a surface potential and exposed to light using a He—Ne laser having an oscillation wavelength of 633 nm at an irradiation dose on the surface of light-sensitive element of 30 erg/cm$^2$.

The color duplicate obtained had clear image free from background stain, and degradation of image quality was not substantially observed as compared with the original.

POSSIBILITY OF UTILIZATION IN INDUSTRY

The method and apparatus according to the present invention can be effectively employed for the formation of color images in electrophotographic color duplicators, color printers, color proofers or color checkers, etc.

What is claimed is:

1. A method of forming a color image comprising forming at least one color toner image by an electrophotographic process on a first peelable transfer layer provided on the surface of an electrophotographic light-sensitive element whose surface has releasability, forming a second transfer layer on the toner image and transferring the toner image together with the first transfer layer and the second transfer layer onto a receiving material.

2. A method of forming a color image as claimed in claim 1, wherein the surface of electrophotographic light-sensitive element has an adhesive strength measured according to JIS Z 0237-1980 "Testing methods of pressure sensitive adhesive tapes and sheets" of not more than 150 gram-force, before the formation of toner image.

3. A method of forming a color image as claimed in claim 1, wherein the electrophotographic light-sensitive element contains a polymer having a polymer component containing at least one of a silicon atom and a fluorine atom in its surface region adjacent to the first transfer layer.

4. A method of forming a color image as claimed in claim 1, wherein the electrophotographic light-sensitive element is caused by adsorption or adherence of a compound (S) containing at least a fluorine atom and/or a silicon atom onto its surface.

5. A method of forming a color image as claimed in claim 1, wherein the first transfer layer is formed by means of electrodeposition or adhesion of resin grains (AR) by electrophoresis on the surface of electrophotographic light-sensitive element to form a film using a dispersion for electrodeposition comprising resin grains (AR) having a glass transition point of not more than 140° C. or a softening point of not more than 180° C. dispersed in an electrically insulating organic solvent having a dielectric constant of not more than 3.5 and at least one compound (S) which has a fluorine atom and/or a silicon atom and is soluble at least 0.01 g per 1.0 liter of the organic solvent.

6. An apparatus for forming a color image comprising a means for forming a first peelable transfer layer on the surface of an electrophotographic light-sensitive element, a means for forming at least one color toner image on the transfer layer by an electrophotographic process, a means for forming a second peelable transfer layer on the toner image formed on the first transfer layer and a means for transferring the toner image together with the first transfer layer and the second transfer layer onto a receiving material.

* * * * *